US005988645A

United States Patent [19]

Downing

[11] Patent Number: 5,988,645

[45] **Date of Patent: *Nov. 23, 1999**

[54] MOVING OBJECT MONITORING SYSTEM

[76] Inventor: Dennis L. Downing, 403 David, Friendswood, Tex. 77546

[ * ] Notice: This patent is subject to a terminal disclaimer.

[21] Appl. No.: 08/754,682

[22] Filed: Nov. 21, 1996

Related U.S. Application Data

[62] Division of application No. 08/319,279, Oct. 6, 1994, Pat. No. 5,577,733, which is a division of application No. 08/225,257, Apr. 8, 1994, abandoned.

[51] Int. Cl.[6] ..... F41J 5/02

[52] U.S. Cl. ..... 273/348; 273/317; 273/371; 273/382; 434/16; 250/222.2

[58] Field of Search ..... 273/382, 371, 273/317, 348, 358, 366, 381, 404

[56] References Cited

U.S. PATENT DOCUMENTS

| | | | |
|---|---|---|---|
| 3,047,723 | 7/1962 | Knapp | 273/371 |
| 3,401,937 | 9/1968 | Rockwood et al. | 250/222.2 |

(List continued on next page.)

FOREIGN PATENT DOCUMENTS

| | | | |
|---|---|---|---|
| 0182397 | 10/1985 | European Pat. Off. . | |
| 2914329 | 11/1979 | Germany . | |
| 4005940 | 8/1991 | Germany . | |
| 41 14544 A1 | 8/1991 | Germany . | |
| 25696 | 1/1990 | Japan | 434/20 |
| 25697 | 1/1990 | Japan | 434/20 |
| 44198 | 2/1990 | Japan | 273/371 |
| 2175222 | 2/1985 | United Kingdom . | |
| PCT/US93/07227 | 3/1992 | WIPO . | |

OTHER PUBLICATIONS

Nonte, "Firearms Encyclopedia," pp. 7–9, 16–17, 20, 21, 116, 117, 138, 139, 164, 163, 230, 231, 246, 247, 270, 271; 1977.

Fadala, "The Rifleman's Bible," pp. 44–55, 68–73; 1987.

O'Conner, "Complete Book of Rifles & Shotguns," pp. 242–267; 1976.

Hornaday, "hornaday Handbook of Cartridge Reloading," pp. 2–9, 132–133, 386, 387, 468–471; 1992.

Speer, "Reloading Manual Number 11," pp. 80–91, 466–471, 482–487, 492–509, 542–547, 608–621; 1987.

Laurin Publishing Co., "The Photonics Design & Applications Handbook," Book 3, pp. H–176, H–177; 1994.

Technohunt, "The Interactive Archery Video System For The Future,"; 1993.

Dart Target Systems, "We Mean Businessm,"; 1993.

Synder, "Cylindrical Micro–optics," SPIE Proceedings; 1992.

(List continued on next page.)

*Primary Examiner*—Jessica J. Harrison

*Attorney, Agent, or Firm*—Guy McClung

[57] ABSTRACT

A method has been invented for monitoring an object passing through a frame space of a light panel, the light panel having at least one light emitter on the first side, the at least one light emitter for continuously emitting a fan-shaped light beam, across the frame through which and beyond which an object may pass, and at least one light detector on the second side of the frame and associated electronic sensing apparatus connected to the at least one light detector for continuously detecting the fan-shaped light beam from the at least one light emitter, the method including detecting with the at least one light detector and associated electronic sensing apparatus interruption by an object of the fan-shaped light beam continuously emitted by the at least one light emitter; and generating with the electronic sensing apparatus a signal signalling the interruption of the fan-shaped beam by the object. A light panel system has been invented for monitoring and determining information concerning moving or stationary objects. In one aspect the light beam is modulated. In one aspect such a panel has on-board electronics for calculating: object (e.g., but not limited to, bullet) location, size, shape, orientation and/or velocity. Methods are described for using such systems and such light panels.

38 Claims, 30 Drawing Sheets

U.S. PATENT DOCUMENTS

| | | | |
|---|---|---|---|
| 3,475,029 | 10/1969 | Hyman | 250/222 X |
| 3,487,226 | 12/1969 | Yetter et al. | 250/222 |
| 3,624,401 | 11/1971 | Stoller | 273/102.2 B X |
| 3,727,069 | 4/1973 | Crittenden, Jr. | 273/371 |
| 3,802,098 | 4/1974 | Sampson et al. | 273/102.2 |
| 3,807,858 | 4/1974 | Finch | 356/1 |
| 3,824,463 | 7/1974 | Oehler | 324/179 |
| 3,849,910 | 11/1974 | Greenly | 273/358 |
| 3,874,670 | 4/1975 | Weihl | 273/105.6 |
| 4,128,761 | 12/1978 | Oehler | 250/222 R |
| 4,142,723 | 3/1979 | Rief | 273/102.2 |
| 4,150,825 | 4/1979 | Wilson | 273/181 H |
| 4,155,096 | 5/1979 | Thomas et al. | 358/125 |
| 4,204,683 | 5/1980 | Fillippini et al. | 273/371 |
| 4,239,962 | 12/1980 | Oehler | 250/222 R |
| 4,243,879 | 1/1981 | Carroll et al. | 250/221 |
| 4,267,443 | 5/1981 | Carroll et al. | 250/221 |
| 4,384,201 | 5/1983 | Carroll et al. | 250/221 |
| 4,437,672 | 3/1984 | Armantrout | 273/181 H |
| 4,467,193 | 8/1984 | Carroll | 250/216 |
| 4,497,576 | 2/1985 | Caussigne et al. | 250/222.2 |
| 4,531,052 | 7/1985 | Moore | 235/404 |
| 4,563,005 | 1/1986 | Hand et al. | 273/371 |
| 4,645,920 | 2/1987 | Carroll et al. | 250/221 |
| 4,672,364 | 6/1987 | Lucas | 340/712 |
| 4,684,801 | 8/1987 | Carroll et al. | 250/221 |
| 4,698,489 | 10/1987 | Hickin et al. | 235/407 |
| 4,713,534 | 12/1987 | Masters et al. | 250/214 B |
| 4,761,637 | 8/1988 | Lucas et al. | 340/365 |
| 4,763,903 | 8/1988 | Goodwin et al. | 273/371 |
| 4,789,932 | 12/1988 | Cutler | 273/348 |
| 4,799,044 | 1/1989 | Masters et al. | 341/5 |
| 4,818,859 | 4/1989 | Hough | 250/221 |
| 4,845,690 | 7/1989 | Oehler | 368/113 |
| 4,890,500 | 1/1990 | Giles | 250/222.2 |
| 4,919,528 | 4/1990 | Pitalo et al. | 350/620 |
| 4,943,806 | 7/1990 | Masters et al. | 341/31 |
| 4,949,972 | 8/1990 | Goodwin et al. | 273/371 |
| 4,965,439 | 10/1990 | Moore | 235/404 |
| 4,970,589 | 11/1990 | Hanson et al. | 358/108 |
| 4,988,983 | 1/1991 | Wehrer | 340/712 |
| 5,015,840 | 5/1991 | Blau | 250/221 |
| 5,026,158 | 6/1991 | Golubic | 356/252 |
| 5,031,349 | 7/1991 | Vogel | 42/103 |
| 5,031,920 | 7/1991 | Poirier | 273/371 |
| 5,111,476 | 5/1992 | Hollenbeck et al. | 372/107 |
| 5,121,188 | 6/1992 | Partridge et al. | 357/74 |
| 5,198,661 | 3/1993 | Anderson et al. | 250/221 |
| 5,230,505 | 7/1993 | Paquet et al. | 250/206.2 |
| 5,310,192 | 5/1994 | Miyake | 273/310 |
| 5,316,479 | 5/1994 | Wong et al. | 434/11 |
| 5,328,190 | 7/1994 | Dart et al. | 273/371 |
| 5,375,072 | 12/1994 | Cohen | 364/561 |
| 5,382,026 | 1/1995 | Harvard et al. | 273/310 |
| 5,416,581 | 5/1995 | Kanngiesser | 356/343 |
| 5,437,463 | 8/1995 | Fromm | 3434/20 |
| 5,566,951 | 10/1996 | Dart et al. | 273/358 |
| 5,586,663 | 12/1996 | Graudejus et al. | 209/582 |
| 5,649,706 | 7/1997 | Treat, Jr. et al. | 273/371 |
| 5,727,789 | 3/1998 | Butts | 273/371 |
| 5,775,699 | 7/1998 | Orito et al. | 273/371 |
| 5,871,215 | 2/1999 | Butts | 273/371 |

OTHER PUBLICATIONS

NSG America Inc, "SELFOC Product Guide," 1993.
Welch Allyn, "Miniature Reflectors," 1993.
Power Technology Incorporated, "Laser Diode OEM Systems," 1993.
In Focus Systems, Inc., "Great Ideas Brought To Light," 1994.
PACT, "Professional Chronograph," 1993.
American Rifleman, "Rollabull Target Machine," pp. 55–56; 1992.
Dingle, "Federal Firearms Training Sets The Standard," pp. 10–13, Guns & Weapons, 1994.
Aagaard," PACT: The Answer Machines," pp. 38, 39, 83, 85, American Rifleman 1993.
Petty, "What's The Timer," pp. 36–37, 76, American Rifleman 1993.
Poly Optical Products, Inc., "Light Source Technical Data Poly Optical Products," 1992.
"Sunx Sensors," 1993.
Banner Eng. Corp., "Handbook of Photoelectric Sensing," 1993.
Motorola,"Optoelectronics Device Data," 1993.
Safford, et al, "Fiberoptics And Laser Handbook 2nd Edition," 1988.
"Ballistic Explorer The Friendly Ballistics Program," Jan. 1993.
Davis, "Oehler's Model 35 P Chronograph," 1994.
Oehler Research, "Oehler Ballistic Chronographs," 1994.
Schuh, "Interactive Video For Hunters," Sports Afield, May 1994.
Speith, "Shooting Range Equipment," 6 pages prior to 1993.
Office Action mailed Sep. 14, 1995 in U.S. 08/225,257—parent of this case.
"BARCODATA 5100 LC and 8100 LC," Barco, Inc.
"AMPRO Large Screen Projectors," AmPro Corporation.
"Packaging by passive cooling reduces manufacturing costs of laser diode arrays," Laser Focus World, 1994.
"... So Get Mobilized," Texas Microsystems, Inc., 1994.
"Jane's Military Training And Simulation Systems", 7th ed., 1994–95.
"Laser Diode OEM Systems and Components," Power Technology Incorporated, Feb. 1993.
"General Catalog KA–SW–07 Sensors," Keyence Co.
"General Catalog KA–ME–04 Measuring Instruments," Keyence Co.
"Optoelectronics Infrared Products," Honeywell Catalog E26, 1993.
"Optoelectronics Components Catalog," UDT Sensors, Inc.
"Going For The Glow," National Geographic World, Jun. 1994, pp. 3–6.
"Applied Laser Systems," Applied Laser Systems.
"Welcome To The World Of Lasiris," Lasiris, Inc.
"Diode Laser Instruments," Micro Laser Systems.
"Laser Diode Collimating And Objective Lenses," Optima Precision, Inc.
"Positioning Controls & Motor Drives," Design Components, Inc.
"Optoelectronics Data Book 1993, 1994," Siemens, Inc.
"Barcographics 808," Barco, Inc.
"Data Projections 1994 Catalog," Data Projections, Inc.
"Optoelectronics Device Data DL 118/D REV 4," Motorola, Inc.
"Short Form Vol. 41, Total Solution For PC—Based Industrial and Lab Automation," American Advantech Corporation.
"Pen Ray Lamps," UVP, Inc.
"LIMO Lissotschenko Mikrooptik," LIMO Gmbtt.
"Electro–Optical Product Guide," Aerotech, Inc.
"STI Product Databook," Scientific Technologies Incorporated.
PCT/EP95/01270, Int'l Search Report and cited references; this is the PCT counterpart of the parent of this case.

$$X = a + \frac{\sqrt{2a^2} \cdot \mathrm{SIN}(45° + \emptyset_e) \cdot \mathrm{SIN}\ \emptyset_E}{\mathrm{SIN}(90° - \emptyset_E - \emptyset_e)}$$

$$Y = a + \frac{\sqrt{2a^2} \cdot \mathrm{SIN}(45° + \emptyset_E) \cdot \mathrm{SIN}\ \emptyset_e}{\mathrm{SIN}(90° - \emptyset_E - \emptyset_e)}$$

MOVING OBJECT MONITORING SYSTEM

RELATED APPLICATION

This is a continuation-in-part of U.S. Ser. No. 08/319,279 filed on Oct. 6, 1994 entitled "Targeting System", U.S. Pat. No. 5,577,733 issued on Nov. 26, 1996, which is a continuation-in-part of U.S. Ser. No. 08/225,257 filed on Apr. 8, 1994, now abandoned, entitled "Target System", both applications co-owned and incorporated fully herein by reference in their entirety for all purposes.

BACKGROUND OF THE INVENTION

1. Field of the Invention

This invention is directed to monitoring systems and apparatus for determining information concerning moving or stationary objects; and in one particular aspect this invention is related to target systems and to computer-controlled systems for guns for shot monitoring, target projection, automatic sight adjustment, sight error calculation, calculation of ballistic parameters and display thereof, target replacement, and bullet recovery in an environmentally sensitive manner.

2. Description of Related Art

The prior art contains a wide variety of target systems and ballistic instruments. These include the subject matter of the references discussed below. These discussions do not present the subject matter of these patents in their entirety. Only a detailed review of the entire text and all drawings of these patents will reveal their complete disclosures.

U.S. Pat. No. 5,031,920 discloses a gun shooting range with a target chamber position at the target end where a still target is projected. A camera focused on a target on the chamber projects an image of the target to the shooting end where it is displayed on a screen of a video micrometer. The video micrometer has cross hair reticles that a shooter moves to place over a screen image of a target with a bullet hole and that measure a shot pattern generated on a roll paper target. The video micrometer has a tape recorder for recording the transmitted image, a printer for printing a hard copy of the pattern, a keyboard for data input, and is connectable to a computer for input and storage of the shot pattern data. A target feed mechanism is electrically controlled.

U.S. Pat. No. 5,031,349 discloses a method for aligning adjustable sights on a firearm with the point of bullet impact at a given range in which the sights are aligned during firing range testing including the use of a laser beam from a portable laser unit mounted on the firearm sights which beam indicates the alignment of the sights vis-a-vis the target. A spotting scope is used to detect a bullet's point of impact on a target. Gun sights are manually adjusted.

U.S. Pat. No. 5,026,158 discloses an apparatus and method for determining and recording a calculated impact point of one or more projectiles discharged from a firearm including a sighting mechanism with a field of view display unit, sensor elements, a recording unit, and a trajectory calculating microprocessor unit, the microprocessor unit for storing parameter data and for responding to sensor and/or manual data input signals and modifying the image presented by the field of view display unit. The trajectory calculating microprocessor unit, in response to the sensor data and parameter data, determines the trajectory of a projectile. The calculated impact point of the projectile is used to superimpose an indicia, namely an impact point-reticle on the image of the field of view of the display unit relative to the zero-range reticle or standard cross-hair setting. The system has a video camera with freeze-frame capability mounted on a rifle and a viewfinder displays scope cross-hairs and a second impact-point reticle which shows where the bullet would have impacted the target, based on the results of an on-board trajectory calculating microprocessor unit together with ballistic information on the trajectory, environmental factors (wind, barometric pressure, etc.), range of target, etc. Adjustment of the scope zero-range reticle is done manually on a firing range using live ammunition. Then the invention does not use ammunition and simulates a hunting experience by predicting and displaying the point of impact of an imaginary bullet on a target image frozen into the viewfinder.

U.S. Pat. No. 4,949,972 discloses an automatic target shooting system for determining projectile location relative to a target, calculating a score based upon the location and displaying a replica of the target with an indication of the location of the projectile relative to the target and the score. A target support structure defines a target area with criss-crossing X-Y-type coordinate light beams extending thereacross between light emitter devices and light receiving devices which generate output signals indicative of the location of a projectile during passage through the target area. The light beams are not modified by lenses or any light modifying device. The output signals are utilized by a computer device to identify the location of the projectile relative to the target and score the shot in accordance with the location. A replica of the target is displayed on a CRT screen with an indication of the location of the shot thereon and the score for the shot.

U.S. Pat. No. 4,919,528 discloses a boresight alignment verification device for testing sophisticated sighting and weapon systems used on various types of military aircraft and vehicles. The alignment device measures boresight error between a reference line of sight, a vehicle sighting system and a weapon system. The boresight alignment verification device is used to sight weapons on aircraft and vehicles while stationary. A collimated beam of light is generated by the optical verification device and transmitted through a telescoping periscope system of mirrors and prisms to a gun bore. An optical reference fixture is placed in the gun bore to reflect the light (e.g. back through the telescoping periscope) to sensor optics and a matrix camera contained in the main housing of the boresight alignment verification device. A computer in the unit stores the alignment data for later use. A matrix camera senses the different locations of the reference beam vs. the retroreflected beam.

U.S. 4,845,690 discloses a chronograph system with three shot-sensing screens which provide start and stop signals to interval-determining timers. The first screen provides a start signal to both timers and the subsequent screens provide stop signals to the first and second timers, respectively. The time intervals measured by these timers are divided into the distances between the screens to separately calculate two velocities based on two different distances. The calculated velocities are compared to evaluate the performance of the instrumentation so that measurement errors resulting from the instrumentation itself can be eliminated from analysis of the test shots.

U.S. Pat. No. 4,698,489 discloses a boresight correction system that determines the existing error between an aircraft gunsight and its gun systems while prescribed aircraft maneuvers are performed and which automatically corrects the gunsight system to compensate for this error. The system includes a sensor for detecting bullet positions, hardware that determines the bullet positions relative to the gun boresight, a digital processor to determine the above mentioned error, and to correct the gunsight system according to this error, and a non-volatile memory in the digital processor to store a corrected boresight position. A cockpit television camera records the path of projectiles fired from an aircraft while in flight. A video processor scans a sequence of frames received from the cockpit television and records the apparent location of the bullet path or position within the frame. Software in the digital processor calculates a relative error between the measured bullet positions and predicted (or desired) bullet positions. The gun boresight symbol is then adjusted accordingly to correct for sighting error.

U.S. Pat. No. 4,239,962 discloses a ballistic velocity measuring device with two photodetectors spaced apart by an accurately known distance along a projectile path exposed to ambient light from the sky. The system has a sunshield and light diffuser structure for each (or both) of the photodetectors to eliminate light reflection from the projectile which can cancel the "shadow" of the projectile and prevent the photodetector from responding to passage of the projectile; and to increase the level of light to the photodetectors by diffusing direct sunlight.

U.S. Pat. No. 4,204,683 discloses a device and method for detection of the shots on a target having a closed video circuit with a camera positioned adjacent the target to receive light influenced by a projectile about to hit the target. A monitor of the video circuit is positioned adjacent to a shooter and provides indication of the shooter's shot on the monitor. The camera captures the reflection of a projectile as it passes through a plane of light immediately in front of the target. The video image is then projected onto a monitor which scans the image to determine coordinates of the projectile's reflection.

U.S. Pat. No. 4,155,096 discloses a system for boresighting the laser of a laser designator system to the null point of an automatic television tracker by selectively causing the laser beam to be retroreflected to the video sensor of the system which interfaces with a television tracker. The tracker locks onto the retroreflected laser spot, with the tracker error signals, in a feedback control loop, being used to control the video sensor raster bias to center the sensor sweeps about the laser spot, thereby nulling the tracker error signals and achieving boresight with the laser automatically. This includes a method for boresighting a laser beam to be directed against a distant target. Laser designators are used in conjunction with laser guided weapon delivery systems to retroreflect a portion of laser energy back to the unit's television point tracker and imaging optics. A video sensor and error processing electronics adjust the laser's alignment until it is on-target. Error signal processing electronics automatically adjust the laser's alignment.

U.S. Pat. No. 4,128,761 discloses a system in which light perturbations sequentially produced by a projectile at spaced points are detected by photodetectors connected to a logarithmic diode circuit which is AC coupled to an amplifier time-shared by the detectors. Successive pulses from the amplifier are interpreted by logic circuits to start and stop an interval counter.

U.S. Pat. No. 3,824,463 discloses a shot cluster velocity measuring apparatus in which the coils through which the shot is to sequentially pass are mounted in axially spaced relation and are electrically connected as frequency determining elements in a high frequency oscillator, the output of which is frequency modulated as the shot cluster passes the coils. An FM discriminator generates an amplitude varying signal representative of the frequency modulation. A differentiating and filtering circuit shapes the discriminator output which is then amplified. The gain of a variable gain amplifier is automatically adjusted to equalize signal amplitude, and a Schmitt trigger produces rectangular pulses. If the pulses out of the trigger are of sufficient duration they are used to produce "start" and "stop" signals, indicating the passage of the center of mass of the projectile or projectile cluster through the first and second coils, respectively. These signals are then used to control an interval timer which displays the count as a measure of velocity.

U.S. Pat. No. 3,807,858 discloses a method and apparatus for determining the position at which a projectile passes through an area in space. Two light beams are projected to scan the whole of the area in space, and detector means are provided for detecting the reflections of said beams off a projectile passing through said area. Means are provided for determining the angular relationship of the reflected beams relative to established reference lines at spaced reference points to accurately determine by triangulation the position at which the projectile passes such area in space.

U.S. Pat. No. 3,727,069 discloses a target system for measuring the location and diameter of a projectile in a frame of reference, including vertical and horizontal banks of light sources for projecting collimated beams of light across the target area, and corresponding vertical and horizontal banks of light receptors for indicating the location and diameter of a projectile passing through the target frame. A plurality of light receptors receive impinging light from each light source, each light receptor receiving a predetermined portion of a corresponding collimated light beam. When a light beam is interrupted by a projectile, the light receptors indicate the location and diameter of a projectile in increments less than the width of the collimated beam. Output signals from the light receptors are converted to numerically coded signals by coupling the output signals from the light receptors to a plurality of amplifiers, less in number than the number of light receptors, according to a predetermined coding pattern. A system of lenses, slits and baffles is used to produce a matrix pattern of collimated light beams and focus them on corresponding light sensors to form a X-Y coordinate grid. Incandescent lamps or lasers are used. Two light panels are used in a chronograph arrangement. The light panel outputs signals from photocells coupled to amplifiers. The signals are processed by a digital computer or other device having a similar capability.

U.S. Pat. No. 3,624,401 discloses a scoring system for nonmaterial target by directing ultraviolet light across the face or front of the target in such manner that a projectile striking the target must pass through the ultraviolet light. Photoelectric sensors are arranged to detect ultraviolet light reflected from projectiles passing through the light and striking the target. The light passes through coded masks associated with each sensor. The coding of the masks is such that the sensors respond discretely to indicate the position of the projectile with respect to the target and thus a "hit" or a "miss." Ultraviolet light is projected from two sides into an area immediately in front of a target. Photoelectric sensors are arranged to detect UV light reflected from projectiles passing through the light beams and striking the target. Each photosensor has masks or slits so that it can sense relative angular location of a passing projectile. Using triangulation, the detector system outputs pulses of electricity which are counted. Different numbers of pulses correspond to different target hit locations. The pulse counters register the hits on the target and are connected to a decoding circuit to indicate the value of a particular hit. The decoding circuit forms an input to a register or recorder arranged to add the values of several hits and store the sum to keep the scores of several marksmanship trainees.

U.S. Pat. No. 3,487,226 discloses a method and electro-optical apparatus for deriving time signals from the passage of a bullet through a series of intersecting optical planes, the time signals being utilized to provide information on bullet velocity and on the azimuth and/or altitude of the bullet trajectory. Four panels or "screens" of collimated light beams are arranged so that all four planes of light are broken by the passage of a projectile through the device. Two panels are vertical and two are transverse. Three time interval measuring devices are used to clock the projectiles passing between successive light planes. This information is recorded and used to calculate the location (X-Y coordinate) of the projectile. The light sources are incandescent lamps or other electromagnetic radiation sources such as lasers, infrared, ultraviolet and microwave sources. Multiple light planes are used in a chronograph arrangement. A computer is used to automatically compute results. Chronograph outputs are connected to a small digital computer, which is programmed to automatically compute results such as the mean radius of a number of shots from center of impact, maximum deviation from center of impact, etc., as well as a correlation of each individual location with the velocity of the corresponding bullet. The system includes a printer for the computer.

U.S. Pat. No. 3,475,029 discloses a missile scoring detection system having spaced photoelectric sensing elements positioned to define a plurality of segmented indestructible target light matrices through which a missile may be propelled, a pumping system for establishing a fluid screen aligned with each target matrix, projectors for visually displaying indestructible target images on said fluid screen substantially aligned with said target matrices in line of intended missile fire, a signal circuit including transistors and AND gates responsive to said sensors in the passage of a missile through each segment of said matrices to develop output electrical signals, an electric display matrix responsive to said electrical signals for indicating the resultant accuracy of fire, and an instructor operated timer for unprogramed selection of the timing, location and duration of the projected images on said fluid screen. The display circuit means is connected to receive light interruption signals and to provide visual indication of the area of each of the light matrices penetrated by a missile and includes a counter for and connected to each AND circuit to visually indicate a hit in each cross ray area of said light matrices and to sum the hits in each area. Scoring is indicated by flashing a light or indexing a conventional resettable counter at a location on the operator's display panel corresponding to the relative location of the path of the projectile as sensed by the blocked light beams downrange. The display panel is a scaled replica of the light beam matrix located downrange. Projectors produce still target images and several projectors can be set up with a timer/shutter system to provide a sequence of different target images appearing at different times.

SUMMARY OF THE PRESENT INVENTION

The present invention, in certain embodiments, discloses a light panel system for monitoring and determining information concerning moving or stationary objects which pass through or are positioned within the light panel frame space; and in other embodiments, teaches a targeting system for a shooter of a gun which produces a video target image created by a video projector and projected on a target screen or surface downrange from the shooter's position. In one aspect the target image is projected on a blank target paper or blank screen which, in certain embodiments, may include a roll or fan-folded sheet stack of such target screen or surface so that different targets are presented to the shooter and/or a new target is provided to a new shooter. In other embodiments a target roll or fan-folded sheet stack is used with targets printed thereon. In one aspect a drive mechanism moves the roll or fan-folded sheet stack so that an old screen or surface with bullet hole(s) therein is removed and a new surface is provided on which is a target image or on which a target image is projected. A light panel is disposed between the target and the gun so that a bullet from the gun passes through the light panel which sends signals indicative of the bullet's location to a computer in which the signals are stored and, in one aspect, analyzed and compared with additional data such as previous bullet locations and ballistic performance data and parameters for such a bullet. In certain embodiments, a light panel sends signals to a computer indicative of a bullet's shape/size (i.e. image), orientation (e.g. pitch, yaw) and angle of arrival at the target.

In one embodiment of such a system the computer controls the target screen drive mechanism (either for a target roll or for a fan-folded sheet stack) and the video projector. In certain embodiments the computer selects a particular target image from a plurality of stored target images and this image is transmitted to the video projector for projection on the exposed target area or portion of the target screen. In certain embodiments using target rolls/sheets with target images printed thereon, a light(s) is used to illuminate the exposed target area. In certain other embodiments using target rolls/sheets with targets printed thereon, the target images use fluorescent material and/or are printed with fluorescent inks and an ultraviolet light source (black light) is used to illuminate the exposed target area.

In another embodiment a second light panel is disposed between the first light panel and the shooter so that signals are generated corresponding to the time of passage of the bullet through each light panel permitting the computer to calculate velocity of a bullet.

In one embodiment suitable light modifying devices (lenses, mirrors) are used to reduce or eliminate distortion of the projected target image. Bullet-proof and shock-isolated shields may be used with any of the parts of this system so that stray bullets do not damage the parts or affect accuracy; and a bullet trap may be employed behind the target to reduce or eliminate damage to the environment by the bullet(s).

In another embodiment the previously described systems include a computer monitor which displays a target image like the one on the target or the one being projected by the video projector on the target surface, screen or roll. After signals are received from the first light panel and processed by the computer, bullet hole location(s) are displayed on the target image on the computer monitor and/or tabular and/or graphical results of the shot and its position are also displayed on the monitor. In one aspect the computer transmits the image to an interconnected printer which provides a hard copy of any target image, data, calculations, or graph. In one aspect preprinted targets are used. In one embodiment such targets are preprinted on fluorescent material and/or with fluorescent ink or paint and a light projected onto the targets is ultraviolet light.

In one embodiment such systems include a sound system controlled by the computer which announces firing commands, firing sequences, bullet impact location(s), shot score, cumulative score, shot group size, and bullet data and parameters such as velocity or target impact location. In another embodiment the computer controls a computer-adjustable sighting or aiming device on a gun and changes sights and/or aim of a gun in response to results of processed shot data or in response to input and commands from the shooter.

In another embodiment preprinted targets are used, or the video projector projects images with areas which are scored differently (e.g. a typical bullseye with different scores for the bullseye and rings radiating from it or images of different size in series across a target area). The computer calculates a score for each shot; a cumulative score for the shooter; and similar data for additional shooters. In another aspect moving targets are provided by appropriate transmission of suitable video images and/or by moving the target screen. Systems according to this invention sense a second bullet passing through a location identical to that of a first bullet.

In one embodiment a light panel is disclosed with an X-Y rectangular coordinate light grid with one or more light beams transmitted from one or more emitters to one or more detectors, and, in certain embodiments, with fiber optic cable(s) to transmit light from light emitter(s) to a location on a panel frame, and/or from a location on the frame via fiber optic cable(s) to photosensor(s). Lenses may be used on the frame in conjunction with the fiber optic cables. One such light panel has a plurality of close collimated light beams from emitters detected by light detectors in an X-Y rectangular coordinate grid or matrix. Another such light panel utilizes light sources which emit fan-shaped planes of light beams from one panel side towards a plurality of closely-spaced light detectors located on opposite panel sides, or towards the end of one or more fiber optic cables for transmitting the light to a location, device, or sensor remote from the panel. Radial light beam paths are created between emitters and detectors. Mathematical equations may be used to convert the angular (polar) coordinates of the beam paths to rectangular X-Y coordinates. In one aspect a light panel according to this invention has one or more light sources which emit a spread-out or fan-shaped light, in one aspect in a plane. One such light source is a laser including a laser diode used with line generating lenses. In one embodiment a light panel according to the present invention has at least two emitters which emit fan-shaped light beams toward an associated plurality of light detectors associated with each emitter. The panel frame may have two or more sides and the frame may be any desired shape. In certain embodiments, a light panel has flat or curved mirrors or reflectors to reflect the planes of light beams from emitters to detectors.

In another embodiment a light panel has one fan-shaped emitter on one panel side and associated detectors on an opposite panel side (an "emitter/detector system" or "beam system") and is used to sense a moment-in-time at which an object passes through the central space in the panel frame. Moment-in-time signal can be used, in conjunction with a moment-in-time signal from another light panel spaced apart from the first panel at a known distance, to calculate the velocity and/or time of travel/flight of an object.

In one embodiment velocity of an object is determined with two different moment-in-time signals by two (or more) spaced-apart light panels, each with at least one fan-shaped emitter on one panel side and associated detectors on an opposite panel side. In one embodiment location coordinates and/or size/shape (e.g. image) and/or orientation (e.g. pitch, yaw) of an object passing through a light panel is determined with a panel with at least two fan-shaped emitters, one on one panel side and one on a panel top or bottom which is at an angle to the one panel side, with detectors associated with each emitter located on an opposite panel side. In another embodiment, angle of arrival of an object into a target plane/area is determined with two different location coordinate signals from two (or more) spaced-apart light panels. In certain embodiments two (or more) emitter/detector systems or beam systems are not located in identically the same orientation on a panel frame, i.e., when viewed from a position perpendicular to the planes of the light beams, the light beams from two emitter/detector systems on different sides of a single panel frame cross in order for an object's location coordinates, size/shape (e.g. image) and orientation (e.g. pitch, yaw) to be determined.

In one embodiment a single location coordinate-sensing light panel with two emitter/detector systems creating parallel planes of light beams is used to determine an object's coordinates, velocity, orientation and shape/size. Some finite distance exists between the two parallel planes of light beams of the two emitter/detector systems and the object passing through the panel frame travels perpendicular to the two planes. The beams in one first plane are interrupted at a slightly different moment-in-time than the beams in a second plane, and a velocity is calculated using the two different moment-in-time signals and the distance between the two light planes. In one preferred embodiment the accuracy and resolution of the velocity calculation is enhanced by spacing apart the two planes of light beams a desired distance (e.g. twelve inches); to produce high accuracy and resolution for determining object location coordinates, orientation and size/shape, in one preferred embodiment the two light beam planes are as close together as possible, or coinciding.

In another embodiment, a single light panel is used to determine the velocity of an object passing through the light panel when the length of the object in the direction of travel is known. In one embodiment, a light panel has light emitters that are turned on and off rapidly ("pulsed") and the light detectors associated with these emitters are tuned to respond only to modulated light pulses received from these emitters. In another embodiment, a light panel is used to sense the presence of an object passing through the light panel and to generate and transmit a signal to a computer or other device (e.g. but not limited to a timer, counter, switch, machine, motor, camera, or other electronic apparatus) at the moment the object's presence is sensed. In one embodiment, a light panel is used to sense the two-dimensional and/or three-dimensional image of an object passing through the light panel and to generate and transmit signals representing this information to a computer or other device. In another embodiment, a light panel measures/monitors the light transmittance of a translucent solid, or a liquid or gas flow stream.

The present invention, in certain aspects, discloses a method for monitoring an object passing through a frame space of a light panel, the light panel having a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam, across the frame through which and beyond which an object may pass, and at least one light detector on the second side of the frame and associated electronic sensing apparatus connected to the at least one light detector for continuously detecting the fan-shaped light beam from the at least one light emitter, the method including detecting with the at least one light detector and associated electronic sensing apparatus interruption by an object of the fan-shaped light beam continuously emitted by the at least one light emitter, and generating with the electronic sensing apparatus a signal signalling the interruption of the fan-shaped beam by the object; and such a method with two such light panels the method further including generating a first signal indicative of passage of the object through the frame space of a first light panel, transmitting the signal to a clock to start the clock to time amount of time for the object to go from the first light panel to a second light panel, generating a second signal indicative of passage of the object through a frame space of the second light panel, transmitting the second signal to the clock to stop the clock, recording with the clock time elapsed for passage of the object from the first light panel to the second light panel, and calculating, e.g. with a computer, velocity of the object based on the time elapsed and the known distance between the light panels.

In another aspect, in such a method the object is a first object and a plurality of objects passes sequentially through the light panel, the light panel and associated electronic sensing apparatus connected to totalling apparatus for receiving a plurality of signals from the associated electronic sensing apparatus, one signal corresponding to each object of the plurality of objects, and the method further includes generating a signal corresponding to a time each object passes through the frame space of the light panel, transmitting each signal to the totalling apparatus, totalling the number of signals received from the associated electronic sensing apparatus with the totalling apparatus and producing an output indicative of the total number of objects passing through the frame space, and totalling an amount of time elapsed for occurrence of the plurality of signals received from the associated electronic sensing apparatus with the totalling apparatus, and calculating with electronic calculating apparatus a rate of passage of objects through the light panel frame space based on the number of objects counted and the time elapsed.

In another aspect in such a method there are at least two spaced apart light emitters and at least two light detectors with at least one light detector positioned opposite each of the at least two spaced apart light emitters and wherein the light panel is disposed adjacent a menu diagram so that touching a portion of the menu diagram in a specific location with a touch member interrupts a specific part of the fan-shaped light beam, the at least one light detector comprising a plurality of light detectors and associated electronic sensing apparatus so that interruption of the specific part of the fan-shaped light beam is sensed by at least one of the plurality of light detectors and a signal is generated indicating which light detector sensed said interruption thereby indicating the portion of the menu diagram touched by the touch member, and the method further includes touching a portion of a menu diagram with a touch member, the menu diagram disposed adjacent the light panel so that in touching the portion of the menu diagram the touch member interrupts the fan-shaped light beam and said interruption is sensed by at least one of the light detectors and associated electronic sensing apparatus, generating a touch signal with the associated electronic sensing apparatus indicative of location of the touching and of the portion of the menu diagram touched by the touch member, and transmitting with the associated electronic sensing apparatus the touch signal to a signal receiving other device to activate the signal receiving other device. In another aspect a method is disclosed for generating a set of signals from light detectors on a panel as described herein whose beam portions are interrupted by an object, the set of signals corresponding to an image of the object; such a method including transmitting the set of images to an image device; such a method wherein the image device is a computer and the method includes calculating angles of pitch and yaw for the object or the method includes calculating with the computer an angle of arrival of the object, e.g. a bullet, on a target adjacent the light panel.

In certain aspects methods are disclosed according to the present invention: wherein the object is a first object, the first object and a plurality of objects flow through the frame space as a solids stream, and the image is an image of the solids stream, the image device is a computer and the method includes calculating with the computer a flow rate of the solids stream; wherein the light panel is connected to electronic calculating apparatus associated with the frame for calculating location coordinates of an object passing through the frame space, the associated electronic sensing apparatus connected to the electronic calculating apparatus, and the method includes calculating location coordinates of the object passing through the frame space; wherein the light panel is connected to electronic calculating apparatus associated with the frame for calculating size of an object passing through the frame space, the associated electronic sensing apparatus connected to the electronic calculating apparatus, and the method includes calculating size of the object passing through the frame space; wherein the associated electronic sensing apparatus is connected to electronic calculating apparatus which calculates velocity of an object passing through the light panel frame space, which object has first passed through a second light panel spaced apart from, on a common axis with, and interconnected in electronic communication with the light panel, and the method includes calculating velocity of the object passing through the light panel frame space; wherein the associated electronic sensing apparatus is connected to electronic calculating apparatus that transmits data to another device regarding the object, and the method includes transmitting the data to the another device; wherein the light emitter is a laser and there is lens means adjacent the laser, the laser for providing a laser light beam to the lens means, and wherein the lens means is a line generating lens emitting a fan-shaped plane of light, and the method includes generating a fan-shaped plane of light with the lens means.

In one aspect the present invention discloses a method for monitoring an object passing through a frame space of a light panel, with at least one light emitter on a first side, and at least one light emitter on a bottom, the method including detecting with the at least one light detector and associated electronic sensing apparatus interruption by an object of the fan-shaped light beams continuously emitted by the at least one light emitter, and generating with the electronic sensing apparatus a signal signalling the interruption of the fan-shaped beams by the object; and such a method including detecting with the associated electronic sensing apparatuses interruption of the light beams by an object passing through the frame spaces, calculating with the electronic calculating apparatus velocity and size and location coordinates of the object passing through the frame spaces and producing data indicative thereof, and transmitting the data to another device.

In one aspect a method according to the present invention is for monitoring a gas stream passing through a frame space of a light panel, the method including detecting with the at least one light detector and associated electronic sensing apparatus the portion of the fan-shaped light beam that passes through the gas stream, and generating with the electronic sensing apparatus a signal signalling the amount of the fan-shaped beam that passes through the gas stream.

In one aspect according to the present invention a method is disclosed using a light panel with at least two spaced apart light emitters and at least two light detectors, the method including sensing the object's interruption of the fan-shaped light beam with at least one of the light detectors and associated electronic sensing apparatus, and generating a signal with the associated electronic sensing apparatus indicative of location of the interruption by the object.

It is, therefore, an object of at least certain preferred embodiments of the present invention to provide:

New, useful, unique, efficient, safe, nonobvious devices and methods of their use for monitoring and determining information concerning moving or stationary objects;

Such devices in which light panel(s) send signal(s) to a computer which stores and processes them to produce data related to object time of detection, position, size, shape, orientation, motion (e.g. velocity) and optical characteristics (e.g. transmittance or translucence);

Such devices with which the computer controls a monitor which can selectively display object images and tables and/or graphs showing object data (e.g. size, time of detection);

Such devices in which light panel(s) send signal(s) to operate other devices or cause action to be taken to control a process;

New, useful, unique, efficient, safe, nonobvious devices and methods of their use for determining bullet location on a target, ballistic data and parameters of the bullet, and related methods;

Such devices with which stationary or moving video target images are displayed on a target area or moving target paper or screen;

Such devices in which targets, target image display, and/or target screen or roll/sheet movement by a drive mechanism are computer controlled;

Such devices in which light panel(s) send signal(s) to the computer which stores and processes them to produce data related to bullet velocity, size, shape, orientation and target impact location;

Such devices with which the computer controls a monitor which can selectively display target images, images showing bullet impact location, and tables and/or graphs showing bullet data and ballistic parameters;

Such devices which store such information and display summaries, comparisons, totals, and/or tables for multiple shots by one shooter or for multiple shooters;

Such devices which calculate and total scores for scored targets for one or more shooters;

Such devices which provide a hard copy of any of the results which the computer generates;

Such devices which provide a user means to interact with the computer to direct and control system operation and input information necessary for the computer to perform its functions;

Such devices including a computer-adjustable sight on a gun and a computer-driven apparatus for adjusting sights or aiming the gun;

Such devices including a bullet trap behind the target;

Such devices including a computer-controlled sound system for issuing commands, sequences, and results;

Such devices including bullet-proof shock-isolated shields, barriers, or protectors for some or all of the system components;

New, useful, unique, efficient, safe, and nonobvious computer-controlled sight adjustment systems;

New, useful, unique, efficient, safe, and nonobvious methods for using the above-listed items;

New, useful, unique, efficient and nonobvious methods employing a computer and appropriate computer software for accomplishing the various functions described according to this invention; and Such devices which compare the action of one or more bullets and their physical parameters with known tables of data for such bullets and, if desired, display the results.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
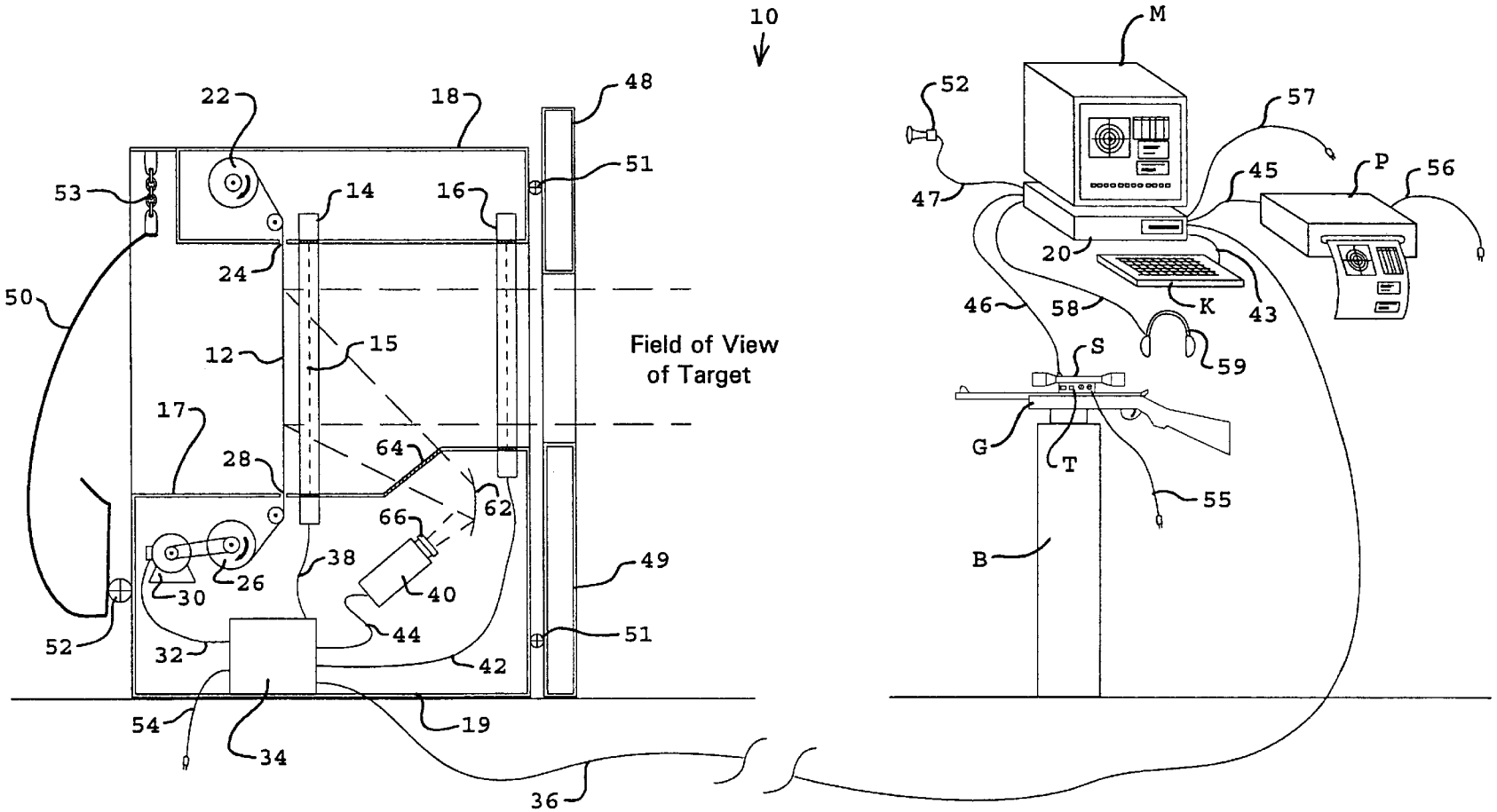
FIG. 1 is a schematic view of one target/ballistic system according to the present invention.
Figure 2:
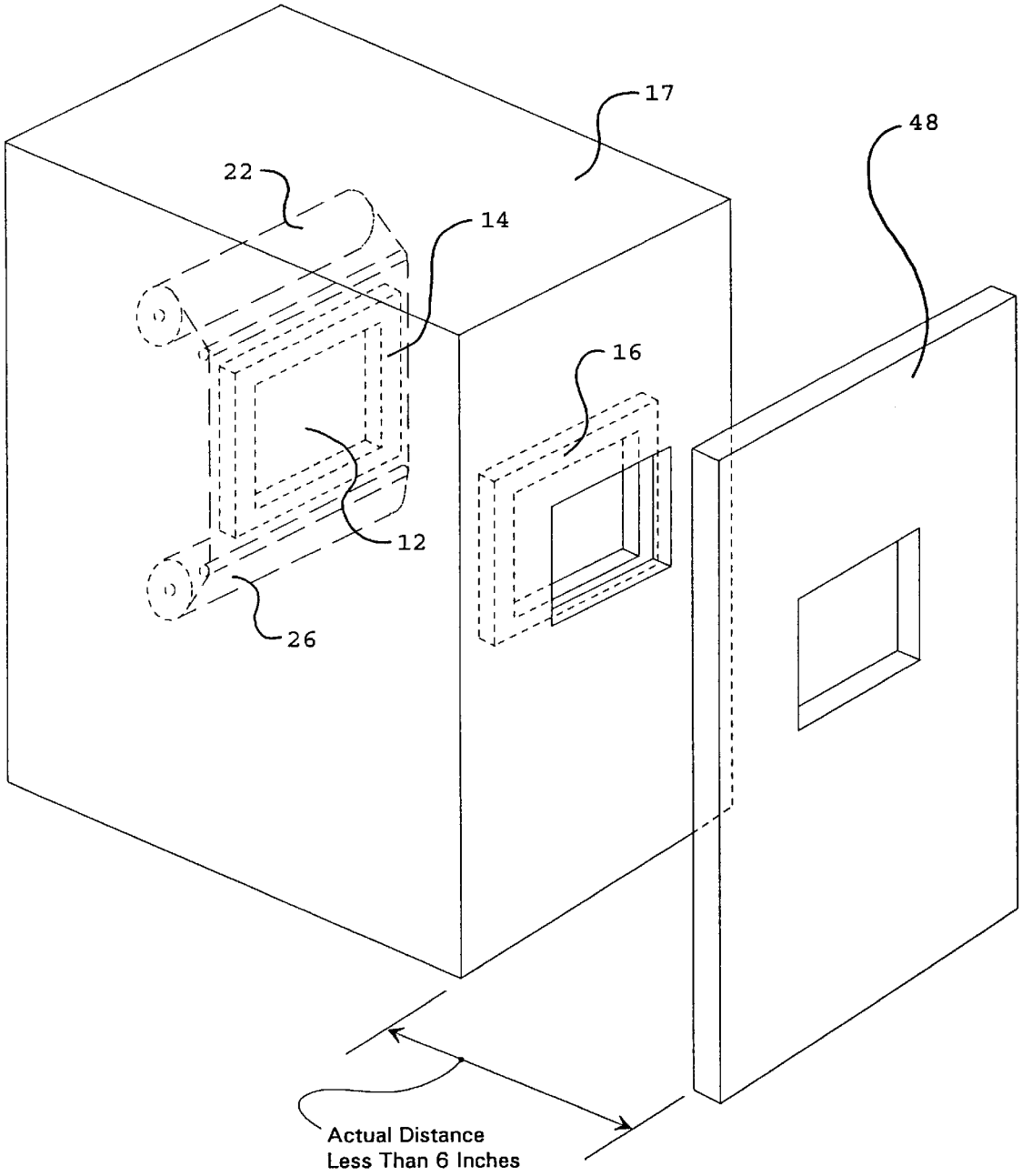
FIG. 2 is a partial perspective schematic view of the system of FIG. 1.

Referring now to FIGS. 1 and 2, a system 10 according to the present invention has a target screen 12 upon which impacts one or more bullets from a gun G on a bench B. Two light panels are positioned so that their light beams pass across an area through which bullets from the gun pass on their way to the target screen.

A first light panel 14 is mounted so that its light beams' paths (e.g. beam path 15) are relatively close to the surface of the target screen 12, preferably within about one inch of the screen or less and most preferably within one millimeter or less. Thus the location at which the bullets pass through the first light panel 14 corresponds to the point of impact on the target screen. Passage of a bullet through the first light panel generates a signal indicative of the bullet's location and moment-in-time of passage through the light panel. This signal is transmitted to a computer 20 which is discussed below and may be used to stop a timing clock whose timing operation is initiated by a signal from a second light panel.

Figure 13:
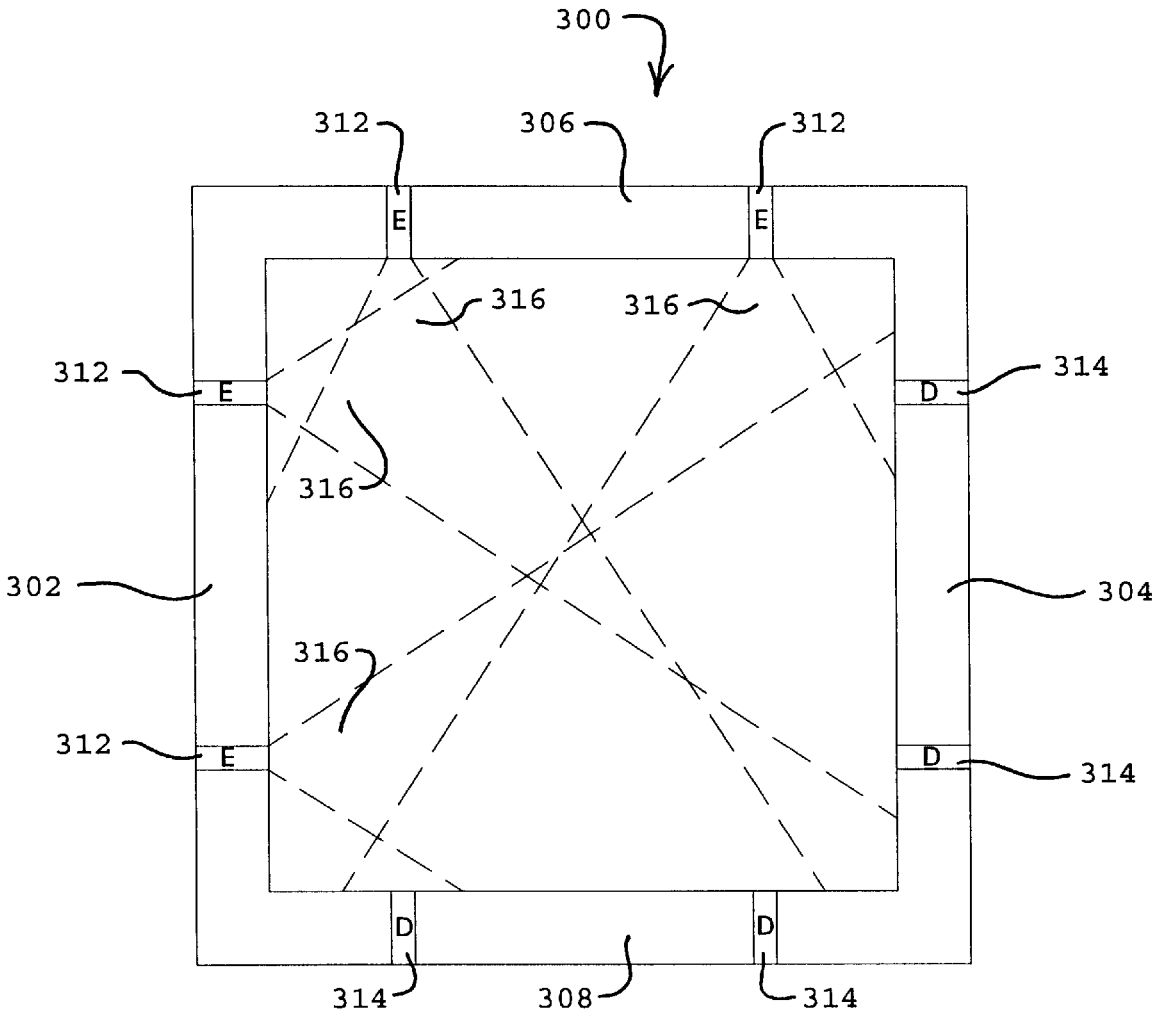
FIG. 13 is a front view of a chronograph light panel according to the present invention.

A second light panel 16 is positioned between the first light panel 14 and the gun G in one aspect at a known distance (stored e.g. in the computer's memory and/or the systems' electronics and accessible therein) from the first light panel 14. A bullet passing through an array of light beams of the second light panel 16 generates a signal indicative of the moment-in-time of passage of the bullet through the light panel (and, in certain embodiments, of the bullet's location). This signal is sent to the computer 20 and is processed as discussed below; e.g. this signal may be used to initiate a time period measurement or to start a timing clock. The light panels 14 and 16 are mounted within a housing 17 with a top 18 and a bottom 19. In one embodiment the panel 16 has only two pairs of emitter-detectors in each axis (vertical and horizontal) as shown in FIG. 13. Instead of using the first and second light panels to create and generate signals corresponding to time of projectile passage therethrough to determine velocity, a third light panel (not shown) is used, in certain embodiments, in conjunction with the second light panel for this purpose. In another embodiment the panel 16 has only a single emitter which illuminates a plurality of detectors (see e.g. FIG. 18). In certain embodiments the light panels 14 and 16 are identical.

A target screen roll 22 (or alternatively a fan-folded sheet stack of target material) is positioned in the top 18 of the housing 17 and the target screen 12 is fed through a hole 24. The target screen is re-wound on another roll 26 and fed to it through a hole 28 in the bottom 19 of the housing 17. A roll drive mechanism 30 rotates the roll 26 pulling the target screen 12 from the roll 22. A power cable 32 connects the mechanism 30 to an electronic controller, power supply, and computer interface device 34. A cable 36 interconnects the interface device 34 and the computer 20. A cable 38 interconnects the light panel 14 and the interface device 34. A cable 42 interconnects the light panel 16 and the interface device 34. A cable 44 interconnects a video projector 40 and the interface device 34. A cable 46 interconnects a sight device S of the gun G and the computer 20. A cable 47 interconnects a speaker 52 and the computer 20. A cable 45 interconnects a printer P and the computer 20. A monitor M is interconnected with the computer 20 and a cable 43 interconnects the computer 20 with a keyboard K. The printer P has a power cord 56. The computer 20 with the interconnected monitor M has a power cord 57. The movable sight mount T has a power cord 55. The interface device 34 has a power cord 54. Each power cord plugs into a suitable power supply (not shown). In one aspect of this invention instead of using a video projector to project a target image a preprinted target is used and a light source illuminates the preprinted target. "Computer monitor", "monitor" and "computer terminal screen" include, but are not limited to, cathode-ray tube (CRT) computer monitors, liquid crystal display (LCD) flat-panel computer display screens, advanced flat-panel computer display screens, video projector-based computer display screens, or any type of video display device or apparatus that may be interconnected with a computer for the purpose of displaying graphic information or data to a user. "Computer keyboard" and "keyboard" include, but are not limited to, any type of user interface device by which a user communicates with a computer, including alphanumeric keyboard, keypad, mouse, trackball, joystick, CRT touch input panel (touchscreen), scanner, bar code reader, modem, and voice recognition interface microphone with associated voice recognition computer software.

A bullet trap 50 is positioned behind the target screen 12 to stop and trap bullets passing through the target screen 12. The bullet trap 50 may be secured to the housing 17 or suspended behind it. This trap in one embodiment is made from thick steel plate or heavy steel mesh and, in one aspect, is curved away from the housing 17. A bulletproof shield 48 with a bottom portion 49 protects the housing 17 and its contents. In one embodiment the shield 48 is made from heavy steel plate or mesh. In another embodiment, the shield 48 has hollow internal cavities filled with energy absorbing material (e.g. sand). In one aspect shock absorbers 51 are mounted between the shield 48 and the housing 17; shock absorbers 52 between the rear of the housing and the trap 50; and a shock absorbing mount 53 supports the trap 50 from the top of the housing. Preferably the housing 17 is made from bullet-resistant or bulletproof material; in one aspect such material is capable of stopping deflected or ricocheting bullets. In housing areas where devices are to be protected from stray projectiles, but where provision is made for the transmission of light (e.g. light panels 14 and 16), bulletproof glass or acrylic material may be used to shield these devices.

In one embodiment the computer 20 stores a plurality of target images in its memory ("memory" including any type of computer-accessible storage media device interconnected to the computer system). A shooter selects an image to be projected on the target screen 12 by inputting a command into the computer 20 with the keyboard K. The selected image is sent via the cable 36, to the interface device 34, through the cable 44, and to the video projector 40. The video projector 40 projects the selected image through a lens 66, onto a mirror 62, through a lens 64, and then onto the target screen 12. Additional lenses, mirrors etc. are used to reduce or eliminate distortion of the image on the target screen 12 and the computer itself can modify the image to reduce/eliminate distortion of the image as projected. In another aspect the projector projects an image directly onto the target screen. In another embodiment, the target screen 12 has target images printed thereon and the video projector 40 or another light source illuminates the target upon command from the computer 20. The computer 20, upon request or automatically signals the monitor M to display and signals the printer P to print out a copy of the image as it appears on the target screen 12.

Following a shot, with the data provided by the signals from the two light panels 14 and 16, the computer calculates and stores the velocity of a bullet and the location of its point of impact on the target image on the target screen 12 (or alternatively electronics within or adjacent the light panels calculates actual bullet velocity and transmits the velocity value to the computer 20 along with X-Y coordinates for the bullet). The computer 20 then, either upon request or automatically, signals the monitor M to display the point of impact on the target image on the monitor and, upon request or automatically, signals the printer P to print out a copy of the target image with an indication of the point of bullet impact. In certain embodiments, with data provided by signals from the two light panels 14 and 16, the computer calculates and stores the shape, size, pitch, yaw and angle of arrival of a bullet as it impacts the target.

Upon request or automatically the computer 20 compares actual bullet performance data to known ballistic data and parameters which are stored in the computer's memory for use and for display. For example, a shooter according to one method of the present invention inputs details and data about the shooter's gun (caliber, barrel length, type-rifle, revolver, etc.) and ammunition (caliber, bullet weight, bullet type, etc.), the distance to the target, and atmospheric conditions. The computer uses "look up" data tables and equations relating the particular gun, the particular ammunition, and the shooting conditions and calculates a theoretical predicted bullet velocity which it announces in audio and/or displays on the monitor and/or prints out in hard copy. Upon request or automatically the computer 20 displays on the monitor M data for the bullet in tabular or graphical format. The computer 20 stores data (bullet velocity, location, score for each shot) and calculates and displays the data for a plurality of shots. If desired, a shooter commands the computer to store each entire target screen image after each shot or after a group of shots. For target images which have areas with different scores, the computer 20 receives signals indicative of bullet impact location and converts each such signal to a score; adds the scores for multiple shots; averages them; and, either upon request or automatically at any point in the process or when it is complete displays these results in a desired format on the monitor M and/or has the printer P provide them in a printed copy. The computer 20 also processes scores for multiple shooters at multiple target images and displays results as described and prints them as described. The computer 20 (automatically or upon request) calculates, stores, and displays, and/or prints average velocity; high, low, and extreme spread velocity; and velocity standard deviation for a plurality of shots and shot group size for a plurality of shots. In certain embodiments, the computer 20 calculates, stores, and displays, and/or prints average, high, low, extreme spread and standard deviation values for size, pitch, yaw and angle of arrival for a plurality of shots. The computer calculates and displays other factors relating to a bullet: e.g. (a) kinetic energy of bullet at target; (b) momentum of bullet at target; and (c) power factor of bullet at target. Then, knowing the distance to the target and the shooting conditions, the computer corrects the factors to give values at the gun's muzzle; e.g. (a) muzzle velocity, (b) muzzle energy, and (c) muzzle momentum.

The computer 20 controls both the video projector 40 and the target screen roll drive mechanism 30 and, as desired, produces moving target images on the target screen 12 using appropriate moving target image software. The computer controls interconnected storage media devices (e.g. CD-ROM drives, laser disk players) containing moving (or still) target images and causes the desired target image to be transmitted to the video projector 40 and monitor M at the appropriate time. In another embodiment the computer 20 controls the target screen roll/sheet drive mechanism and the target screen illumination light(s) that illuminate target screen material with target images printed thereon.

Figure 14:
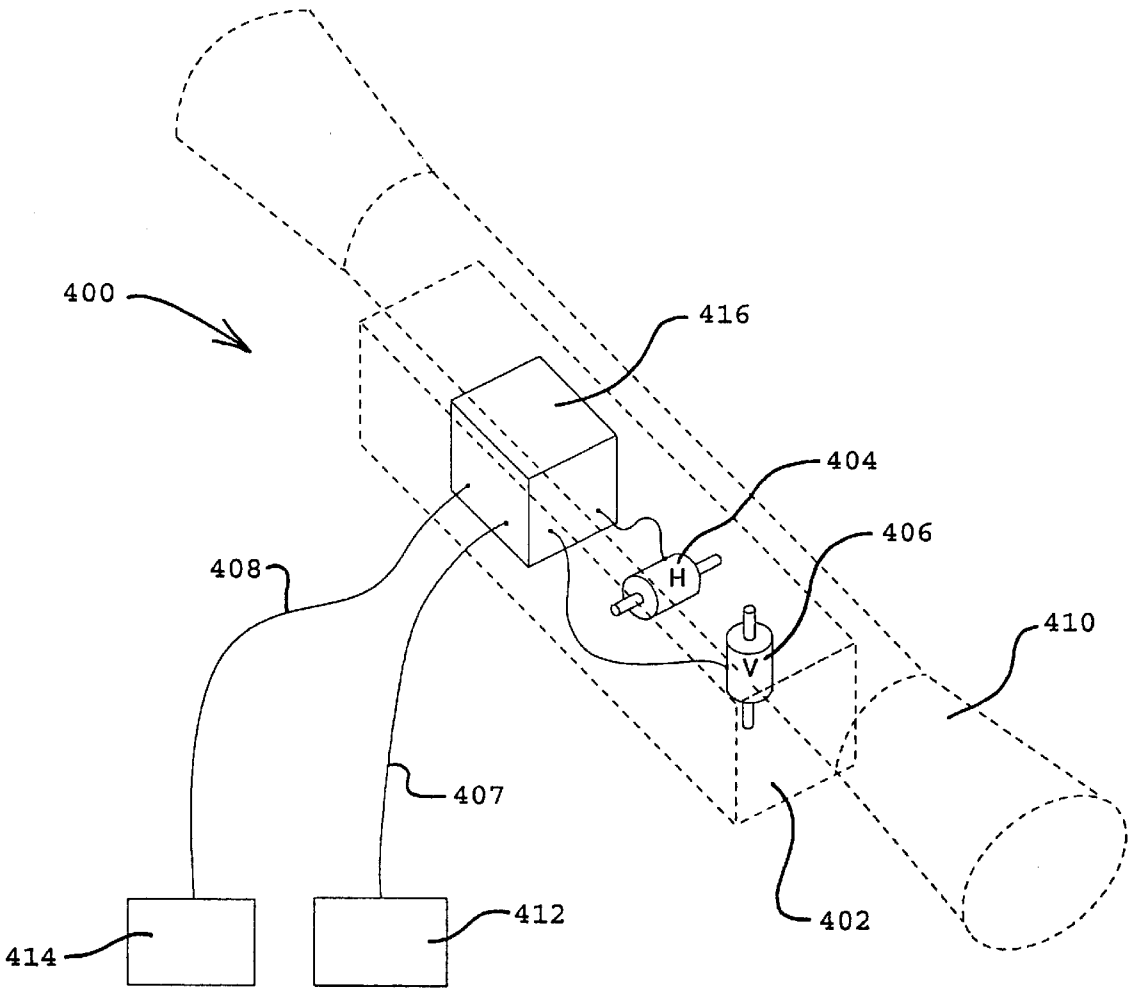
FIG. 14 is a perspective schematic view of a computer-controlled sight according to the present invention.

In one embodiment the computer-controlled sight S has a system of miniature electric servomotors and screw/rotary drive mechanisms which rotate horizontal and vertical sight adjustment "screws" on the sighting device upon receiving adjustment signals from the system computer. The portion of the device which contains the servomotors and drive mechanisms may be either: an integral part of the overall sighting device and/or its base or mounting bracket, such that the servomotor system remains a part of the sighting device and projectile launch system at all times during use; or contained in a separate enclosure that is only connected/attached to the sighting device during the adjustment or "sighting-in" procedure. FIG. 14 shows schematically one such computer-controlled sighting device, described below. ("Servomotor" includes servomotors, stepper motors, small motors, step motors, hybrid servomotors and stepping servomotors.)

In another embodiment, after receiving signals indicative of bullet impact location from light panel 14, the system computer 20 transmits adjustment signals to an appropriately designed gun control system to aim the gun.

In one embodiment the audio system includes the speaker 52, computer interface cable 47, user headset 59, headset cable 58, and a sound card (not shown) in the computer 20 to provide appropriate output signals to the audio devices. The computer used in systems according to this invention may use any type of computer-accessible storage media, e.g. magnetic or optical, including laser optical devices, laser disk, CD-ROM, digital audio/video disk, digital audio/video tape, magnetic disk or magnetic tape. Computer software used in systems according to this invention take X-Y coordinate input signals from the light panel (e.g. panel 14) and calculate and display location of bullet impact. Actual bullet velocity is calculated from known travel time between two light panels and distance of panel spacing (e.g. between the panels 14 and 16).

Due to the precision of the light panels, a bullet passing along a path identical to that of a previous bullet is sensed by the light panels and its position is accurately noted and stored.

Figure 3:
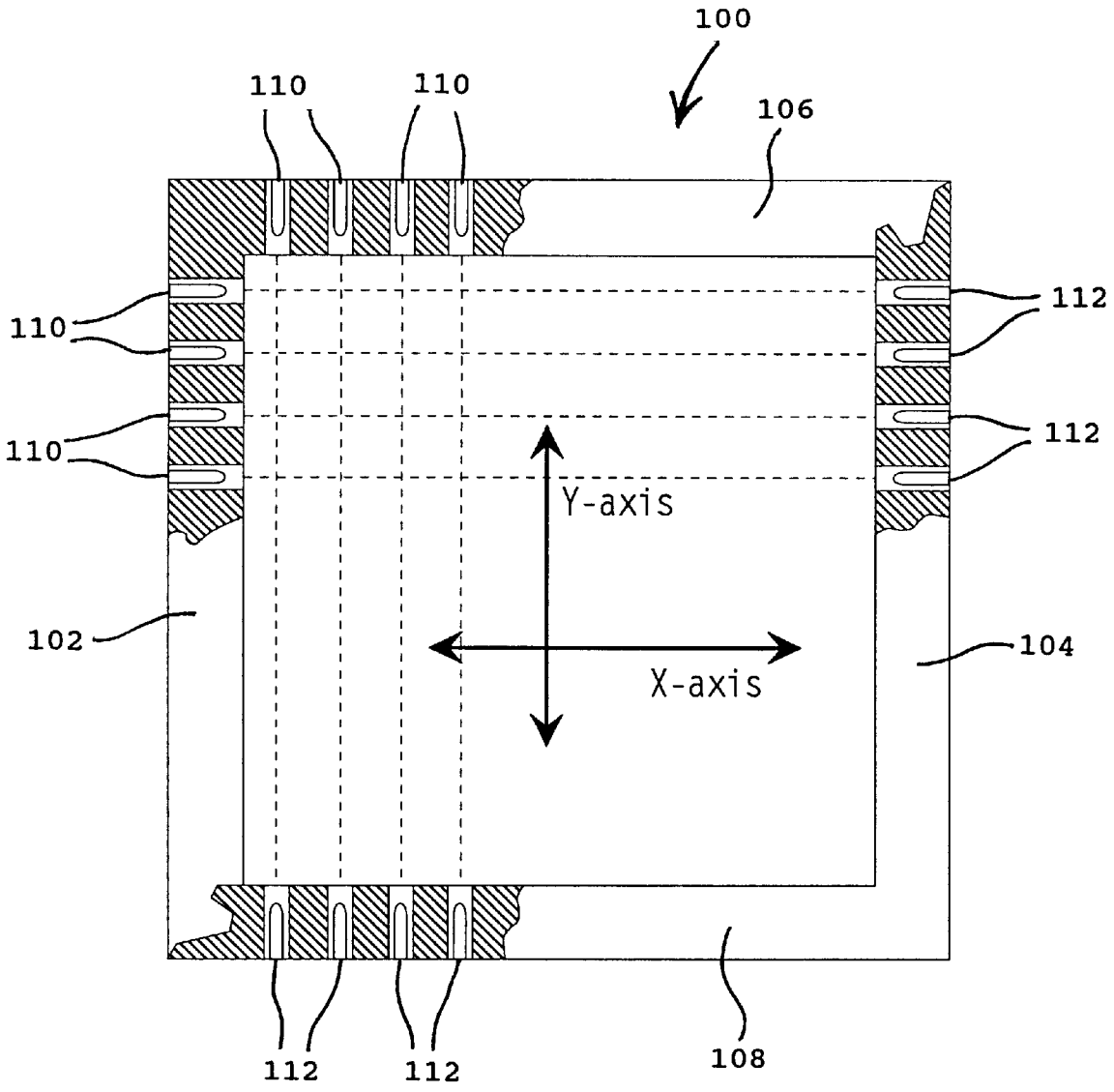
FIG. 3 is a front view of a light panel according to the present invention, partially cut-away.

FIG. 3 illustrates a light panel 100 according to the present invention (e.g. panel 14) which has vertical sides 102 and 104 and horizontal sides 106 and 108. A plurality of light emitters (four shown in cutaway on each side) 110 are mounted in the vertical side 102 and the horizontal side 106; and a plurality of light detectors 112 are mounted in the vertical side 104 and the horizontal side 108. Preferably emitters and detectors extend along the length of each respective side. (A "light panel" in any embodiment herein may be a matrix light panel, an X-Y coordinate light panel, an impact coordinate light panel, or a light panel utilizing emitters which emit fan-shaped light beams, e.g. in a plane.)

Figure 4:
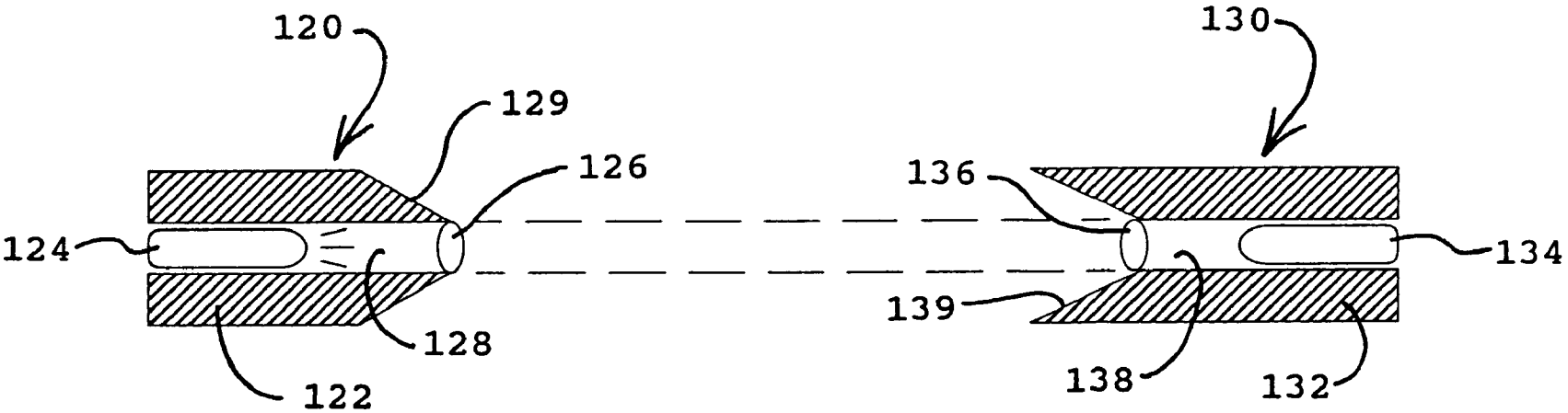
FIGS. 4 and 5 show, in cross-section, emitter-detector pairs useful with the panels of FIG. 3 or 6.

FIG. 4 illustrates an emitter mount 120 according to the present invention with a body 122; a channel therethrough 128; a light emitter 124; a focusing lens 126 mounted in the channel 128; and a convex surface 129 at one end of the body 122. FIG. 4 also illustrates a detector mount 130 according to the present invention with a body 132; a channel 138 therethrough; a focusing lens 136; a light detector 134 mounted in the channel 138; and a concave surface 139 at one end of the body 132.

Figure 5:
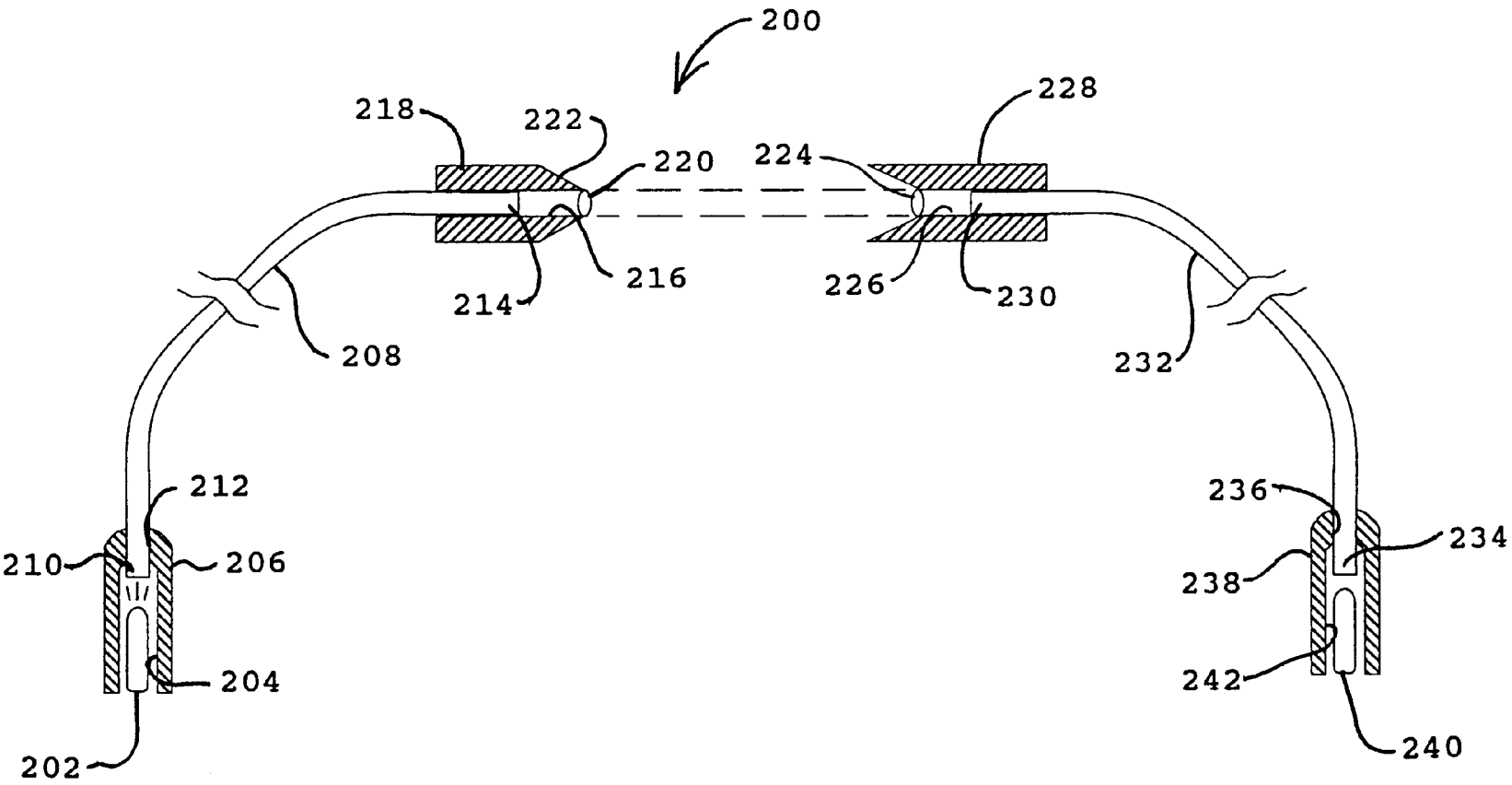

FIG. 5 illustrates an alternative emitter-detector system 200 according to the present invention. A light emitter 202 is disposed in a channel 204 of a body 206. A fiber optic 208 has one end 210 which passes through a hole 212 in the body 206 and another end 214 disposed in a channel 216 in a body 218. A focusing lens 220 is disposed in an end 222 of the channel 216. Light from the emitter 202 passes down the fiber optic 208, to and through the lens 220 and thence across to a focusing lens 224.

The focusing lens 224 is disposed in a channel 226 of a body 228 in which is also mounted an end 230 of a fiber optic 232. An end 234 of the fiber optic 232 extends through a hole 236 of a body 238. A light detector 240 is mounted in a channel 242 of the body 238 so that light passing through the lens 224 passes through the fiber optic 232 to the light detector 240.

Figure 6:
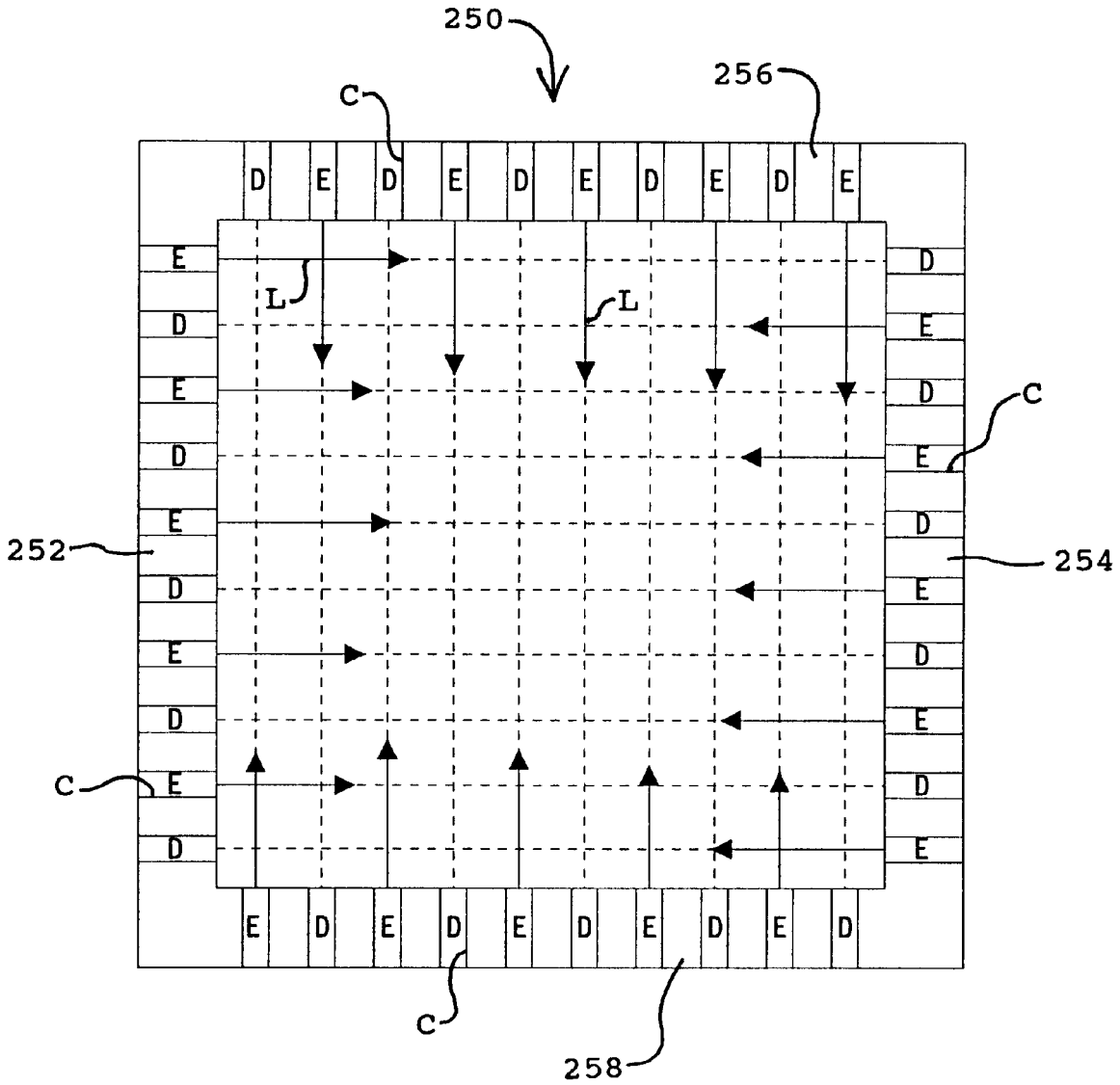
FIG. 6 is a front view of a light panel according to the present invention.
Figure 7:
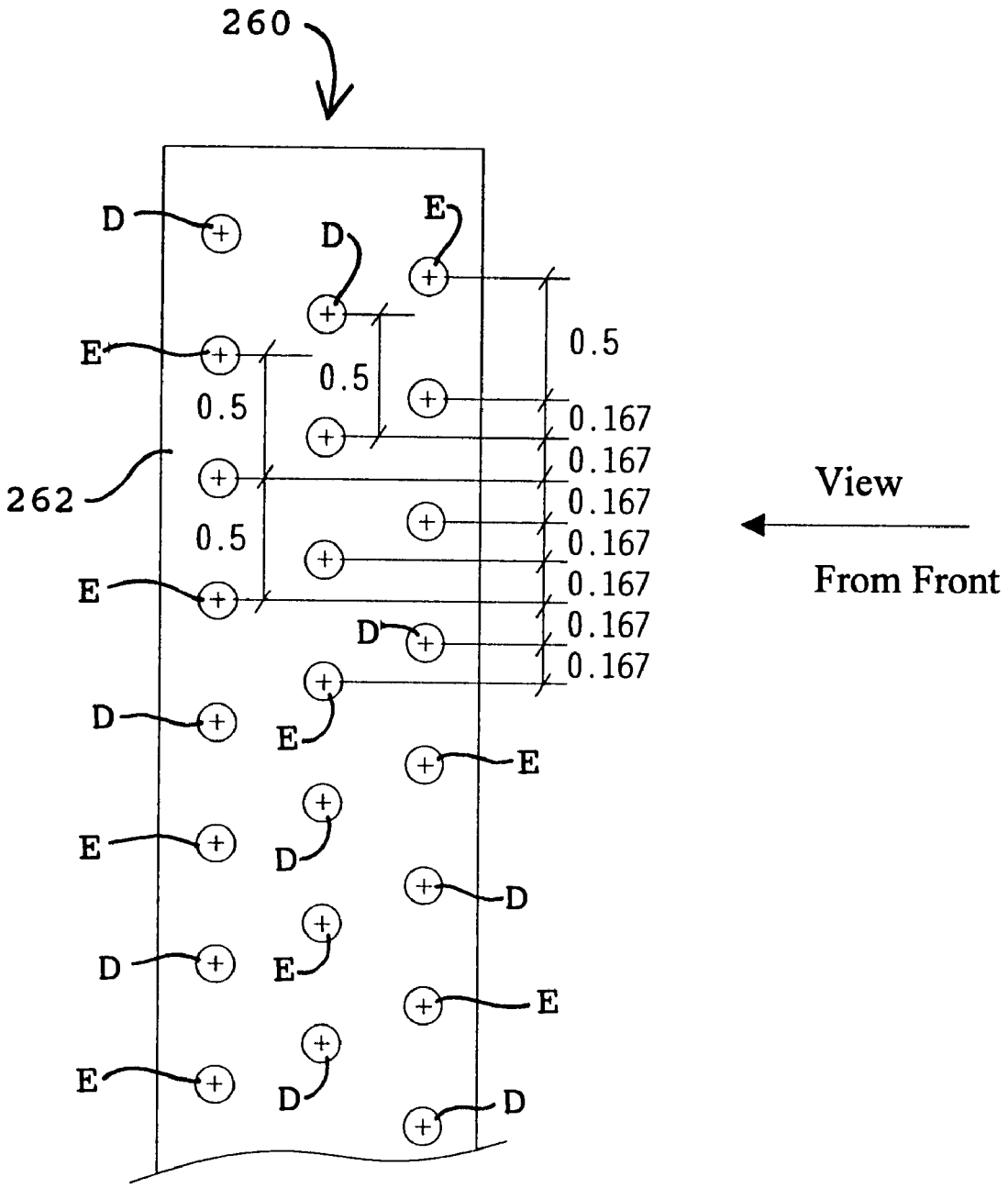
FIG. 7 is a side cross-sectional view of a side of a panel like that of FIG. 6.

FIG. 6 illustrates a light panel 250 (like the panel 14) according to the present invention which has vertical sides 252 and 254 interconnected by horizontal sides 256 and 258. Light emitters E and detectors D are alternately positioned in channels C in each side so that a light beam L from an emitter on one side strikes a corresponding detector on an opposing side. As shown in FIG. 7, in a light panel 260 according to the present invention which is similar to the panel 250, each panel side, e.g. as the one panel side 262 shown, may have a plurality of rows of emitters E and detectors D with opposing panel sides having corresponding rows of detectors and emitters. It is within this invention's scope for vertical columns of devices as shown in FIG. 7 to have emitters and detectors alternating from top to bottom. In one embodiment of a light panel according to this invention, all emitter-detector pairs are simultaneously energized. In certain embodiments, emitter-detector pairs are pulse modulated to minimize interference from ambient light or the light from adjacent emitter-detector pairs. In other embodiments, emitter-detector pairs are energized sequentially and/or in groups to create the continuous presence of planes of collimated light beams through which the projectile passes. Alternate emitter-detector positioning and spacing, the use of different frequency/wavelength and/or alternately polarized light for adjacent emitter-detector pairs, as well as the use of lenses (e.g. but not limited to polarizing lenses), assist in isolating one beam from another so that a detector senses only light from its associated emitter. Control/interface electronics (ambient light compensating circuits, automatic fault detection circuits, interrupted light beam detecting circuits, digital microprocessing circuits) are used to sense, calculate and transmit X-Y coordinate signals from a light panel's interrupted light beams to the system computer.

Figure 16:
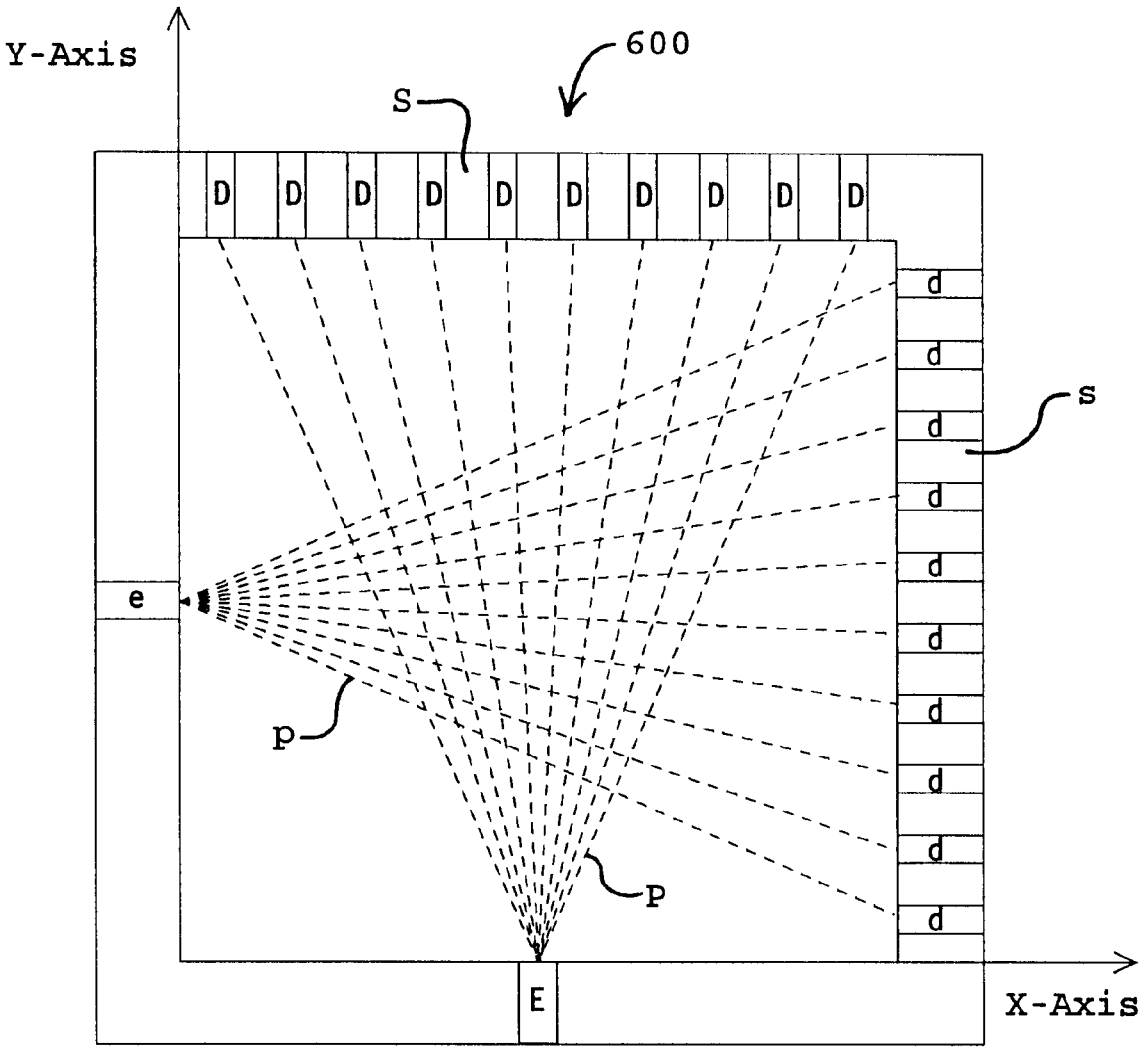
FIG. 16 is a front view of a light panel according to the present invention, partially cut away, with two light sources emitting fan-shaped planes of light.

Light panels according to the present invention (e.g., but not limited to, as shown in FIGS. 6 and 16) may have light emitter-detector pairs or beam systems located in a variety of ways, including: individual emitters and individual detectors both located on a light panel frame; individual emitters and individual detectors both located remote from the frame with fiber optic cable used to transmit the light signals to and from the precise rectangular (X-Y) or angular coordinate frame positions; individual emitters located on the frame with individual detectors located remotely with fiber optic cable; individual emitters located remotely with fiber optic cable and individual detectors located on the frame; large, common emitters serving several frame coordinate positions, located on the frame with individual detectors located on the frame; large, common emitters serving several frame coordinate positions, located on the frame, with individual detectors located remotely with fiber optic cable; large, common emitters serving several frame coordinate positions, located remote from the frame with fiber optic cable, with individual detectors located on the frame; large, common emitters serving several frame coordinate positions, located remote from the frame with fiber optic cable, with individual detectors located remotely with fiber optic cable. In certain embodiments, light panels according to the present invention use light sources and detectors which operate at any frequency/wavelength, including ultraviolet, visible, and infrared, with appropriately matched emitter-detector devices. "Emitters", "light emitters" and "light sources" used in light panels according to certain embodiments of the present invention include any device or apparatus capable of emitting or producing light (e.g., but not limited to, light emitting diodes, lasers), although they may not be equivalents of each other. "Detectors", "light detectors" and "light sensors" used in light panels according to certain embodiments of the present invention include any device or apparatus capable of detecting or sensing light (e.g., but not limited to, charge-coupled devices, photodiodes, phototransistors), although they may not be equivalents of each other. "Light" and "light beams" include all forms of continuous wave (CW), wavelength modulated (WM), amplitude modulated (AM), frequency modulated (FM), or pulse modulated ("pulsed") electromagnetic radiation including radio waves, microwaves, radar, infrared light, visible light, ultraviolet light, x-rays and gamma rays. In certain embodiments, light polarization techniques and light filters (e.g., but not limited to, bandpass filters) are used in light panel emitter-detector systems, including light filtering and/or polarizing fiber optic cable.

Figure 8:
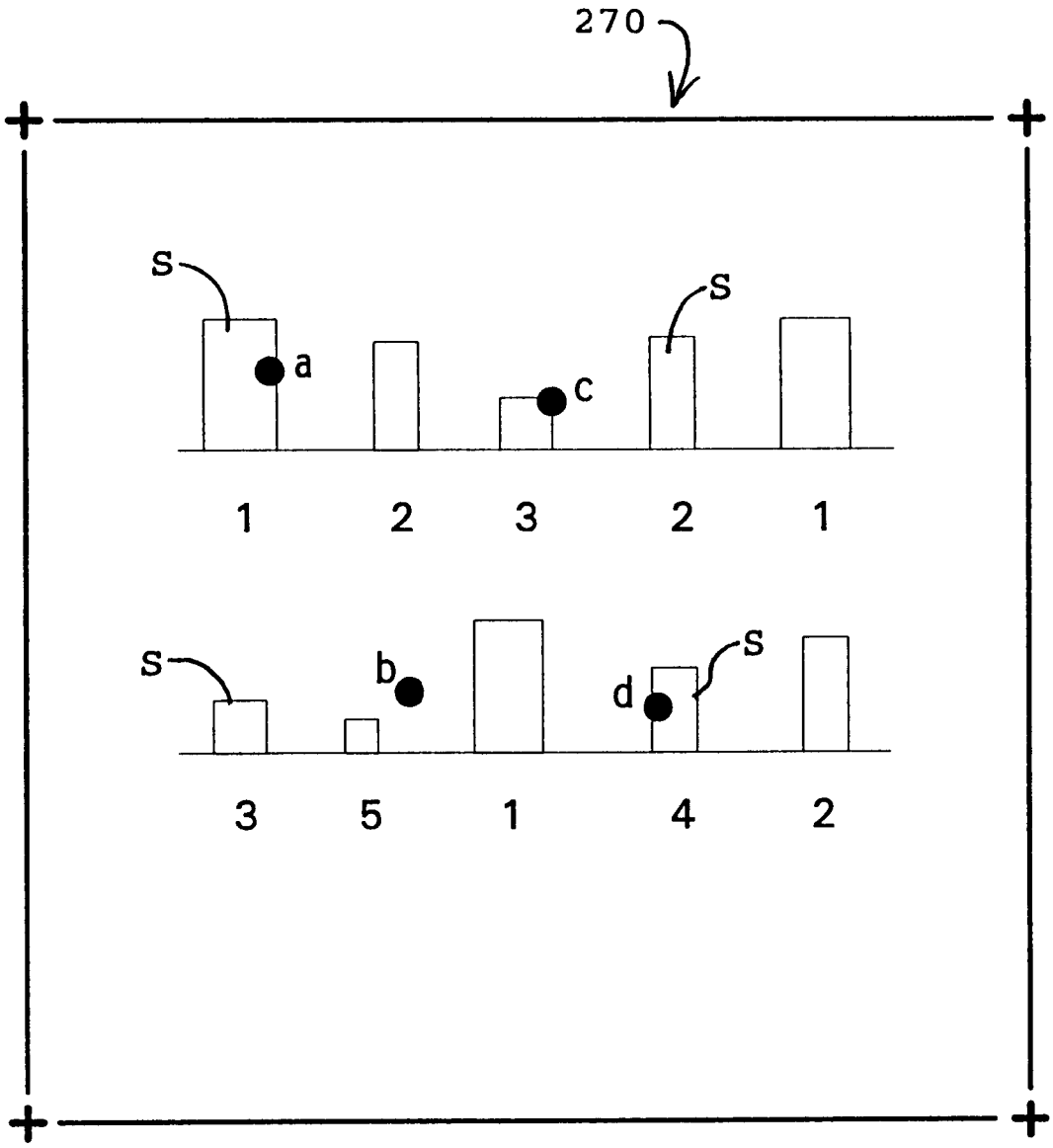
FIGS. 8 and 9 illustrate target images projected on a target screen, preprinted on target screen material, and/or displayed by a system monitor according to the present invention.
Figure 9:
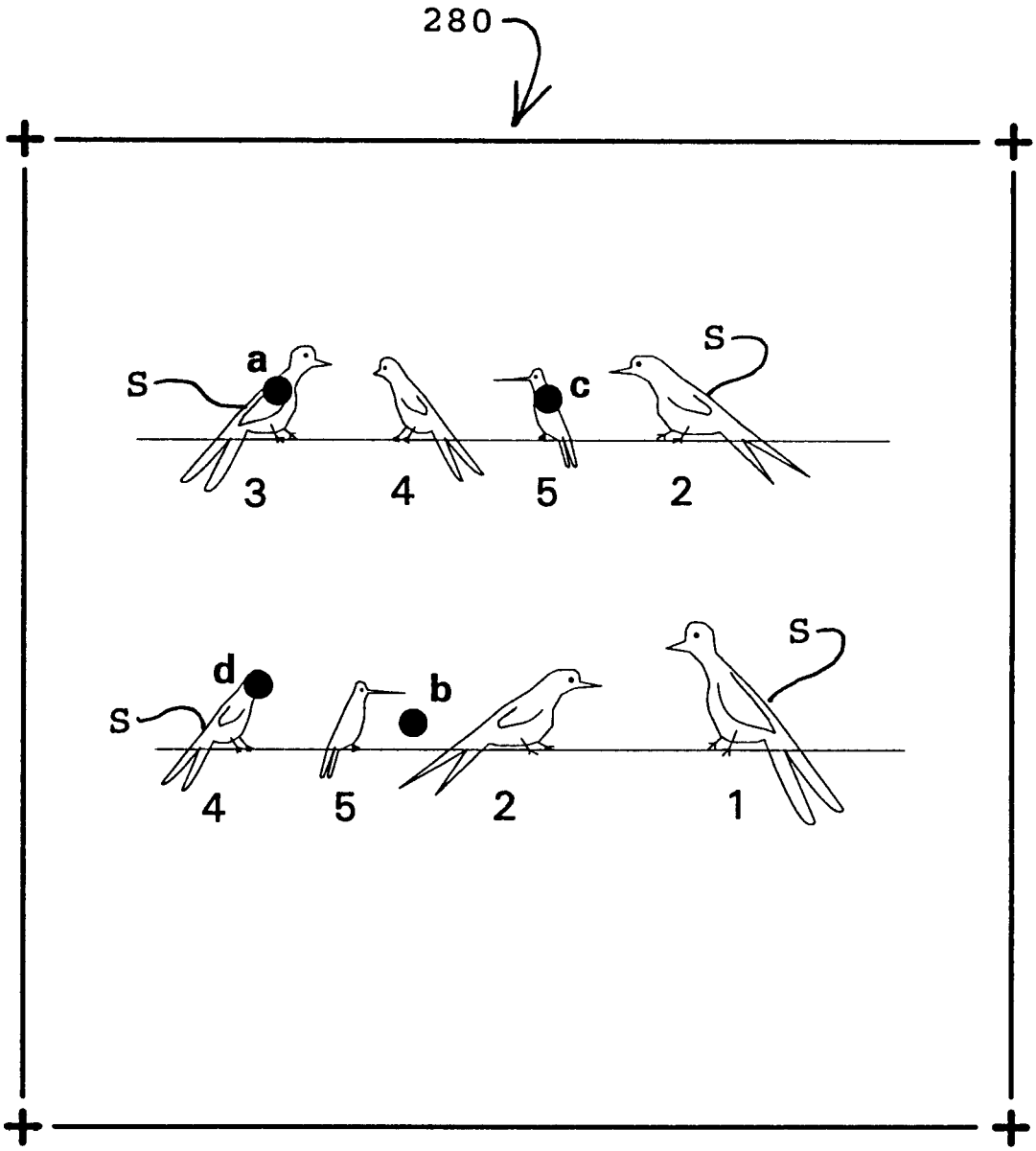
Figure 10:
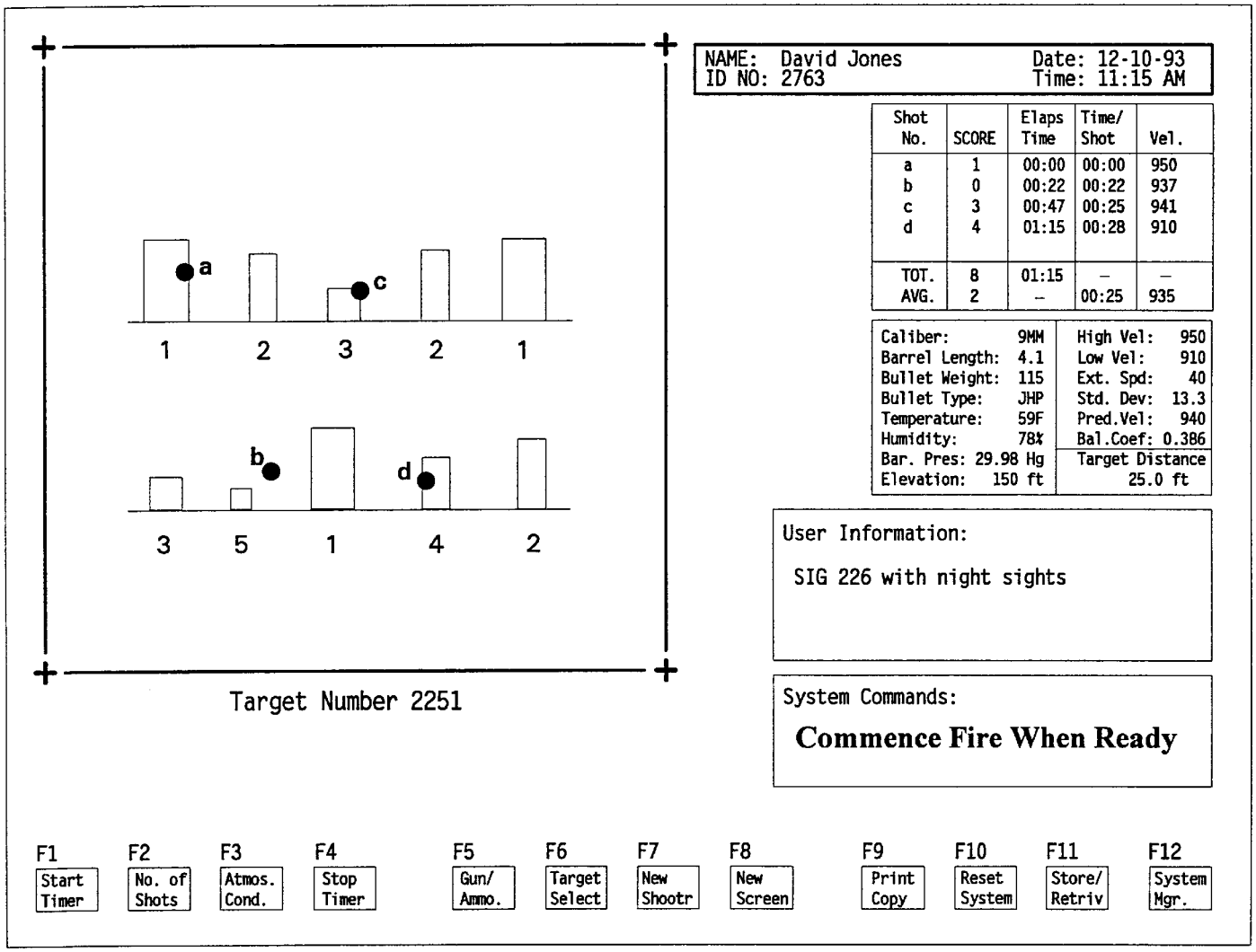
FIG. 10 illustrates both a monitor image and a printed copy of data for a shooter produced by a system according to the present invention.

FIGS. 8 and 9 illustrate video (or preprinted) target images 270 and 280 (which may also be printed out by the printer in a hard copy) respectively which show sub-images S of different size and of different shot point value (indicated by numerals 1, 2, 3, 4, 5), and multiple bullet impact points a, b, c, d. FIG. 10 illustrates both a monitor M image of the shooting comprising shots corresponding to bullet impact points a, b, c, and d as well as a paper print out of the same image. As shown, the computer notes each shot by designation a, b, c, d; each shot's point value; a total score; an average score; a time and date; a shooter by name—"David Jones"; a shooter number—"ID No. 2763"; a predicted bullet velocity; shot timing and time per shot; an actual velocity for each shot; average, high, low and extreme spread velocity; a velocity standard deviation; atmospheric conditions; gun/ammunition information; and distance to target. Pressing an indicated softkey on the computer keyboard initiates a stated function or initiates display of stated information on the monitor M.

Figure 11:
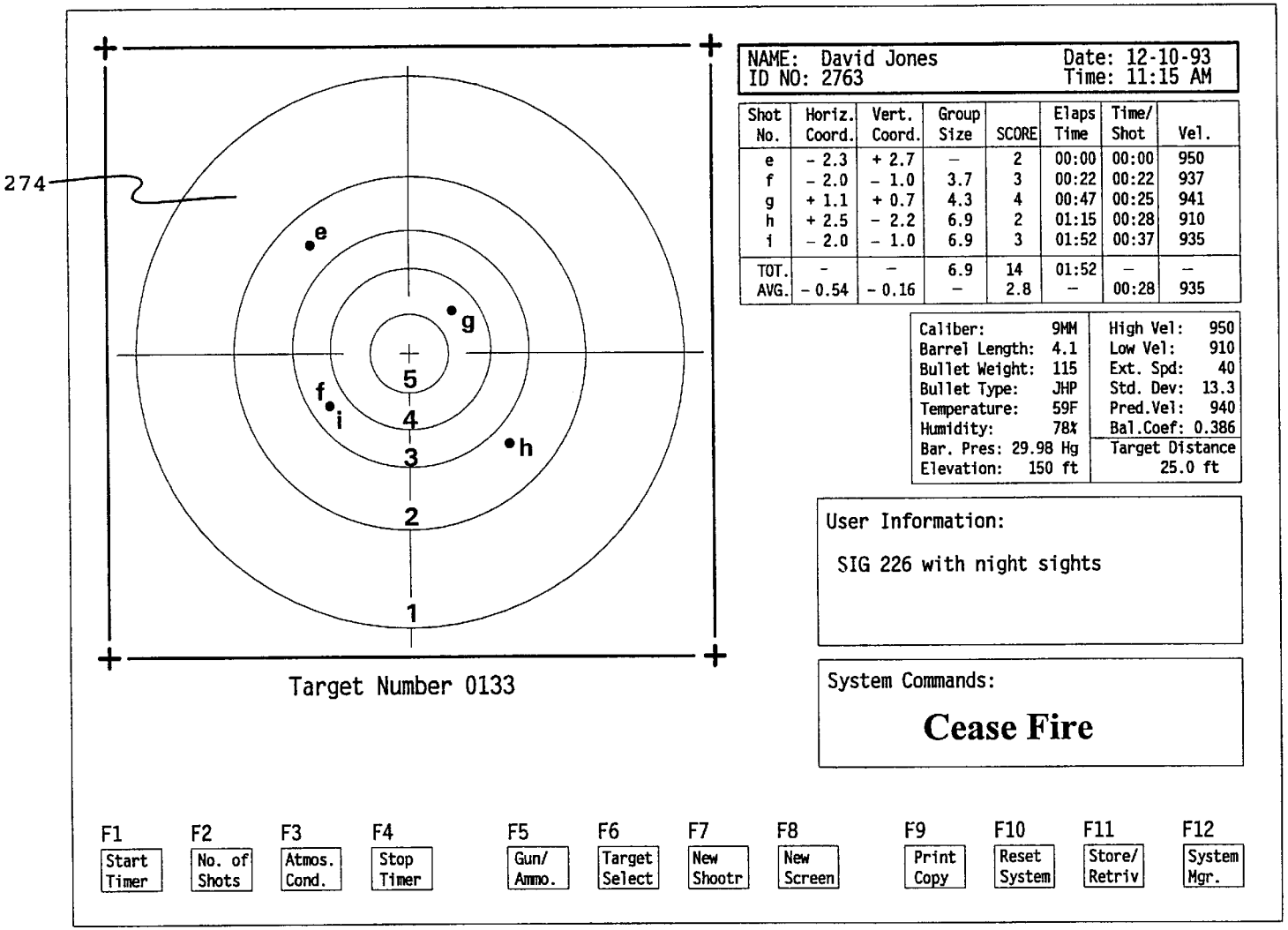
FIG. 11 illustrates both a monitor image and a printed copy of data for a shooter produced by a system according to the present invention.

Similarly, FIG. 11 illustrates a typical bullseye video image 274 projected on a monitor M, and/or printed on paper—with different point value areas 1, 2, 3, 4, 5 and with actual bullet impact points e, f, g, h, i. FIG. 11 illustrates a variety of data and information corresponding to the shots e, f, g, h, i, stored, presented, and/or calculated by the computer, including: shooter number and name; time and date of shooting; shot indicators e, f, g, h, i; vertical and horizontal coordinates of bullet impact points (note i and f are identical in location); group size; point score; predicted bullet velocity; actual bullet velocity; average location; total score; shot timing and time per shot; average score per shot; average, high, low, and extreme spread velocity; and velocity standard deviation. Also shown are atmospheric conditions, gun/ammunition information, and distance to target.

FIG. 13 illustrates a chronograph light panel 300 (like the panel 16) according to the present invention with panel sides 302, 304 interconnected by panel sides 306, 308. Each side pair has two light emitter 312-detector 314 pairs. Emitter beams 316 from each emitter 312 are sensed by a corresponding detector 314. Chronograph light panels according to the present invention which sense the passage of a projectile through the panel (and not the X-Y coordinates of the projectile) may have relatively few pairs of emitters and detectors with light beams that are spread out and not collimated. Dotted lines in FIG. 13 indicate emitted non-collimated light beams.

FIG. 14 illustrates schematically an integral type computer-controlled sight (scope) 410 with a control adjustment apparatus 400 according to the present invention. A sight (scope) 410 is mounted to a mounting bracket 402 (which is mounted on a gun, not shown). One servomotor 404 interconnected between the mounting bracket 402 and the sight 410, moves the sight under control of a computer 412, in the horizontal direction. Another servomotor 406, interconnected between the mounting bracket 402 and the sight 410, moves the sight in the vertical direction. An electronic controller and computer interface panel 416 is interconnected between the computer 412 and the servomotors. A power cord 408 is connected to a power supply 414 and supplies power to the interface panel 416. A cable 407 interconnects the computer 412 and the interface panel 416.

Figure 15:
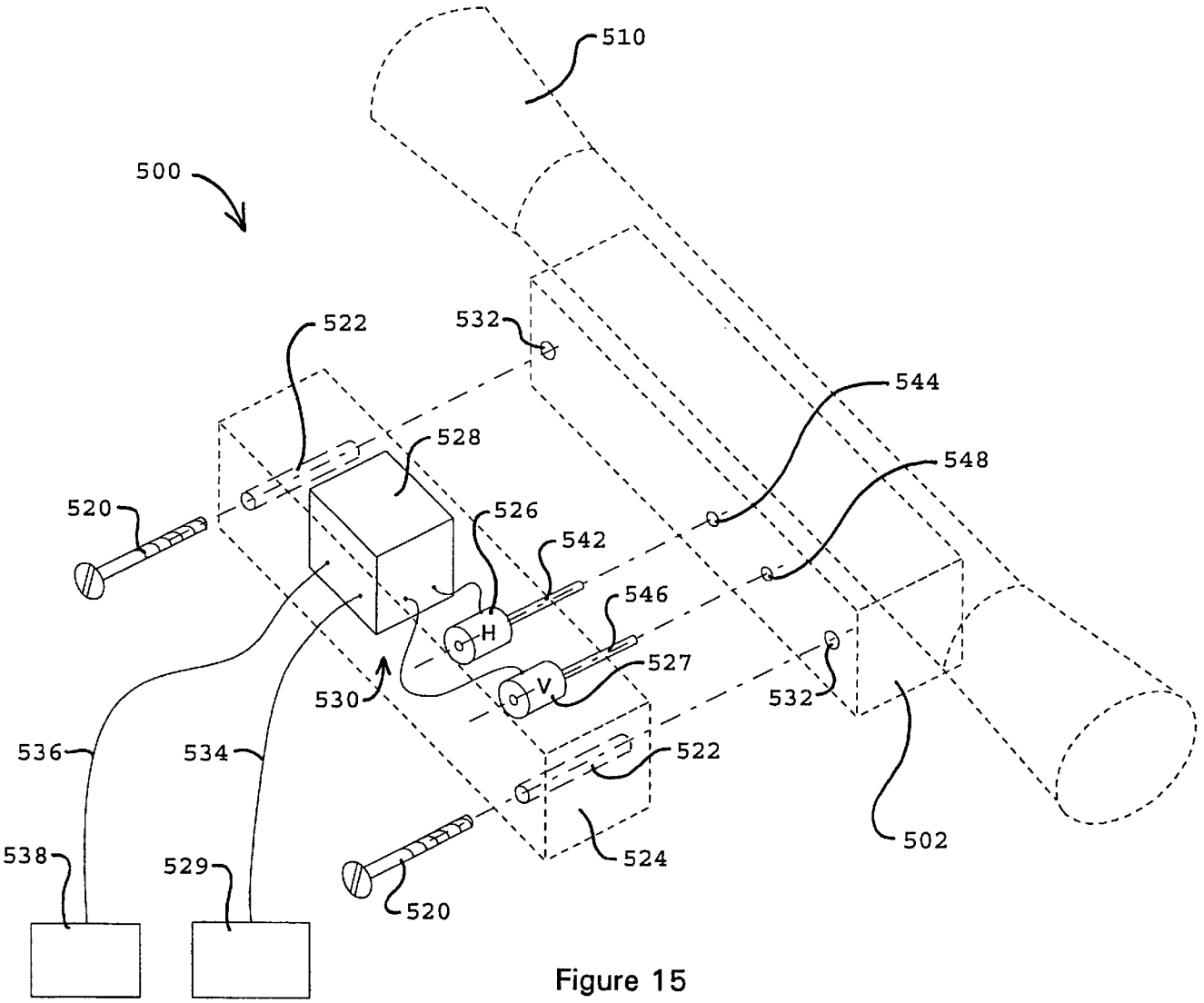
FIG. 15 is a perspective schematic view of a computer-controlled sight according to the present invention.

FIG. 15 illustrates schematically a detachable type computer-controlled sight adjustment apparatus 500 according to the present invention. A sight (scope) 510 is mounted to a mounting base 502. Using bolts 520 extending through holes 522 in a block 524 and through holes 532 in the mounting base 502, the sight adjustment device 530 is attached during the adjustment or sighting-in procedure. The base 502 is mounted to a gun (not shown) so that it is permitted some degree of motion in response to sight adjustment device 530 according to the present invention. The device 530 has an electronic controller and computer interface panel 528 within the block 524 which is interconnected between two servomotors 526 and 527 and a control computer 529. A computer interface cable 534 interconnects a computer 529 and the interface panel. A power cord 536 supplies power to the interface panel 528 from a power supply 538. The servomotor 526 has a shaft 542 which co-acts with a female coupling 544 in the base 502 (e.g. with a splined, threaded, or allen-wrench-type interconnection) to move the base 502 in the horizontal direction. The servomotor 527 has a shaft 546 which co-acts with a female coupling 548 in the base 502 to move the base 502 in a vertical direction.

FIG. 16 illustrates a light panel 600 according to the present invention which has two light sources (e and E) that emit fan-shaped planes p and P respectively of light beams towards opposite panel sides s and S respectively. A plurality of detectors (d and D) are located on the panel sides s and S opposite the emitters e and E, respectively. Radial light beam paths between emitters and detectors are indicated by dotted lines. Such a light panel is useful to detect and register the location of any object or objects (including but not limited to a bullet, arrow, ball, etc.) which is positioned within or passes through the panel's beams. Such a panel also is useful to detect the size, shape, orientation, velocity and/or image of the object(s).

Figures 17A, 17B:
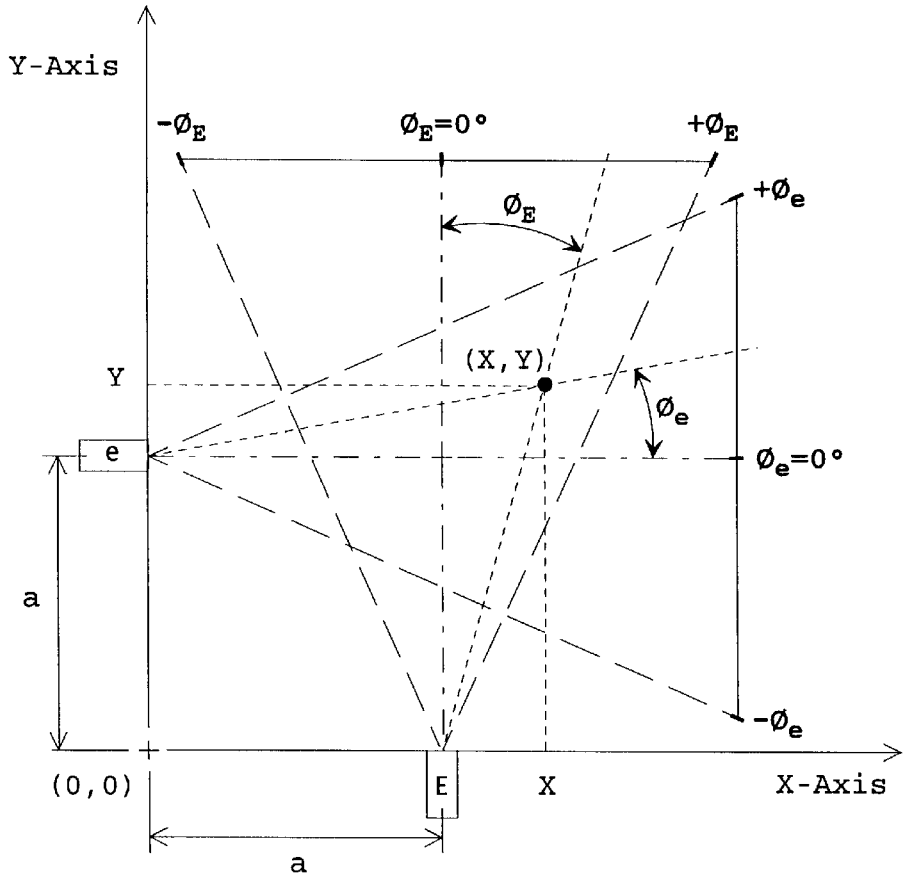
FIG. 17*a* illustrates the geometric layout of the light panel of FIG. 16 and the mathematical equations in FIG. 17*b* are used to calculate an X-Y coordinate of a bullet's path.

FIG. 17*a* illustrates the geometric configuration of the light beam paths that results from the emitter-detector arrangement of the panel of FIG. 16. $Ø_e$ and $Ø_E$ represent values for the angular (polar) coordinates of the radial light beam paths interrupted by a bullet passing through the panel frame. The mathematical equations of FIG. 17*b* illustrate a method of converting the angular (polar) coordinates of the interrupted beam paths to rectangular X-Y coordinates for an object or a bullet passing through the point (X, Y).

Figure 18:
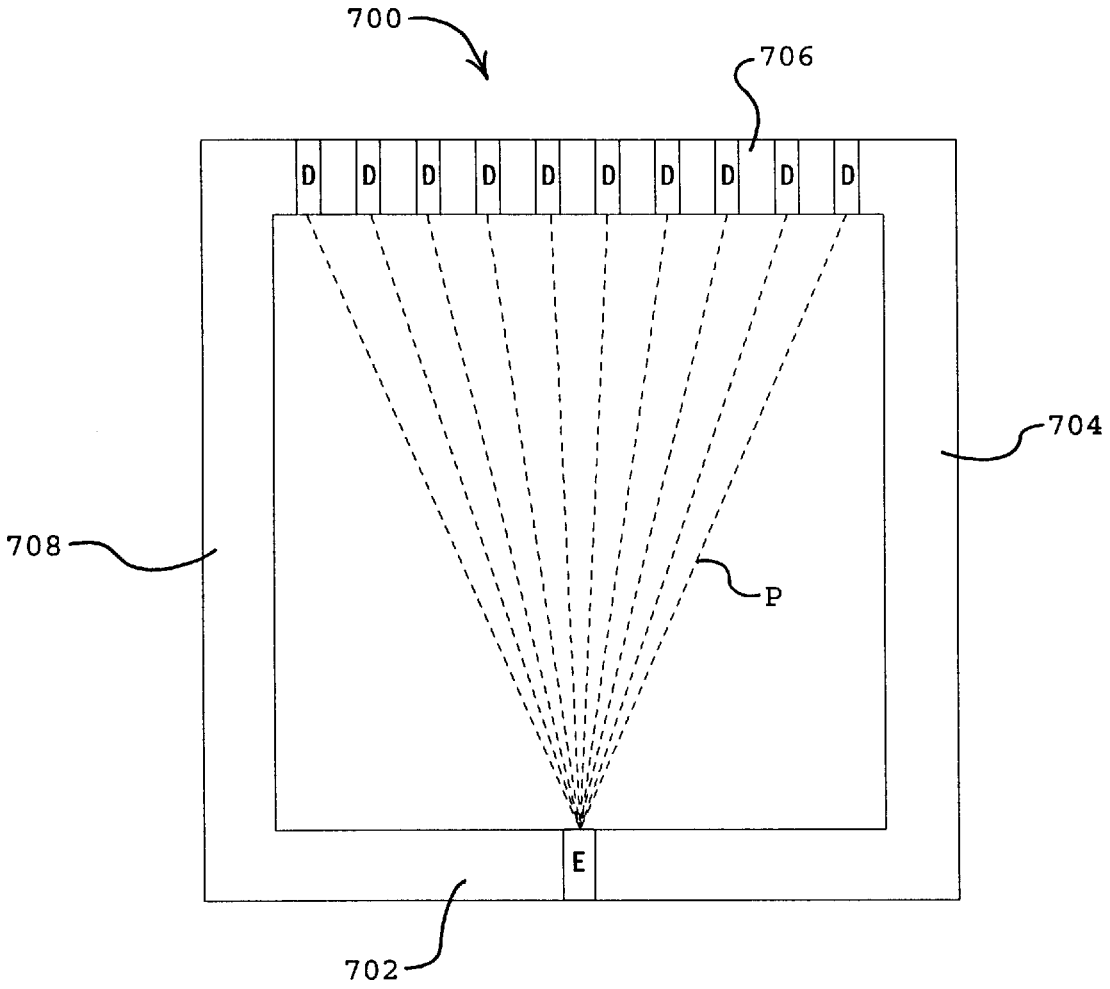
FIG. 18 is a front view of a light panel according to the present invention which uses a single light source emitting a fan-shaped plane of light.

FIG. 18 illustrates a light panel 700 according to the present invention with sides 702, 704, 706, 708 and has a single light source E in side 702 which emits a fan-shaped plane of light beams P towards a plurality of light detectors D located on an opposite side 706 of the panel frame. Radial light beam paths between the emitter and the detectors are indicated by dotted lines.

Figure 19:
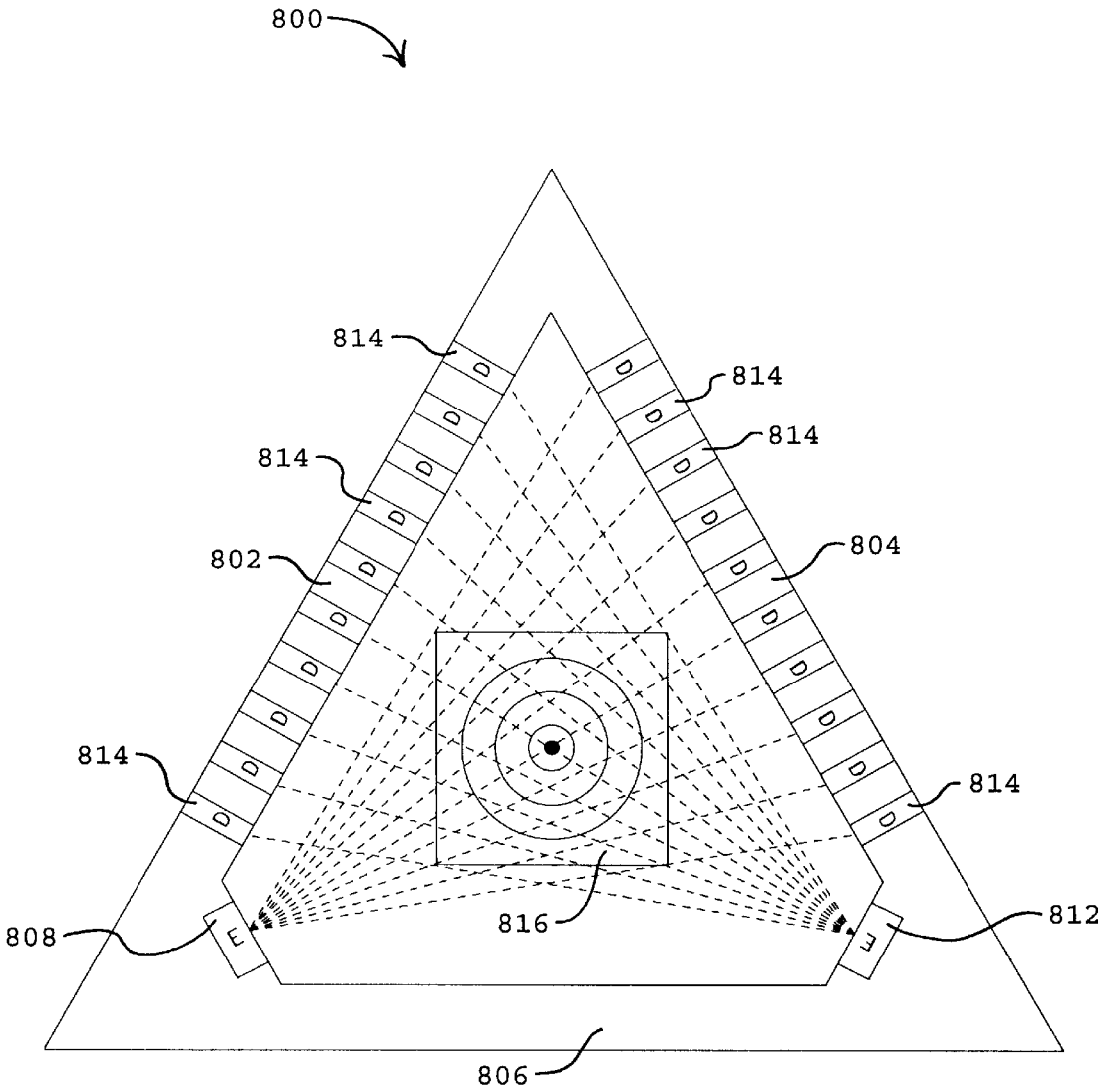
FIG. 19 is a front view of a light panel according to the present invention.

FIG. 19 shows a light panel 800 according to the present invention with three interconnected sides 802, 804 and 806. A first light emitter 808 is secured to or in the side 802 (and/or to the side 806) and a second emitter 812 is secured to or in the side 804 (and/or to the side 806). Each side 802, 804 has a plurality of light detectors 814 thereon or therein for sensing light from their corresponding emitter. The side 806 may be omitted. The light panel 800 is shown superimposed over a target 816 positioned behind and spaced apart from the light panel.

Figure 20:
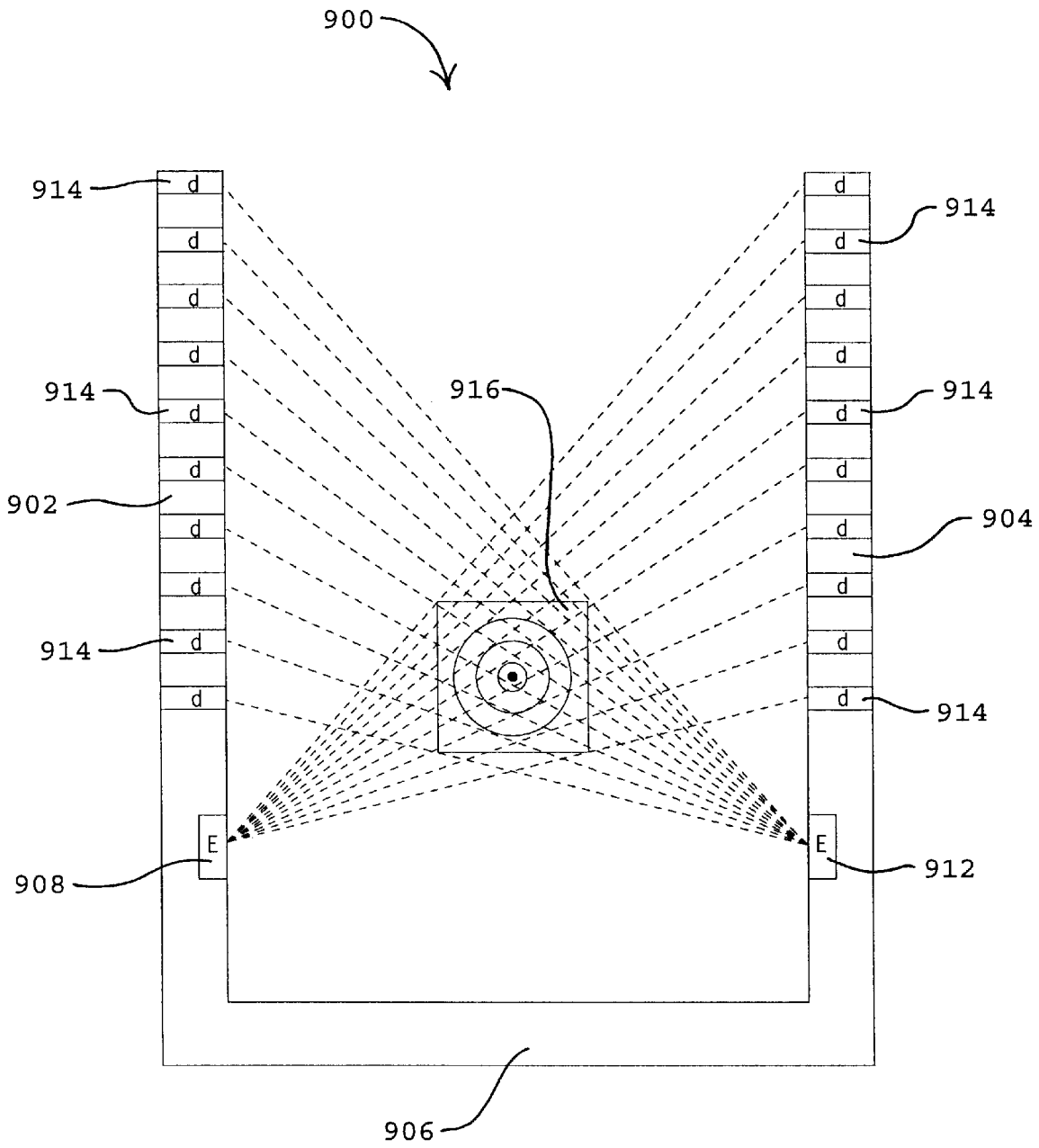
FIG. 20 is a front view of a light panel according to the present invention.

FIG. 20 shows a light panel 900 according to the present invention with three interconnected sides 902, 904 and 906. A first light emitter 908 is secured to or in the side 902 (and/or to the side 906) and a second emitter 912 is secured to or in the side 904 (and/or to the side 906). Each side 902, 904 has a plurality of light detectors 914 thereon or therein for sensing light from their corresponding emitter. The side 906 may be omitted. The light panel 900 is shown superimposed over a target 916 positioned behind and spaced apart from the light panel.

Figure 21:
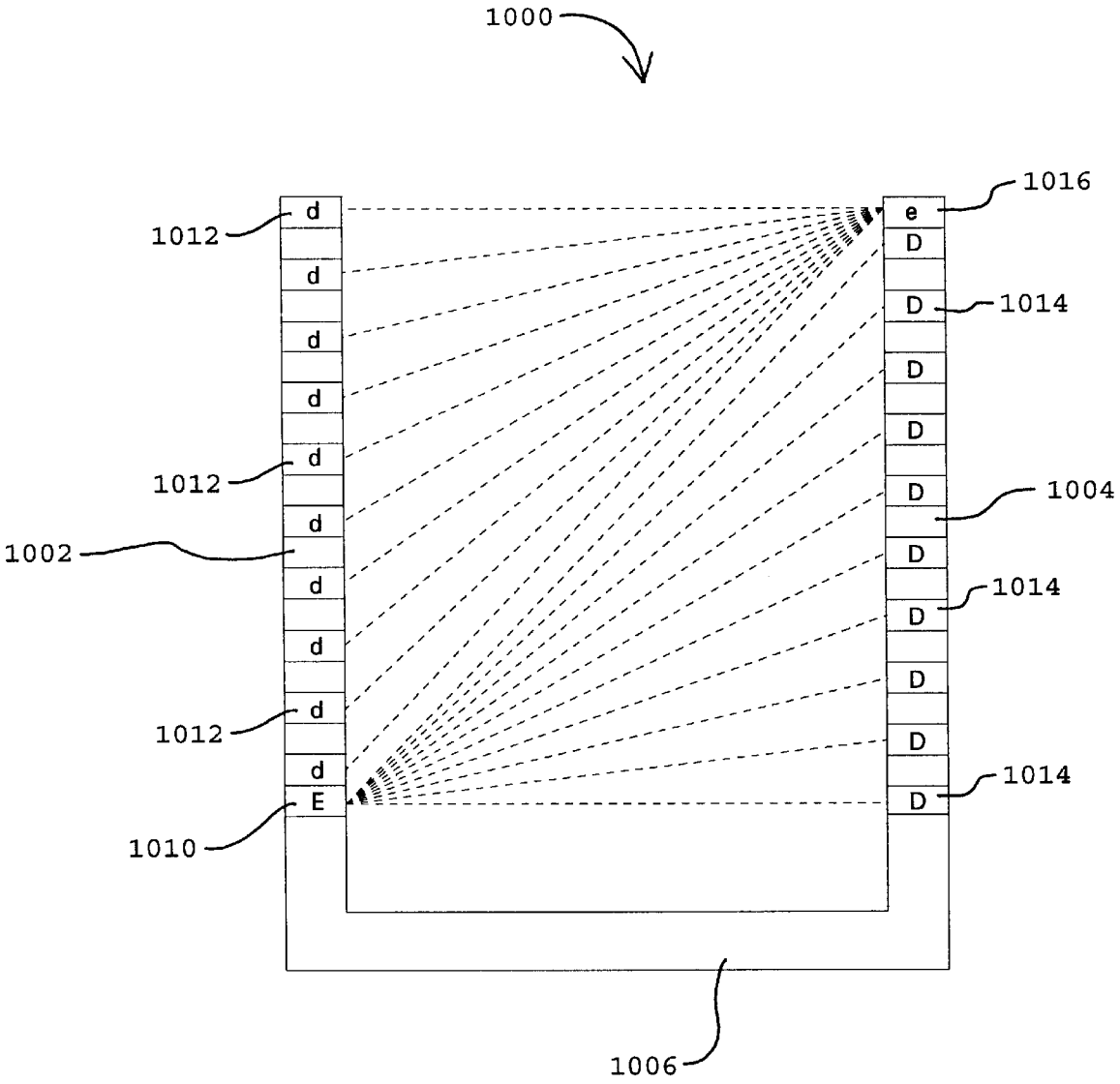
FIG. 21 is a front view of a light panel according to the present invention.

FIG. 21 illustrates a light panel 1000 according to the present invention with three interconnected sides 1002, 1004 and 1006. A first light emitter 1010 is secured to or in the side 1002 and a second light emitter 1016 is secured to or in the side 1004. Side 1002 has a plurality of light detectors 1012 thereon or therein for sensing light from second light emitter 1016. Side 1004 has a plurality of light detectors 1014 thereon or therein for sensing light from first light emitter 1010.

Figure 22:
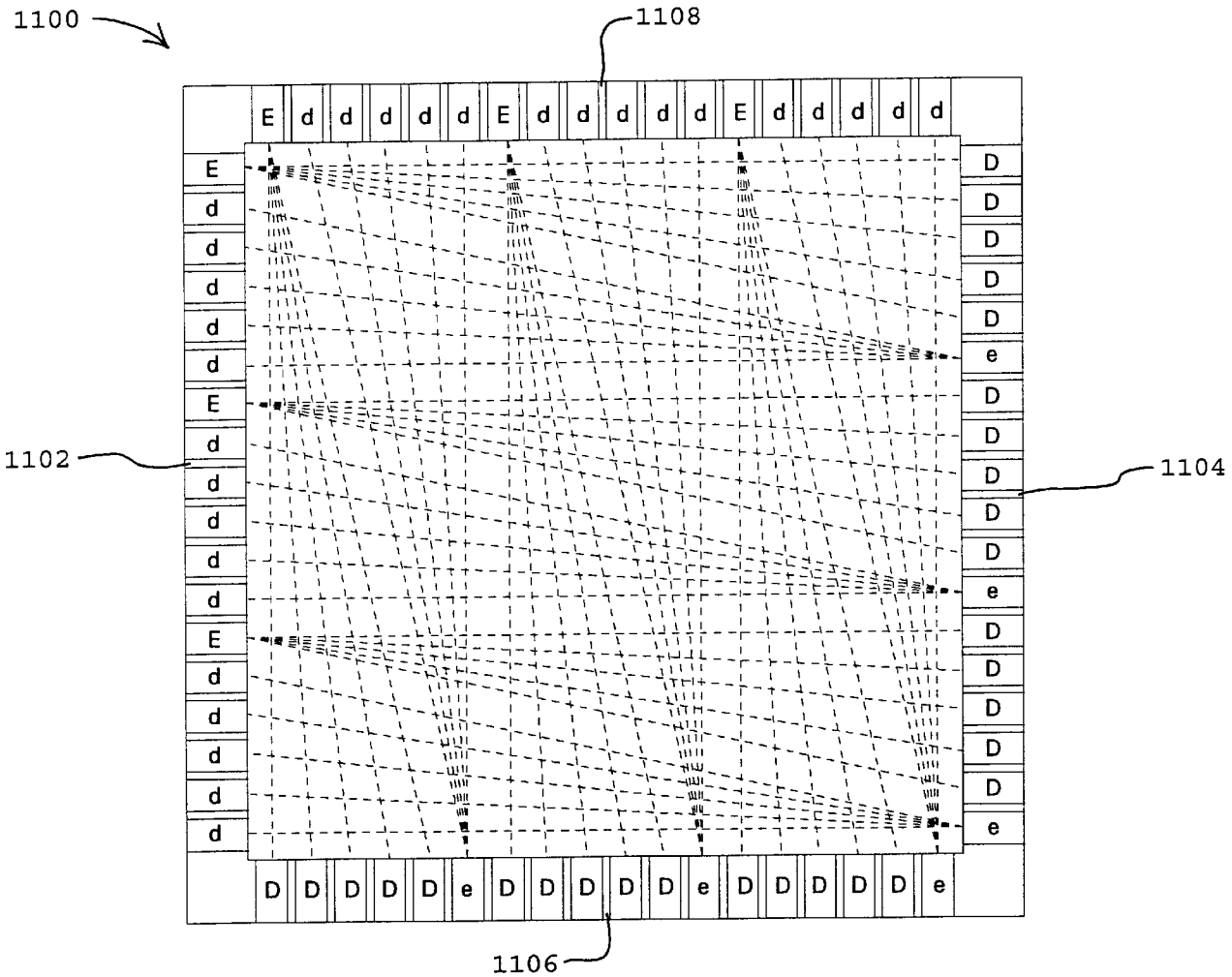
FIG. 22 is a front view of a light panel according to the present invention.

FIG. 22 illustrates a light panel 1100 according to the present invention with four interconnected sides 1102, 1104, 1106 and 1108. Multiple light emitters (e or E) that emit fan-shaped planes of light are secured to or in the panel sides. A plurality of detectors (d and D) are secured to or in the panel sides and opposite the emitters e and E, respectively. Multiple beam systems, each consisting of a single emitter (e or E) emitting a fan-shaped plane of light and a corresponding plurality of detectors (d or D, respectively), are part of a single light panel. Radial light beam paths between emitters and detectors are indicated by dotted lines.

Figure 23:
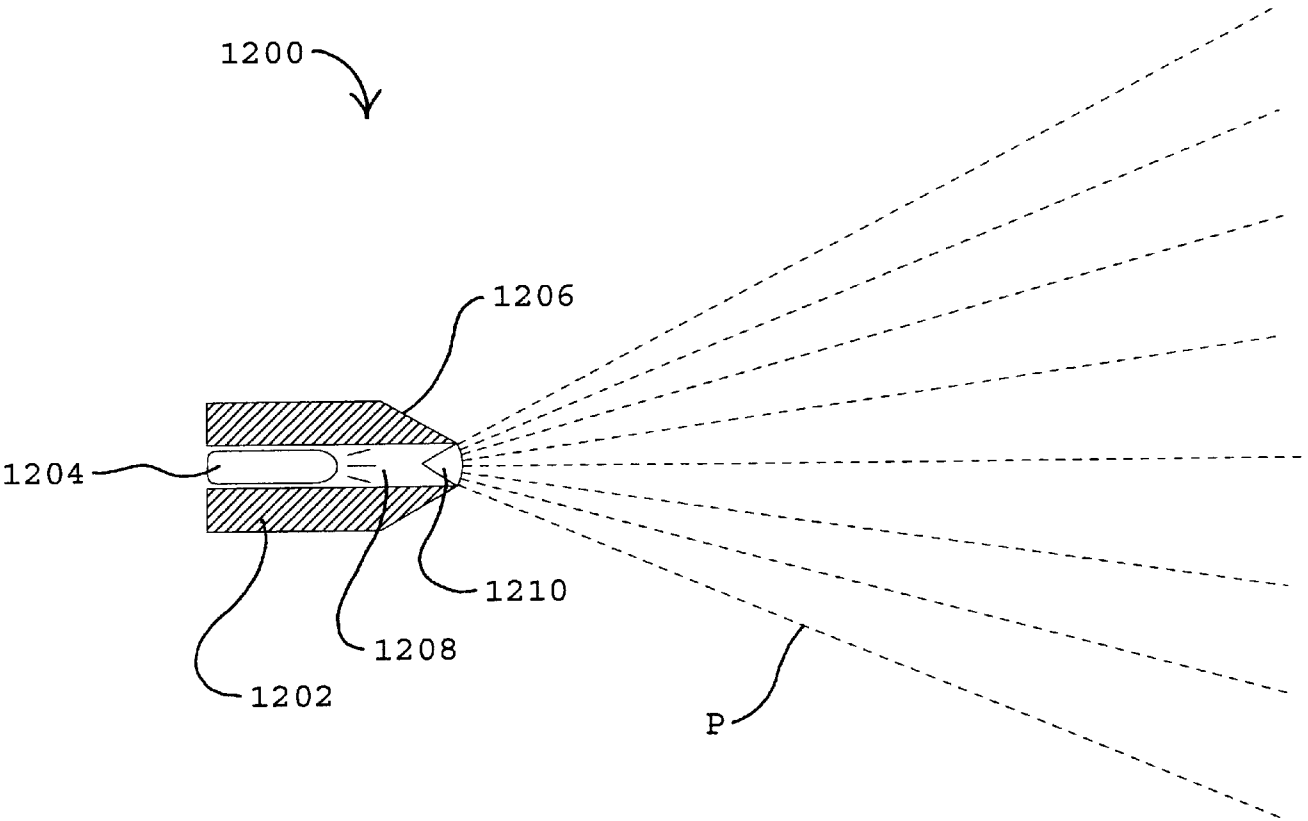
FIG. 23 shows, in cross-section, an emitter emitting a fan-shaped plane of light useful, e.g. with the panels of FIGS. 16, 18, 19, 20, 21, 22, 27 or 28.

FIG. 23 illustrates an emitter mount 1200 according to the present invention with a body 1202; a channel therethrough 1208; a light emitter 1204; a lens 1210 for emitting a fan-shaped plane of light P; and a convex surface 1206 at one end of the body 1202. Such an emitter mount is useful with light panels which utilize fan-shaped planes of light (e.g. like the panels 600, 700, 800, 900, 1000, 1100, 1500, or 1600).

Figure 24:
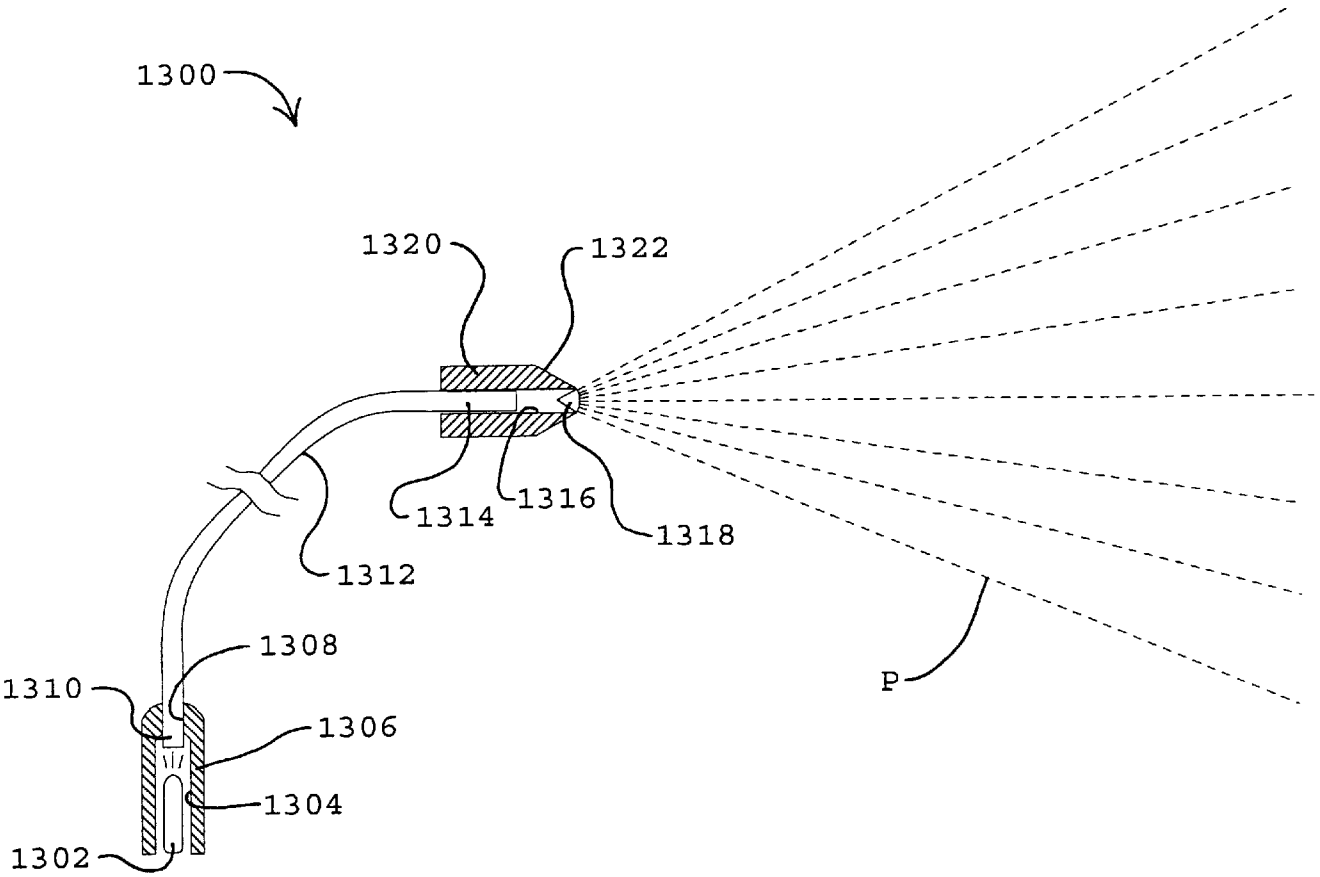
FIG. 24 shows, in cross-section, an emitter emitting a fan-shaped plane of light useful with the panels of FIGS. 16, 18, 19, 20, 21, 22, 27 or 28.

FIG. 24 illustrates an alternative emitter system 1300 according to the present invention. A light emitter 1302 is disposed in a channel 1304 of a body 1306. A fiber optic 1312 has one end 1310 which passes through a hole 1308 in the body 1306 and another end 1314 disposed in a channel 1316 in a body 1320. A lens 1318 for emitting a fan-shaped plane of light P is disposed in an end 1322 of the channel 1316. Light from the emitter 1302 passes down the fiber optic 1312, to and through the lens 1318, to create the fan-shaped plane of light P. Such an emitter system is useful with light panels which utilize fan-shaped planes of light (e.g. like the panels 600, 700, 800, 900, 1000, 1100, 1500, or 1600).

Figure 25:
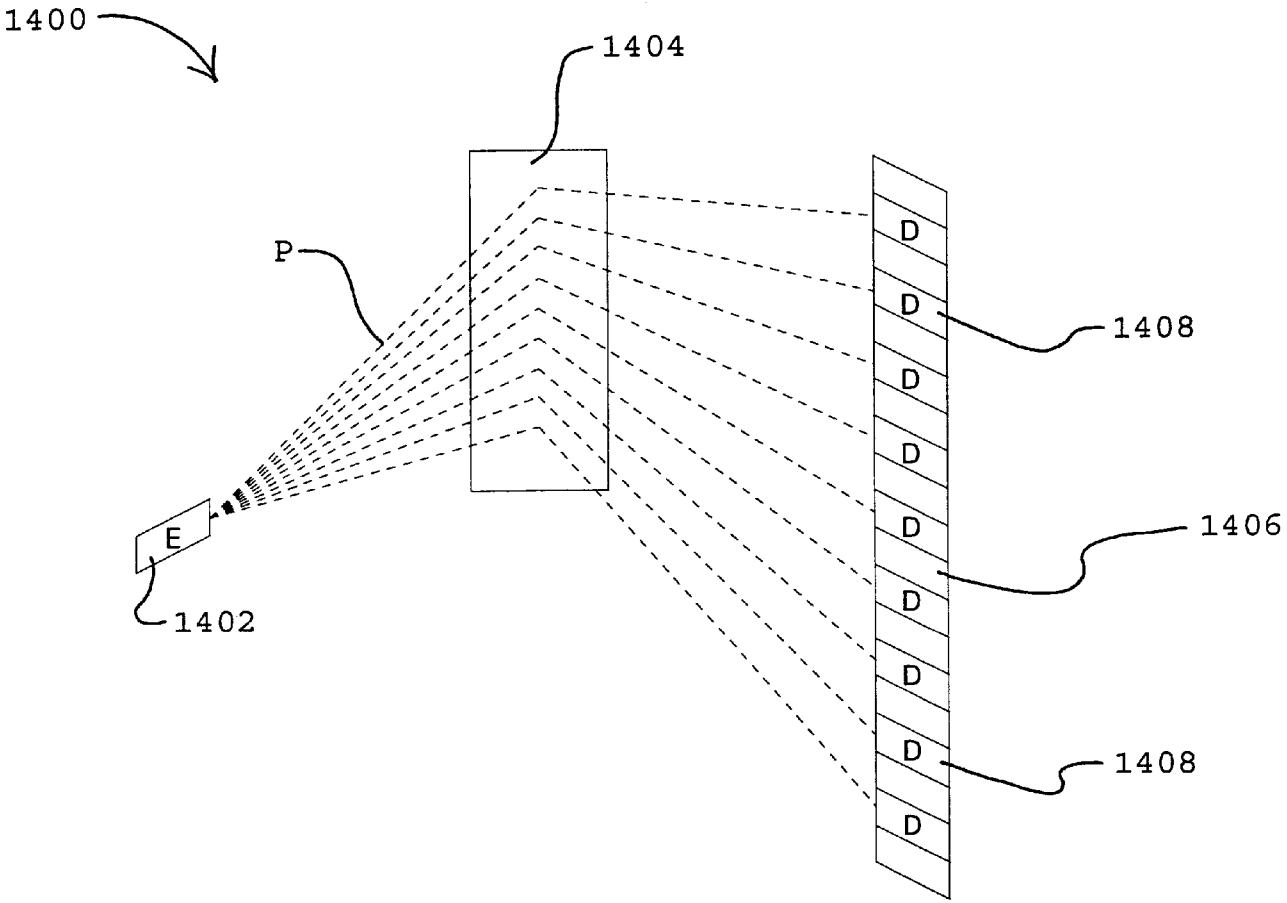
FIG. 25 is a perspective view of one emitter/detector system (beam system) using a mirror/reflector to reflect/redirect the fan-shaped plane of light.
Figure 26B:
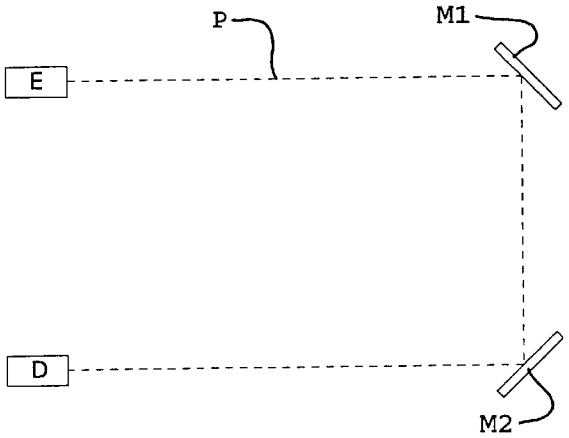
FIGS. 26*a*, 26*b*, 26*c*, and 26*d* are schematic views of emitter/detector systems using mirrors/reflectors to reflect/redirect the fan-shaped plane of light.
Figure 26D:
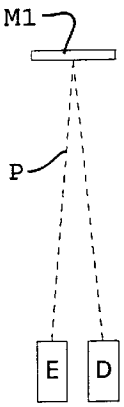
Figure 26A:
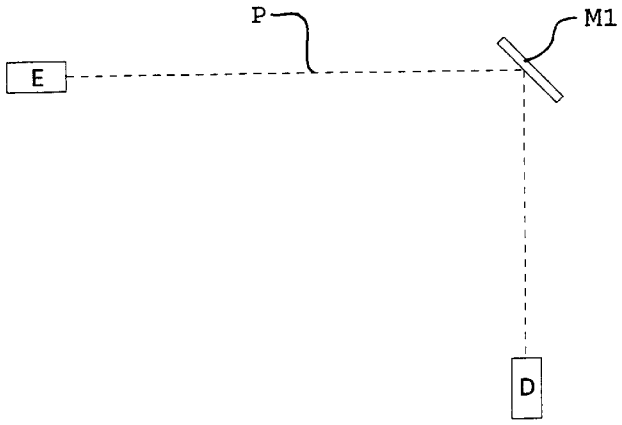
Figure 26C:
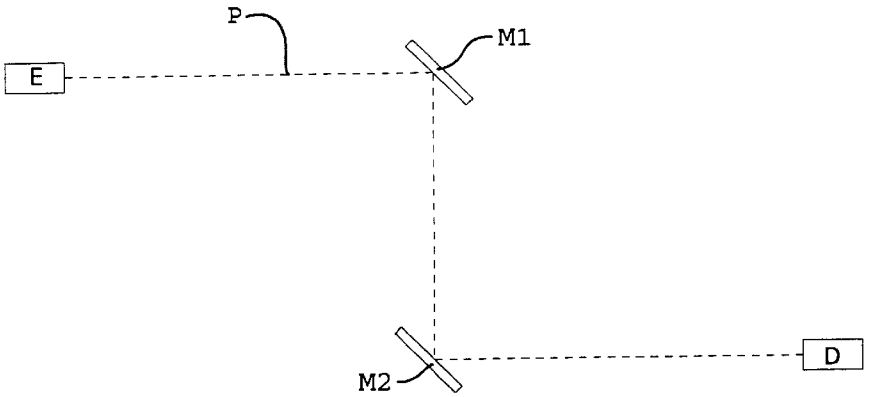

FIG. 25 illustrates an alternative emitter/detector system 1400 according to the present invention. A light emitter 1402 is positioned spaced apart from a light panel side 1406. A plurality of light detectors 1408 are secured to or in panel side 1406. A mirror/reflector 1404 is positioned between emitter 1402 and panel side 1406 such that the fan-shaped light beam P from emitter 1402 is reflected from mirror/reflector 1404 and directed towards the plurality of detectors 1408 secured to or in panel side 1406.

FIGS. 26*a*, 26*b*, 26*c* and 26*d* illustrate alternative emitter/detector systems according to the present invention. A fan-shaped plane of light P is emitted from emitter E and is reflected/redirected by mirror(s)/reflector(s) M1 and M2 towards detector(s) D spaced apart from the emitter.

Figure 27:
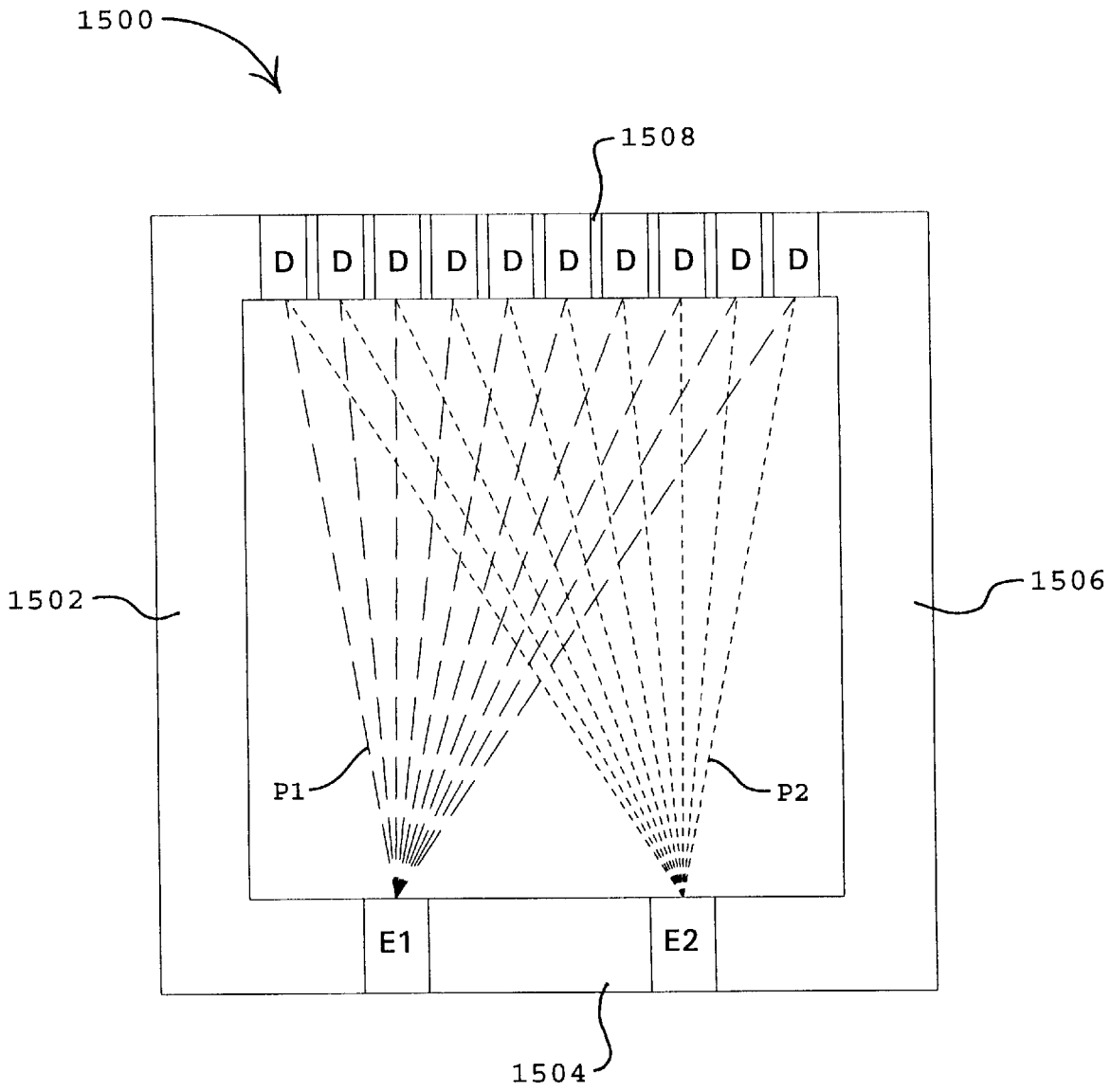
FIG. 27 is a front view of a light panel according to the present invention with two light sources emitting fan-shaped planes of light at different pulse modulation frequencies.

FIG. 27 illustrates a light panel 1500 according to the present invention with four interconnected sides 1502, 1504, 1506 and 1508. Two light sources E1 and E2 are secured to or in panel side 1504. The two emitters E1 and E2 emit pulse modulated fan-shaped planes of light beams (P1 and P2, respectively) toward a common plurality of detectors D located on or in opposite panel side 1508. Emitter E1 emits pulse modulated light at a first pulse modulation frequency and emitter E2 emits pulse modulated light at a second pulse modulation frequency; both emitters directing their fan-shaped beams toward plurality of detectors D; electronics (e.g. but not limited to light signal amplification circuitry or light signal demodulation circuitry) associated with detectors D for responding to, and sensing the interruption of, pulse modulated light signals from the two light sources E1 and E2 simultaneously and independently. Such a light panel is useful to detect the location, size, shape, orientation, velocity and/or image of any object or objects positioned within or passing through the panel's light beams.

Figure 28:
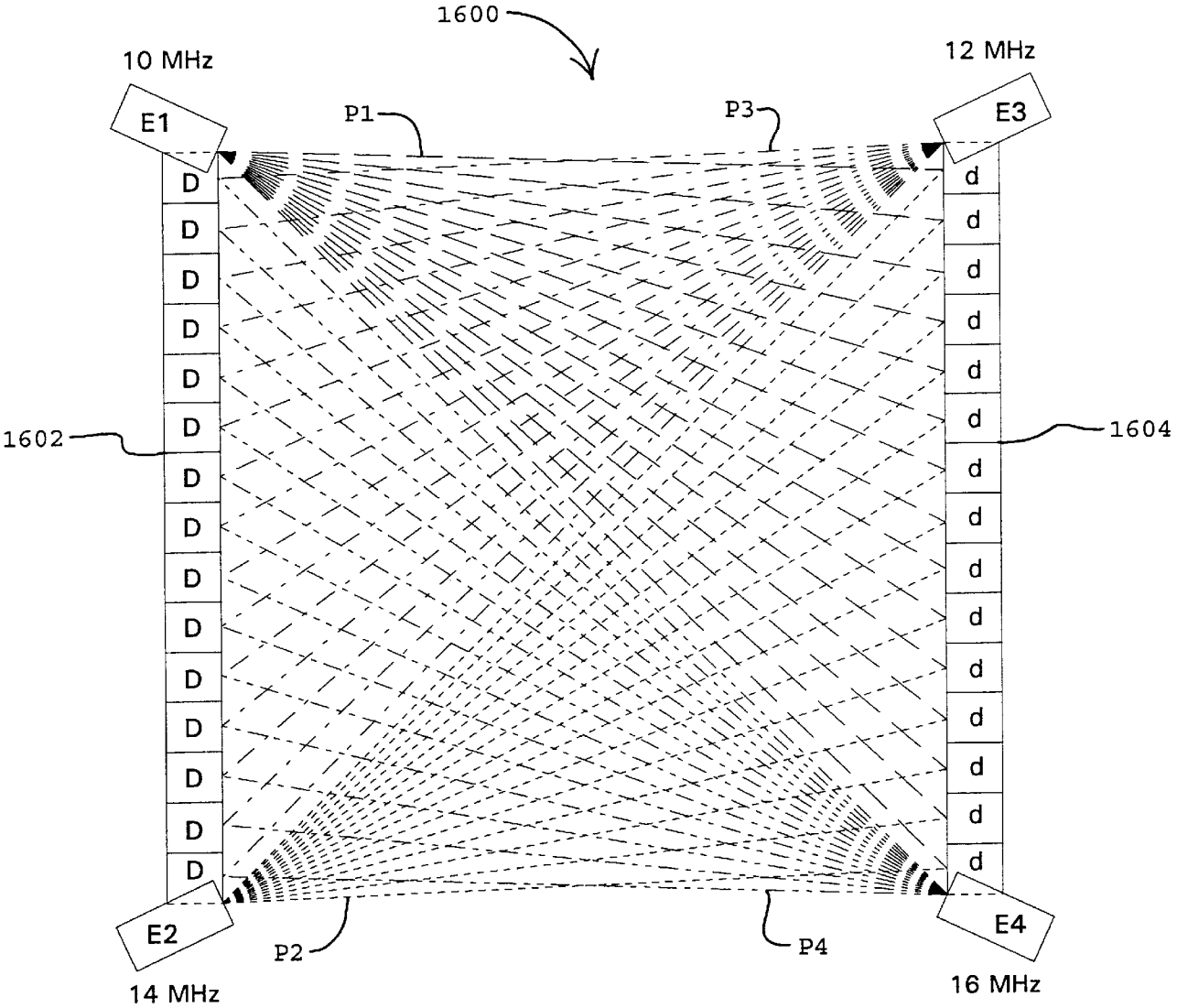
FIG. 28 is a front view of a light panel according to the present invention.

FIG. 28 illustrates a light panel 1600 according to the present invention with a first side 1602 and a second side 1604 spaced apart from the first side. Two light sources E1 and E2 are secured to or in panel side 1602. The two light sources E1 and E2 emit pulse modulated fan-shaped planes of light beams P1 and P2, respectively, toward a common plurality of detectors d located on or in opposite panel side 1604. Emitter light source E1 emits pulse modulated light at a first pulse modulation frequency (e.g., but not limited to, 10 MHz) and emitter light source E2 emits pulse modulated light at a second pulse modulation frequency (e.g., but not limited to, 14 MHz). Both emitters direct their fan-shaped beams toward the plurality of detectors d. Electronics (e.g. light signal amplification or demodulation circuitry, not shown) are associated with detectors d for responding to, and sensing the interruption of, pulse modulated light signals from the two light sources E1 and E2 simultaneously and independently. Two light sources E3 and E4 are secured to or in panel side 1604. The two light sources E3 and E4 emit pulse modulated fan-shaped planes of light beams P3 and P4, respectively, toward a common plurality of detectors D located on or in opposite panel side 1602. Emitter light source E3 emits pulse modulated light at a third pulse modulation frequency (e.g., but not limited to, 12 MHz) and emitter light source E4 emits pulse modulated light at a fourth pulse modulation frequency (e.g., but not limited to, 16 MHz). Both emitters direct their fan-shaped beams toward the plurality of detectors D. Electronics (e.g. light signal amplification or demodulation circuitry, not shown) are associated with detectors D for responding to, and sensing the interruption of, pulse modulated light signals from the two light sources E3 and E4 simultaneously and independently. Such a light panel is useful to detect the location, size, shape, orientation, velocity and/or image of any object or objects positioned within or passing through the panel's light beams and may be used in methods for such functions described below.

Figure 29:
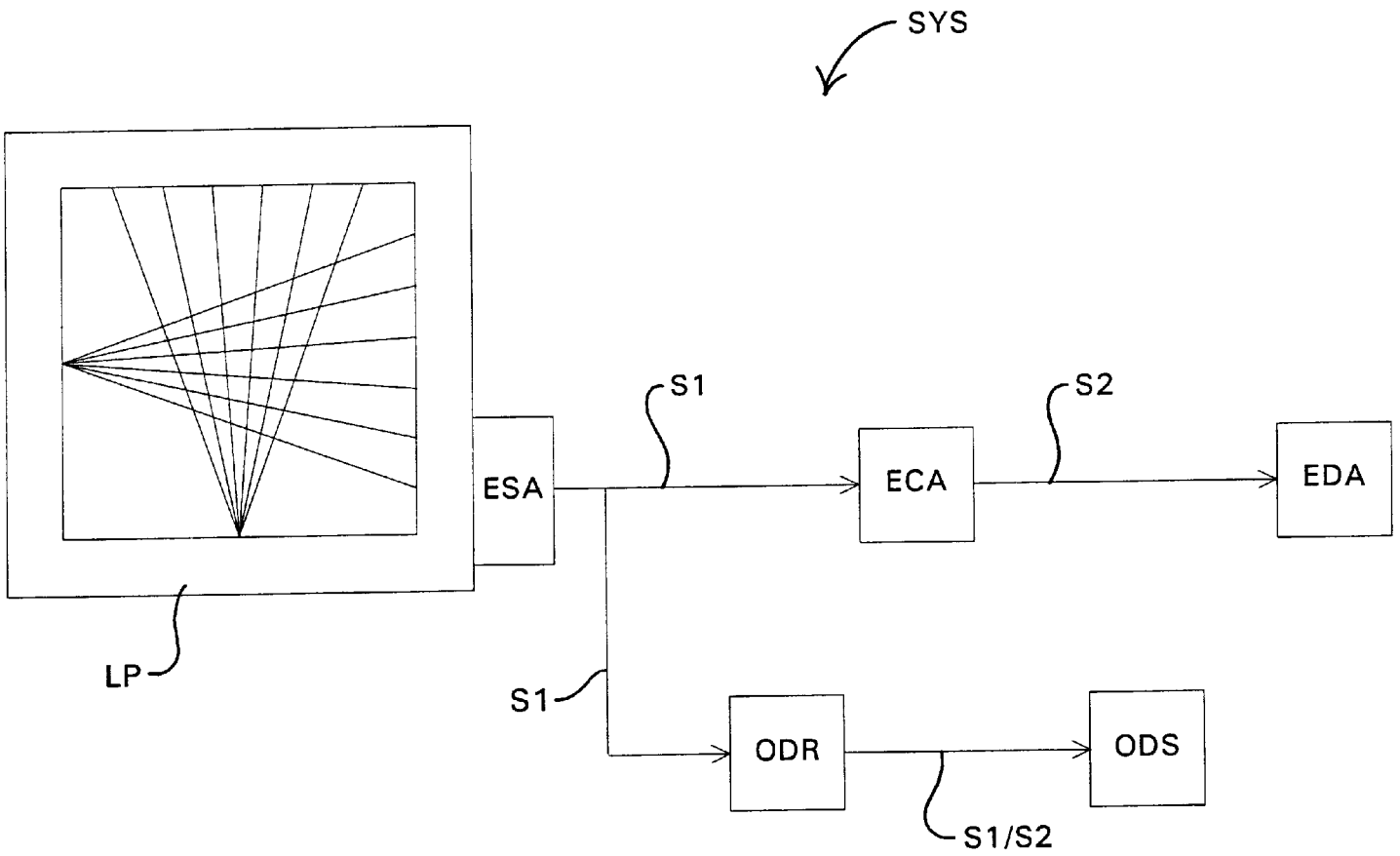
FIG. 29 is a schematic view of a system according to the present invention.

FIG. 29 shows schematically a system SYS according to the present invention which has a light panel LP (any light panel described or claimed herein) to which is connected electronic sensing apparatus ESA. "Connected" as used above and below includes actually in contact with the light panel LP or interconnected in electronic communication with the light panel although not in actual physical contact therewith. The electronic sensing apparatus ESA works with the light panel LP to sense an object in the light panel beam(s) and then transmits raw (e.g. unprocessed) electronic signals S1 to electronic calculating apparatus ECA (e.g. but not limited to any known computer) and/or to other receiving devices ODR [e.g. but not limited to an alarm, computer, machine, electronic apparatus, timer, counter, camera, or image device (as defined below)]. Optionally the other receiving devices ODR may transmit a raw and/or processed signal or signals S1/S2 to other devices ODS (e.g. but not limited to an ODR device as previously described). The electronic calculating apparatus ECA receives the raw (e.g. unprocessed) electronic signals S1 from the electronic sensing apparatus ESA and processes the signals (e.g. compares, analyzes, calculates, stores results, etc.) to produce an output signal S2 (e.g. results, data tables, images, graphs) used to drive a display/communication apparatus EDA such as, but not limited to, a direct readout display unit, monitor or printer for communication with a system user.

In one aspect the sensing and calculating apparatus are on the light panel frame, e.g., but not limited to, a microprocessor with calculating capability on the light panel frame. Electronic sensing apparatus is placed between the photodetectors and the electronic calculating apparatus; e.g. photodiodes output an analog voltage/current signal that is converted to a digital value to feed into the calculating apparatus. The electronic calculating apparatus in one aspect functions in series with (i.e. receive signals from) the electronic sensing apparatus.

Light panels according to the present invention may have a frame with any of the shapes shown or any other suitable shape, including but not limited to circular, oval, parallelogram, pentagonal, hexagonal, heptagonal, octagonal etc. Alternatively it is within the scope of this invention to hold or support light emitter(s) and/or light detector(s) in a suitable configuration and/or disposition with any suitable supports or members, all included in the general term "frame".

Light panels according to the present invention which utilize light sources that emit fan-shaped planes of light beams towards a plurality of detectors located on opposite panel sides may have the detectors located in a variety of ways, including but not limited to: positioned equally spaced apart along a straight line opposite an emitter; located with varying detector-to-detector spacing between adjacent detectors along a straight line opposite an emitter such that equal angular spacing increments are provided between adjacent detectors; located equally spaced apart along a curved line or arc of constant radial distance from an emitter, an arrangement which also provides equal angular spacing increments between adjacent detectors. Electronic apparatus, in one aspect, is part of a light panel (e.g. associated with or on a frame of a panel like the panels 600, 700, 800, 900, 1000, 1100, 1500, or 1600) and receives and processes signal(s) generated by two spaced-apart light panels to calculate object velocity and then transmits a signal indicative of velocity to a computer or other recording and/or display device(s). In any embodiment disclosed herein fiber optic cable(s) may be used to transmit light from locations on a light panel frame to another location and/or to one or more light sensors, e.g. but not limited to photosensor (s), remote from the panel(s).

Light panels according to certain embodiments of the present invention which utilize light sources that emit fan-shaped planes of light beams towards a plurality of detectors located on opposite panel sides may use continuous wave (CW), wavelength modulated (WM), amplitude modulated (AM), frequency modulated (FM), or pulse modulated light transmission techniques. In the pulse modulated mode, the light emitter(s) is continuously "pulsed", a term meaning to turn on and off at a high frequency, usually several thousand to many millions of times per second. A light detector and associated electronics (e.g., but not limited to, signal amplification circuitry or signal demodulation circuitry) receiving light from a pulse modulated emitter is tuned to respond only to light of the same pulse modulation frequency as the emitter (or, alternatively, to respond to the light of two or more pulse modulated emitters, each modulating at a different frequency, at the same time). Light received from sources other than the emitter(s) (e.g. ambient light) is rejected. The light emitters utilized in pulse modulated beam systems are also referred to as "transmitters," which are any light emitting device capable of being turned on and off rapidly, including but not limited to light emitting diodes (LED's) and lasers. The detectors utilized in pulse modulated beam systems are also referred to as "receivers," which are any light detecting device capable of responding to a rapidly pulsed/modulated light signal, including but not limited to charge-coupled devices (CCD's), charge injection devices (CID's), phototransistors, photodiodes and avalanche photodiodes.

Light panels according to certain embodiments of the present invention which utilize light sources that emit pulse modulated fan-shaped planes of light beams may use detectors and associated electronics (e.g. signal sensing, amplification, or demodulation circuitry) for simultaneously and independently detecting pulse modulated light signals at two (or more) discrete modulation frequencies from two (or more) separate emitters.

TARGET SYSTEM USE

Figure 12A:
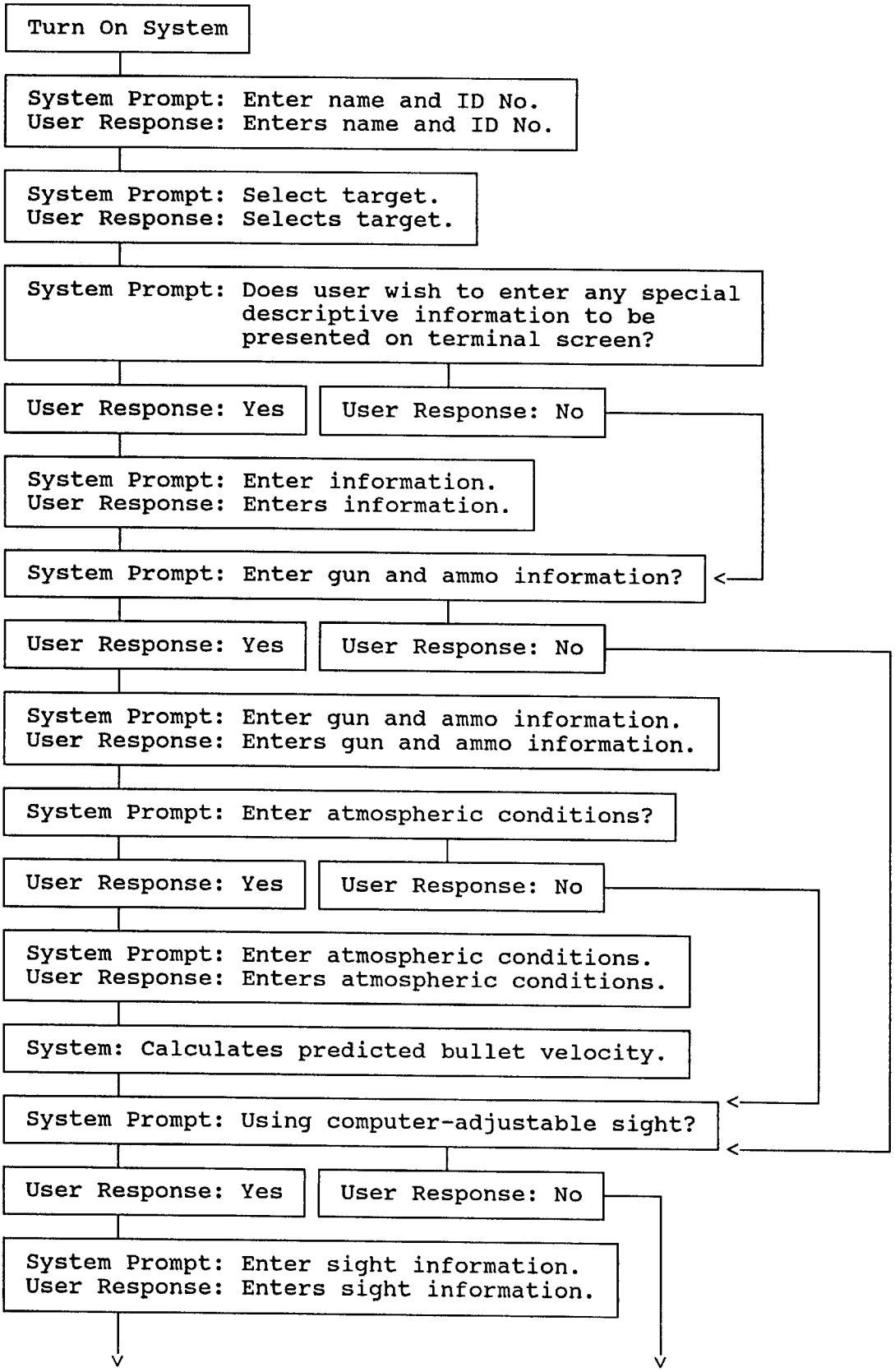
FIGS. 12*a* and 12*b* illustrate schematically an input method according to the present invention.
Figure 12B:
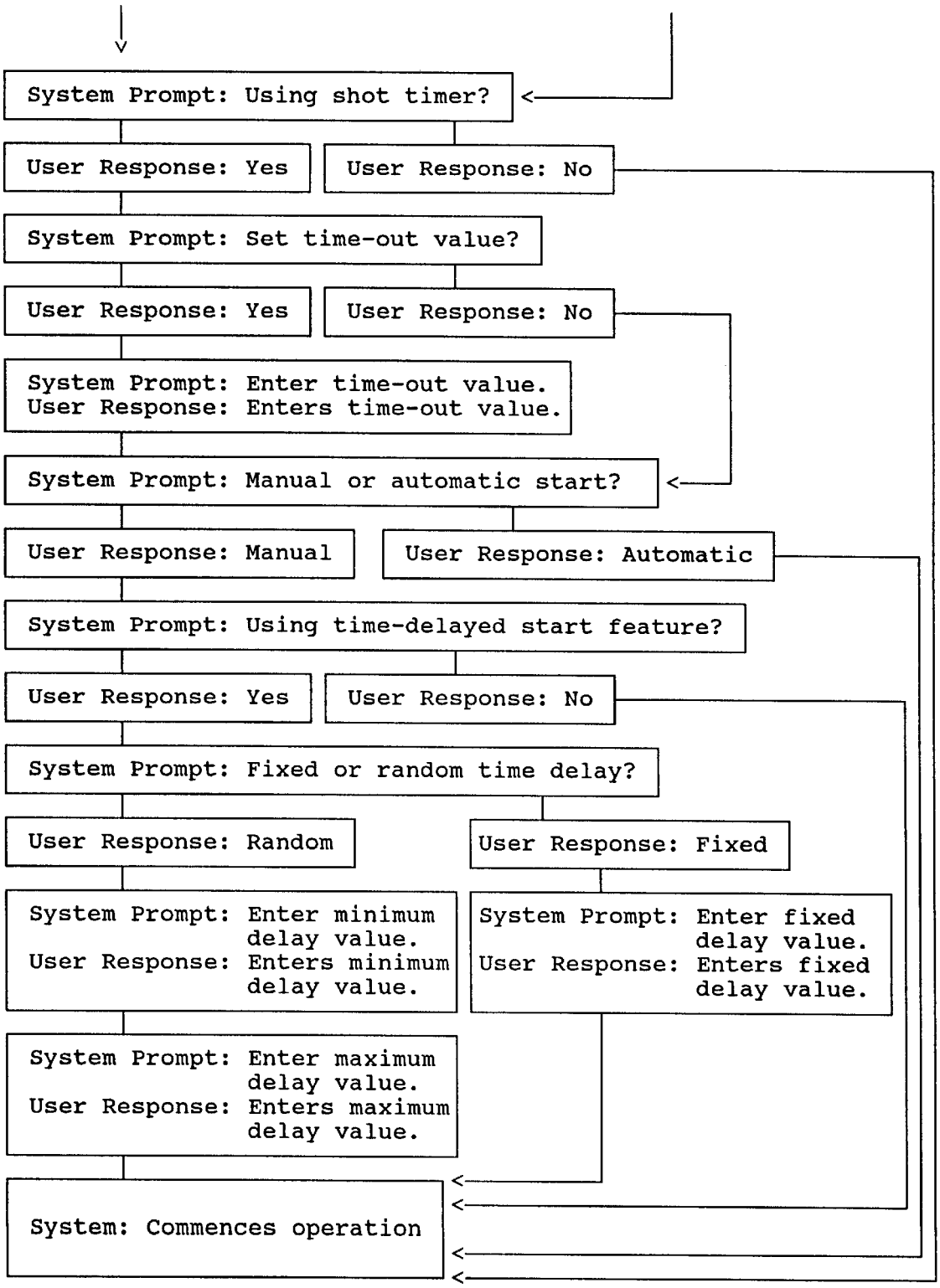

One target system according to this invention utilizing light panels according to this invention has a computer as previously described with internal devices and with software programs installed to accomplish the steps, methods and functions described herein. The computer, in one method, is turned "on", initializes and is ready to accept input from a new shooter (see FIGS. 12*a* and 12*b*). The new shooter (user) enters a name and identification number (ID No.) using a system computer keyboard. The system responds and asks the user to select a target from an on-screen menu or by entering a target number (e.g. four digits) for one of a plurality of available target images. The system then asks if the user wishes to enter any special descriptive information to be presented on the terminal monitor screen and preserved as part of the recorded results. If "yes", then the system responds with a terminal screen area into which the user enters information using the keyboard. If "no", then the system proceeds to a next prompt. The system asks if the user wishes to enter information about a firearm and ammunition in order for the computer to automatically calculate a predicted bullet velocity. If "yes", then the system responds with a series of prompts on the terminal screen whereby the user either makes choices from an on-screen menu, enters information using the keyboard or accepts system default values (e.g. see F5 softkey). If "no", then the system skips to a question regarding a computer-adjustable sighting device. The system asks if the user wishes to enter information regarding atmospheric conditions. If "yes", then the system responds with a series of prompts on the terminal screen whereby the user either makes choices from an on-screen menu, enters information using the keyboard or accepts system default values ( e.g. see F3 softkey). The system calculates predicted bullet velocity and stores it for display on the user's terminal screen. If "no", then the system skips to a question regarding the computer-adjustable sighting device. The system asks if the user is going to use a computer-adjustable sighting device. If "no", then the system skips to a question on shot timing. If "yes", then the system responds with a series of prompts on the terminal screen whereby the user either makes choices from an on-screen menu, enters information using the keyboard or accepts system default values pertaining to the characteristics and features of the sighting device. The system asks if the user wishes to use the automatic shot timing system. If "no", the system commences operation. If "yes", then the system proceeds through the steps shown in FIG. 12*b* related to the automatic shot timing system, beginning with "System Prompt: Set time-out value?" and the shooter responds appropriately at each prompt.

The system then commences operation and activates the target screen drive motor to give the user a fresh target screen; searches computer memory/storage media and finds the selected target and automatically transmits it to the video projector and computer monitor (target images may be either moving video targets or still image targets); activates the matrix light panel and chronograph panel; activates the downrange video projector which causes the selected target image to be projected onto the target screen (or activates the light(s) illuminating a preprinted target); presents the target image on the computer monitor along with shooter information, date, time, firearm/ammunition information, predicted bullet velocity, atmospheric conditions, distance to target, target number and tabular display form into which the shooter's results are entered as they occur; and issues a message of "Commence fire when ready" on the computer monitor and/or over the system's audio devices (user audio headset and/or loudspeaker); or, if the shot timer is being used in "manual" mode, the system prompts "Start timer when ready"; or, if using a computer-adjustable sighting device, the system prompts "connect computer cable and electrical power supply cable to sighting device and loosen all sight adjustment setscrews". In one embodiment a random start time is selectable so that the user is unaware of the precise moment when firing may be commenced. In one aspect the computer randomly chooses a start time within three to ten seconds of initiation. In one aspect the shot timing clock is automatically started when the first shot in a group is sensed by the system to have reached the target and/or stopped when the last shot in a group is sensed by the system to have reached the target. When preprinted target material is being used, the system computer activates (turns "on") and deactivates (turns "off") the light(s) illuminating the target area at the same times during the operating sequences that the video projector would normally be activated and deactivated.

Then the user starts the shot timer, if applicable (e.g. see F1 softkey). The user then commences firing shots at the target screen image.

The chronograph panel senses passage of a bullet projectile through it by sensing an interruption of one or more light beams projected between emitters and detectors, caused by the passing projectile. The signal generated by the interrupted light beam(s) of the chronograph panel is detected by the system's electronics and used to start the system's velocity measurement clock. The start time is transmitted to the computer where it is stored in memory. The matrix light panel and associated electronics sense passage of the projectile through it by sensing an interruption of one or more light beams projected between emitters and detectors, caused by the passing projectile, and calculates/transmits signals representing horizontal (X) and vertical (Y) coordinates of the interrupted beam(s) to the system computer. Also, the signal generated by the interrupted light beam(s) of the matrix light panel is detected by the system's electronics and used to stop the system's velocity measurement clock. The stop time is transmitted to the computer where it is stored in memory. Using the X-Y coordinate signals of the interrupted light beam(s) transmitted to it from the matrix light panel, the system computer: displays a graphic image of a "hole" onto the computer terminal screen representing the location where the bullet struck the target; calculates and displays the horizontal and vertical coordinates of the point of impact of the bullet relative to target center (if applicable to the selected target); for targets having different scoring values for hitting different areas of the target, determines and displays the scoring value corresponding to the X-Y coordinate of the bullet's point of impact; calculates the elapsed time of bullet passage between the chronograph and matrix light panels as measured by the velocity measurement clock; and with the distance between the two panels and projectile passage time, calculates and displays the measured velocity of the bullet (or, bullet velocity may be calculated by the light panels' associated electronics and transmitted to the system computer).

For multiple bullet projectiles, the system calculates and displays (as appropriate to the target being used)

Shot Group Size

Average Horizontal Coordinate (from target center)

Average Vertical Coordinate (from target center)

Average Score per Shot

Total Score for All Shots

Average Bullet Velocity

Highest Bullet Velocity

Lowest Bullet Velocity

Extreme Spread (difference between highest and lowest velocity)

Standard Deviation of Bullet Velocity

If a computer-adjustable sighting device is being used, the system automatically calculates the necessary corrections after each shot based on the X-Y coordinate of the point of bullet impact at the target as measured by the matrix light panel. The user views the results of each shot on the system terminal screen prior to using the data to automatically adjust the sighting device. If acceptable, the user presses a key on the terminal keyboard and the computer automatically outputs control signals to the sighting device (and its associated servomotors) to cause the device to be adjusted. Users can accept or reject individual shots for use in automatically making adjustments. Users can also elect to have the system use the average horizontal and vertical coordinate values of several shots to make the automatic sight adjustments. Once the adjustments are completed, the system advises the user: "Sighting-in complete. Disconnect computer cable and electrical power supply cable from sighting device and tighten all sight adjustment setscrews."

If the automatic shot timing system is being used, the shooter's time clock is started either manually by depressing a softkey (e.g. F1) on the user's terminal keyboard, or automatically by the system's electronics/computer when the first projectile in a group is sensed by the matrix light panel to have reached the target screen. The shooter's time clock runs continuously until either the last shot in a group is sensed by the matrix light panel to have reached the target screen; the clock is manually stopped by depressing a softkey (e.g. F4) on the user's terminal keyboard; or the clock "times-out" and automatically stops after reaching a preset maximum shooter's time default value set by the system user during the set-up procedures. If the shooter's time clock does stop due to reaching its "time-out"/default value, the system displays "time expired" on the user's terminal screen and, if desired, announces it over the audio system. During system operation while using the automatic shot timing feature, the system calculates and displays for each shot: the time elapsed since the shooter's time clock was started; and the time elapsed between shots. The system also calculates and displays the average elapsed time between shots in a given group. When the last shot in a group is sensed by the matrix light panel to have reached the target screen or when the shooter's time clock reaches its time-out value, the system: deactivates the matrix light panel and chronograph panel; deactivates the downrange video projector (or the light(s) illuminating a preprinted target); issues a message of "cease fire" on the computer monitor and/or over the system's audio devices; and asks the user if it is desired to store the results in computer memory, print a hardcopy of the results, use the system again, or "quit".

Exemplary computer keyboard softkey functions for one system according to the present invention are as follows:

F1 "Start Timer"—starts shooter's time clock

F2 "Change Number of Shots"—allows user to input/change the number of shots that may be fired in a single group at a single target screen. (Default=10 shots)

F3 "Change Atmospheric Conditions"—allows user to input/change the atmospheric conditions used in calculating the predicted velocity of the bullet:
- Temperature (Default=59 degrees F.)
- Elevation (Default=sea level)
- Barometric Pressure (Default=29.53"Hg)
- Percent Humidity (Default=78%)
- Distance to Target (Default=25 ft)

F4 "Stop Timer"—stops shooter's time clock

F5 "Change Gun/Ammunition"—allows user to input/change the ammunition and firearm information used in calculating the predicted velocity of the bullet.
- Gun Information:
  - Type (handgun or rifle)
  - Style (automatic, revolver, bolt action)
  - Caliber (9mm, .45, etc.)
  - Barrel Length (Default=handgun 4", rifle 20")
- Ammunition Information:
  - Manufacturer (If handloaded ammunition being used, or if computer does not have information from the manufacturer in its data files, the computer estimates BC based on bullet weight and type)
  - Bullet Weight (115 grains, etc.)
  - Bullet Type (JHP=jacketed hollow point, etc.)
  - Bullet Ballistic Coefficient (BC)—(If not known, computer calculates or looks up in data table based on bullet weight and type)

F6 "Change Target Selection"—allows user to input/change the target image being used. User is given an on-screen menu from which to select, or may enter a 4-digit target number.

F7 "New Shooter"—allows a new shooter to begin using the system. Responding to on-screen prompts at the user's terminal, the new shooter enters name and identification number and is then given the opportunity to accept the remaining system set-up parameters as-is or to reconfigure the system for new target selection, atmospheric conditions, ammunition and firearm.

F8 "New Target Screen"—allows user to activate the target screen drive motor at any time in order to replace the target screen.

F9 "Print Copy"—allows user to print a copy of the current monitor screen image at any time via the system printer.

F10 "Reset"—allows user to shut down system at any time and re-enter set-up sequence from the beginning; all set-up parameters are returned to their default values by the system computer.

F11 "Store/Retrieve Data Files"—allows user to store current results in the computer's memory base or to retrieve results stored previously.

F12 "System Manager"—allows the computer system manager to access maintenance and diagnostic programs used to ascertain that the system is functioning correctly; in one embodiment this is not a user-accessible softkey function and is password protected.

This invention discloses, in certain embodiments, (using systems as described with a computer and related apparatus, the computer with appropriate devices and software installed therein), a method of replacing a target or target screen downrange from a shooter which includes: transmitting a control signal initiated by a user from a computer to a downrange target screen drive mechanism (the control signal is a signal for instant action or for time delayed action, dependent on either an elapsed time period and/or on the occurrence of a number of shots as indicated by a shot sensor such as a matrix light panel or any other light panel described herein); the downrange drive mechanism receiving the signal from the computer with reception apparatus; and then the drive mechanism operating to remove one target or target screen and replace it with a new one. In one aspect of this method a target or target screen is automatically replaced if: 1. a new shooter begins using the system and goes through a system set-up; 2. if the same shooter opts to use the system again after shooting a prescribed number of shots or timing out; or 3. anytime a user presses the F8 "New Target Screen" softkey (e.g. if the target screen becomes damaged prior to finishing all shots).

This invention discloses, in certain embodiments, (using systems as described with a computer and related apparatus, the computer with appropriate devices and software installed therein), a method of producing a target image downrange from a shooter (system user) and/or on the system user's computer terminal monitor screen which includes: designating to the computer a selected target image (the computer having devices and apparatus to receive commands from a user and user accessible memory apparatus and storage location and memory address for the selected image); the computer having devices and apparatuses for accessing and transmitting the contents of the selected storage location containing the target image to a video projector located downrange and to a computer monitor positioned at the user's location; the video projector projecting the selected target image onto the target screen, preferably a replaceable target screen located downrange; and/or presenting the selected target image on the monitor screen at the user's location. The "computer's memory" includes any type of computer-accessible storage media device interconnected to the computer system.

In certain embodiments, this invention discloses (using systems as described with a computer and related apparatus, the computer with appropriate devices and software installed therein) a method for comparing a measured projectile velocity, kinetic energy, momentum, and power factor and a theoretical velocity, kinetic energy, momentum, and power factor, the method including: storing in a memory storage device in the computer published projectile ballistic information, ballistic equations, and data tables, the computer having installed therein appropriate devices and software programs to correct published ballistic information for standard conditions to conform to actual present shooting conditions for the various factors of gun barrel length, gun type, gun style, gun caliber, bullet weight, bullet type, bullet ballistic coefficient, temperature, elevation, barometric pressure, relative humidity, distance to target, and other parameters affecting bullet performance; calculating with the computer (with appropriate calculating device(s) and programming installed therein) predicted bullet velocity and/or kinetic energy, momentum, and power factor at the target location; displaying these factors on a computer monitor connected to the computer and controlled thereby; printing out, on a printer connected to and controlled by the computer, any or all of these factors; inputting into the computer input signals for clock start time and stop time from light panels which sense projectile passage (shot clock times); inputting into the computer a signal for the distance between the panels; storing the data represented by such signals in computer memory; calculating with the computer (with appropriate calculating device(s) and programming installed therein) actual velocity of the bullet, actual kinetic energy, actual momentum, and actual power factor and, if desired displaying such information on the monitor and/or printing out such information on the printer (or, in those embodiments in which the light panel itself has electronics therein or thereon or adjacent thereto and associated therewith for calculating actual bullet velocity, calculating bullet velocity with light panel electronics and transmitting the actual bullet velocity value itself to the system computer); and, if desired, calculating such actual or predicted factors and data for distances other than the actual distance of bullet travel from gun to target (e.g. muzzle conditions).

In certain embodiments, methods according to this invention (using systems as described with a computer and related apparatus, the computer with appropriate devices and software installed therein) to measure and track the location of a projectile's impact on a target include: projecting light beams across a light panel located in front of a target and detecting the beams with detectors either on the panel or remote therefrom; the light beam emitters and detectors arranged in a closely-spaced horizontal and vertical pattern or, alternately, the light beam emitters on different panel sides emitting fan-shaped planes of light beams in the direction of a plurality of closely-spaced light detectors located on panel sides opposite the emitters (like the panel 600), e.g. panel sides at right angles to each other with the light beams crossing through each other within the frame space; sensing interruption of one or more of the beams by a bullet passing therethrough; the light panel and associated electronics generating signals representing the X-Y coordinates of the point of interruption; transmitting the signals to the computer; storing the signals as a point-of-impact location in the computer; displaying data and/or a visual representation of the point of impact on a monitor interconnected with and controlled by the computer; and/or printing out on paper such data and representation on a printer interconnected with and controlled by the computer; calculating and, optionally, displaying (and/or printing out) horizontal and vertical distances from a target center as well as a scoring value for such a point of impact.

In certain embodiments, methods according to this invention (using systems as described with a computer and related apparatus, the computer with appropriate devices and software installed therein) to display and keep track of scoring and results for a number of bullets include: generating, calculating and transmitting bullet velocity, point-of-impact-on-target locations, angles of pitch and yaw, and angle of arrival as described herein; storing, processing, displaying (and/or printing out) such velocity, locations, pitch/yaw angles, and angles of arrival; calculating the factors and data regarding each shot as previously described and displaying it and/or printing it out; calculating average and cumulative results for multiple bullets (velocity, locations, pitch angle, yaw angle, angle of arrival and scoring); and, optionally, displaying such results on a monitor connected to the computer (in tabular and/or graphic form) and/or printing out such results on a computer-controlled printer.

In certain embodiments, methods according to this invention (using systems as described with a computer and related apparatus, the computer with appropriate devices and software installed therein) to measure velocity of an object (e.g. but not limited to a bullet) include: generating and transmitting signals associated with light beam interruption in two spaced-apart light panels caused by object passage therethrough, the signals indicative of the precise moment-in-time of passage of the object through each light panel; the object passing through the two light panels on a common axis thereof; the computer processing the signals and calculating elapsed time between signals and thereby, coupled with the known distance between panels, calculating the average velocity of the object (or, in those embodiments in which the light panel itself has electronics therein or thereon or adjacent thereto and associated therewith for calculating actual object velocity, calculating object velocity with light panel electronics and transmitting the actual object velocity value itself to the system computer); and, if desired, displaying the velocity on a monitor interconnected with and controlled by the computer (and/or printing it out with a printer interconnected with and controlled by the computer).

In certain embodiments, methods according to this invention (using systems as described with a computer and related apparatus, the computer with appropriate devices and software installed therein) to automatically adjust a scope and/or sighting device (collectively "sights") on a gun include: generating and transmitting signals indicative of bullet point-of-impact-on-target location to the computer as previously described; the computer processing such signals and calculating with the computer distance from the actual point of impact to a desired point of impact (e.g. a bullseye image center); calculating with the computer coordinate corrections necessary to move the actual point of impact to the desired point of impact; producing with the computer adjustment signals for signalling the movement apparatus (e.g. a servomotor system) interconnected with the sights to move the sights so that the actual point of impact coincides with the desired point of impact. The sighting device movement apparatus receiving the adjustment signals from the computer (either automatically or upon direction from the user) and accomplishing the adjustment.

In certain embodiments, methods according to this invention (using systems as described with a computer and related apparatus, the computer with appropriate devices and software installed therein) to create a desired target image and to move it, if desired, with respect to a target surface downrange include: storing in the computer's memory a plurality of target images, including pictorial, color, and graphical images; presenting sequential target images on a downrange target surface with a video projector (and/or on an interconnected monitor) so that the image appears to move, the presentation generated and controlled by the computer; if desired, changing the color of all or part of an image; and, if desired, printing out such image(s) with an interconnected printer. The "computer's memory" includes any type of computer-accessible storage media device interconnected to the computer system.

In certain embodiments, methods according to this invention (using systems as described with a computer and related apparatus, the computer with appropriate devices and software installed therein) to print a hard copy of a shooter's results include: storing in computer memory as previously described signals indicative of a plurality of bullet impact locations and data of bullets shot by a shooter on a target; the shooter inputting a print command to the computer; the computer sending appropriate signals to an interconnected printer; and the printer, in response thereto, printing out a hard copy showing the shooter's results in tabulated and/or graphical form.

In certain embodiments, methods according to this invention (using systems as described with a computer and related apparatus, the computer with appropriate devices and software installed therein) to produce human voice audio information and/or commands for a shooter include: the computer generating signals for audio apparatus and transmitting them thereto which are indicative of particular stages in the shooting of one or more shots, e.g. "Ready," "Commence Firing," "Cease Firing,"; the audio apparatus producing human voice (synthesized or recorded) announcements corresponding to each signal; if desired, the computer generating signals indicative of shot location, results, bullet parameters and/or scoring and the audio apparatus producing corresponding announcements; and, if desired, the computer generating signals indicative of elapsed and/or remaining time periods for a timed shot sequence and the audio apparatus producing corresponding announcements. Such methods may employ loudspeakers, personal head sets, or both. In one aspect such announcements are presented on the computer's monitor.

In certain embodiments, methods according to this invention (using systems as described with a computer and related apparatus, the computer with appropriate devices and software installed therein) to time shooting activity include: as previously described, generating signals indicative of shot clock time, location and score for each of a plurality of bullets impacting a target; storing such information in the computer memory; calculating with the computer elapsed time for each shot and total elapsed time for the plurality of shots combined; calculating the elapsed time between each shot; and, if desired, displaying such results on an interconnected monitor, announcing such results over an audio system, and/or printing out a hard copy thereof on an interconnected printer.

In certain embodiments, methods according to this invention (using systems as described with a computer and related apparatus, the computer with appropriate devices and software installed therein) to measure and track the location and/or size of an object passing through a light panel frame include: projecting light beams across a light panel positioned in the pathway of a moving object (or multiple objects) and detecting the beams with detectors either on the panel or remote therefrom; the light beam emitters and detectors arranged in a closely-spaced horizontal and vertical pattern or, alternately, the light beam emitters on different panel sides emitting fan-shaped planes of light beams in the direction of a plurality of closely-spaced light detectors located on panel sides opposite the emitters (like the panel 600) e.g. panel sides at right angles to each other with the light beams crossing each other within the frame space; sensing interruption of one or more of the beams by an object(s) passing therethrough; the light panel and associated electronics generating signals representing the X-Y coordinates of the point(s) of interruption; transmitting the signals to the computer; storing the signals as object size and/or location coordinates in the computer; displaying data and/or a visual representation of the location coordinates and/or size on a monitor interconnected with and controlled by the computer; and/or printing out on paper such data and representation on a printer interconnected with and controlled by the computer; calculating and, optionally, displaying (and/or printing out) horizontal and vertical distances from a known point of reference (e.g. the center of the light panel frame) as well as a scoring value (if applicable) for such location coordinates and/or size.

In certain embodiments, methods according to this invention (using systems as described with a computer and related apparatus, the computer with appropriate devices and software installed therein) to measure and record the angles of pitch and yaw of an object (e.g. projectile) passing through a light panel frame include: projecting light beams across a light panel positioned in the pathway of a moving object and detecting the beams with detectors either on the panel or remote therefrom; the light beam emitters and detectors arranged in a closely-spaced horizontal and vertical pattern or, alternately, the light beam emitters on different panel sides emitting fan-shaped planes of light beams in the direction of a plurality of closely-spaced light detectors located on panel sides opposite the emitters (like the panel 600) e.g. panel sides at right angles to each other with the light beams crossing each other within the frame space; sensing interruption of one or more of the beams by an object passing therethrough; the light panel and associated electronics generating signals representing the X-Y coordinates of the point(s) of interruption for each moment-in-time (e.g. clock pulse) during the total time period ($\Delta T$) in which the object interrupts light beams within the light panel frame space; transmitting the X-Y coordinate signals and the corresponding moment-in-time signals to the computer; the computer analyzing the signals and computing the change in the value of the X coordinate ($\Delta X$) of the object center and the change in the value of the Y coordinate ($\Delta Y$) of the object center which occurred during the total time period ($\Delta T$) in which the object interrupted the light beams within the light panel frame space; the computer further calculating the angles of pitch and yaw for the object, one possible calculation comprising:

$$\text{Angle of Pitch} = \text{Arc Tangent}\left(\frac{\Delta Y}{\Delta T}\cdot\frac{1}{V}\right)$$

$$\text{Angle of Yaw} = \text{Arc Tangent}\left(\frac{\Delta X}{\Delta T}\cdot\frac{1}{V}\right)$$

[The velocity (V) of the object having been determined by any method described herein or by any other method.]

Or, alternatively, if the length (L) of the object in the direction of travel is known:

$$\text{Angle of Pitch} = \text{Arc Sine}\left(\frac{\Delta Y}{L}\right)$$

$$\text{Angle of Yaw} = \text{Arc Sine}\left(\frac{\Delta X}{L}\right)$$

The computer storing the calculated values as object angles of pitch and yaw; displaying data and/or a visual representation of the object's pitch and yaw values on a monitor interconnected with and controlled by the computer; and/or printing out on paper such data and/or representation on a printer interconnected with and controlled by the computer.

A computer used in any embodiment of this invention, including but not limited to the preferred embodiments described above, has, in one aspect: storage apparatus with or in the computer for storing a plurality of target images to be displayed on the computer monitor or target screen, including images stored in any type of computer-accessible storage media device interconnected to the computer; and/or storage apparatus in the computer for storing the location of the point of bullet impact and the bullet velocity information transmitted to it from the first panel electronic apparatus; and/or calculating and storage apparatus in the computer for calculating and storing a variety of ballistic data regarding bullet performance and for analyzing and comparing such actual bullet ballistic data with known, predicted ballistic performance data for such a bullet; and a system according to the present invention with such a computer with any such apparatus may have movement apparatus positioned within the support member for moving the target.

In any embodiment of this invention, the electronics associated with any light panel may include a computer for receiving, storing, calculating, analyzing and comparing signals and/or data transmitted to it from the light panel. In any embodiment of this invention, the light panel may use or incorporate flat (plane) or curved mirrors/reflectors to reflect and/or redirect the planes of light beams from emitters to detectors. A "moving object" is one in linear and/or rotational motion in relation to the light panel frame; e.g. the object is moving and the light panel frame is stationary; the object is stationary and the light panel frame is moving; both the object and the light panel frame are moving, but at different rates/velocities such that there is relative motion (linear and/or rotational) between the object and the light panel frame; or the object is stationary within the light panel frame space while the light panel frame is rotated around one axis of the object while traversing along another axis of the object in order to obtain an image of the object.

In any embodiment of this invention, light panels may utilize light emitters which emit modulated light beams and light detectors and associated electronics which are tuned to respond only to the modulated light that is emitted from their associated emitters.

The light panel systems as described herein can be used to perform a variety of functions. A light panel and associated electronics is used as a noncontact presence sensing device which generates and transmits signals whenever an object interrupts the light beam path between emitters and detectors. The transmitted signals can be used to operate other devices or control a process. In one application, a light panel system is used as a security fence/curtain to provide perimeter guarding of an area. In the event that an object (e.g. person) interrupts the light beams, a signal transmitted from the light panel system is used to sound an alarm or cause other action to be taken (e.g. autodialing a telephone). In another application, a light panel system is used as a machine guard system to close a door or gate or shut down an apparatus or hazardous machinery to protect workers in the event an object (e.g. animal, person, projectile) interrupts the light beams of a presence-sensing light curtain/screen erected around the hazardous machines ("safety light curtain").

In one application, a light panel system is positioned in the path of a moving object and used as the event trigger mechanism for starting a high speed frame, film or video camera in order to photograph/record a high speed event ("High Speed" refers to events that occur too fast to be perceived by a human eye or recorded by conventional photographic techniques). When the moving object interrupts the light beams between emitters and detectors, the light panel electronics senses the presence of the object and transmits a signal to the camera system to begin filming. Reflectors or mirrors can be used with such systems to allow emitters, detectors and associated electronics to be located remote from the detection area.

Light panel systems are used to determine the precise moment-in-time of passage of an object through the light panel frame space and are used as an event timing trigger device to start and/or stop a timing sequence or clock. In one application, a first light panel system is positioned at the end of a gun barrel and a second light panel system is positioned at a distant location (e.g. at a target). As a bullet leaves the gun barrel, it blocks a portion of the light beams of the first light panel system which in turn transmits a signal to start a time clock. As the bullet passes through the light beams of the second light panel system, the system electronics transmits a signal to stop the time clock. The total time elapsed on the time clock is the bullet's time of flight. In other combinations, other devices are used to either start or stop the time clock with a single light panel system used to complete the timing sequence. In one application, a light panel system is used in conjunction with another apparatus in order to measure the action time of a firearm; the "action time" being the total time elapsed between the moment the hammer/firing pin strikes the cartridge primer (or alternatively, the moment the trigger is pulled) until the bullet emerges from the gun barrel. A light panel positioned at the end of the gun barrel is used to detect the precise moment-in-time the bullet emerges from the barrel and transmits a signal to stop a time clock that was started by a separate apparatus that sensed the exact moment the hammer/firing pin struck the cartridge primer (or alternatively, the exact moment the trigger was pulled).

A light panel system as described herein is used as a counting device for counting objects which pass through the light panel frame and for calculating the number of discrete objects which pass through the light panel frame space per unit of time. In one application, a light panel system is used to measure the rate-of-fire of a machine gun when the bullets from the gun pass through the light panel frame and interrupt the light beams. In another application, a light panel system is used to count the number and rate of flow of solid objects (e.g. boxes, cereal grains, articles of manufacture, drug capsules, tools, parts, etc.) moving down a conveyor belt or falling out of a chute or pipe. As each object momentarily interrupts the light beams, the light panel system electronics registers the occurrence and moment-in-time of each discrete beam interruption.

A light panel and associated electronics is used as a device to sense and calculate the position of an object which interrupts the light beam paths between emitters and detectors. When functioning as a position-sensing device, a light panel system is used to transmit signals to operate other devices or control a process. In one application, a light panel frame is located in front of a menu diagram and used as a touch input device. Using a finger or stylus to make a selection, users point to items on the menu and the light panel system detects the location within the light panel's sensing plane where the light beam paths were interrupted and transmits signals as appropriate to other devices for action. In one aspect such a light panel is used for a touch input screen ("touchscreen") for a computer monitor.

In another application, a light panel system is used as an optical position indicator that tracks the location of objects within the light panel frame space ("motion analysis"). As long as an object is present within the frame space, the light panel system provides the location coordinates of the object by sensing the location of the light beam paths interrupted between emitters and detectors.

A light panel and associated electronics as described herein may be used in conjunction with any "image device." An "image device" is any apparatus capable or receiving and/or processing signals transmitted to it in order to record and/or create an image of an object(s) detected by a detector (e.g. a light panel), and/or storing those signals in as-received form or in processed (e.g. image) form, and/or displaying the signals as received or in a processed (e.g. image) form, and/or transmitting signals as received or as processed to another device for action (e.g. activate an alarm, advance a counter, control a machine or motor, drive a display, activate a switch, etc.) including, but not limited to, a computer, programmable logic controller (PLC), comparator, data acquisition module, digital interface module, digital signal processing module, direct readout display unit, data logger, data recorder, data profiler, signal analyzer, digitizer, oscilloscope, or intelligent measurement and control system module.

A light panel and associated electronics is used as an image sensing system ("imaging system") for determining the two-dimensional and/or three-dimensional size and shape ("profile"), the orientation, and/or the optical characteristics (e.g. translucence) of moving or stationary objects. For an object that is stationary within a light panel frame space, the system senses the location and value of the signal generated by each of the plurality of detectors located around the light panel frame. By analyzing the values of the individual signals received from the different detector locations at a single moment-in-time (e.g. clock pulse), the light panel system calculates the size and shape of the object as viewed within the plane of the light beams ("sensing plane") of the light panel frame. To obtain the image of a moving object, a light panel system continuously senses and stores the location and signal values for each of the plurality of detectors along with the moment-in-time for each signal value. By storing (i.e. sampling-and-holding), comparing and analyzing the value of the signals received from each of the detectors during a time period (i.e. sequence of moments-in-time) in which an object moves through the light panel frame space, the system compiles/constructs a sequential set of in-plane shapes/sizes (partial images) for the object which when examined (e.g. compared, plotted, graphed, read out) in relation to an appropriate time base produces a two or three-dimensional image, shadowgraph or silhouette of the moving object. After acquiring an image of the object, the system can then analyze (e.g. measure), compare (e.g. recognize) and/or present the results (e.g. an image of the object displayed on a computer monitor). The system can also manipulate the stored image for viewing (e.g. enlarge it, rotate it in space, etc.).

A light panel system is used as a stand alone device for the acquisition, storage and analysis of object images ("machine vision"), or it is used to transmit signals to operate other devices or control a process. In one application, a light panel system is used as a noncontact dimensional measurement or gauging system for stationary or moving objects. In another application, a light panel system is used as an automatic inspection system that recognizes discrete objects by comparing their images one-to-the-other or by comparing their images to standard images stored in system memory. Once objects are recognized, a light panel system is used to perform other tasks, such as counting recognized objects, inspecting objects for defects/flaws (e.g. holes), inspecting objects for placement, location, orientation and/or alignment, recording/reporting results of the inspection and/or transmitting signals to other devices associated with the automatic inspection/quality control process (e.g. conveyors, pick-and-place machines, label applying machines, alarms, etc.).

In one application, a light panel system is used to determine the orientation of an object or projectile (e.g. bullet) in flight. By obtaining an image of the object/projectile (or, alternatively by monitoring the changes to the X-Y coordinates of the center of the object/projectile) as it passes through the light panel frame space, the light panel system calculates the angles of pitch and yaw exhibited by the object/projectile. In another application, an image of the pattern density for shot pellets fired from a shotgun is obtained using a light panel system. The in-plane size and shape of the pellet group is recorded for each moment-in-time the pellets interrupt the plane(s) of light within the light panel frame as they travel through the frame space. When these partial images obtained by the system for each moment-in-time are analyzed sequentially in the appropriate time base, an image of the shot pellet group is obtained.

A method for determining the location coordinates of a projectile's point-of-impact on a target using a location-coordinate sensing light panel has been described. A projectile's horizontal and/or vertical angle of arrival at a target can be determined using two (or more) such location-coordinate sensing light panels properly arranged. In one embodiment two location-coordinate sensing light panels are placed a known distance apart ($\Delta Z$) on a common axis (Z) in the direction of projectile travel and immediately in front of the target. As a projectile travels toward the target, passing through the two light panels on a common axis, it first interrupts the light beams of the first light panel causing signals to be generated indicating projectile coordinates ($X_1$,$Y_1$). Subsequently, the projectile interrupts the light beams of the second light panel causing signals to be generated indicating projectile coordinates ($X_2$, $Y_2$) before impacting the target. The light panel system then calculates the projectile's angles of arrival at the target as:

$$\text{Horizontal Angle of Arrival} = \text{Arc Tangent}\left(\frac{(X_2 - X_1)}{\Delta Z}\right)$$

$$\text{Vertical Angle of Arrival} = \text{Arc Tangent}\left(\frac{(Y_2 - Y_1)}{\Delta Z}\right)$$

This method is used to calculate the angles of arrival or angles of travel for any moving object.

A method for measuring object velocity using light beam interruption signals from two spaced-apart light panels has been described. For objects of known length (L) in the direction of travel through the light panel frame space, a light panel system using a single light panel with all light beams in a single sensing plane is used as a noncontact velocity measurement device. By sensing and recording the precise moment-in-time at which the object first interrupts the light beams between emitters and detectors, and by subsequently sensing and recording the precise moment-in-time at which the light beam path between emitters and detectors is restored, an elapsed time of beam interruption ($\Delta T$) is calculated by the system. This $\Delta T$ is also the object's time-of-travel through the light panel frame space, so the object's velocity (V) is then calculated by the system as:

$$V = \frac{L}{\Delta T}$$

In one application, a light panel system with a single plane of light beams is used to measure the velocity of objects (e.g. boxes) of constant size being transported on a conveyor belt or dropping out of a chute.

In the same way a light panel system is used to monitor discrete objects, a light panel and associated electronics is used to monitor and/or capture and/or process an image or images of continuous, flowing or web-feed materials, sheets, and objects ("monitoring" including any or all such steps). "Web processing" is the term used to denote the continuous and usually seamless material handling process commonly used with such materials as textiles, paper, steel, glass, plastic and lumber. In one application, a light panel system is used as a noncontact, automatic measurement, gauging and inspection system for materials continuously moving lengthwise through the light panel frame space. The system is used to recognize defects/flaws (e.g. holes, tears), recognize repeating patterns (e.g. hole patterns stamped in sheet metal) and verify/maintain dimensional consistency/integrity; to continuously monitor the location of the outer edges of sheet/strip/film materials ("edge detection") for the purpose of maintaining constant material width and/or constant centerline or edge alignment with processing equipment ("position control") ("monitoring" including any or all such steps).

A light panel system is used to monitor liquid or gas flow streams for clarity/light transmittance, density variations and/or solids content by passing the light beams of the light panel frame across the flow stream perpendicular to the flow direction and continuously monitoring the values of the signals generated by the plurality of detectors located around the light panel frame. As the liquid or gas stream passes through the light panel frame space, the light from emitters to detectors is blocked an amount proportional to the optical density/translucence of the flow stream. Fully transparent flow streams block no light and opaque flow streams block all light between emitters and detectors. Using this principle, the light panel system is used as a densitometer to determine the optical density of, or the portion of solids present in, a flow stream. In one application, a light panel system is used for continuous, real-time emissions monitoring. The relative opacity of discharge gas streams ("stack gas opacity") is measured and monitored on a continuous, real-time basis; or suspended solids concentration or turbidity of liquid flow streams is measured and monitored continuously.

In another application, a light panel system (e.g. any light panel system as described or claimed herein) is used for real-time evaporation rate monitoring and closed-loop control of the evaporization process (e.g. but not limited to, a physical vapor deposition process or thin film deposition process). A light panel is positioned in such a way that the product (i.e. gas, vapor) of the evaporization process is positioned within or flows through the panel's light beams. The percentage of the light which is blocked (attenuated) or absorbed (including atomic absorption) by the vapor/gas within the light panel frame space is a measure of the density/concentration of the vapor/gas molecules present within the flow area/frame space. The percentage of the light blocked/absorbed is continuously monitored by the light panel's electronics and used to control the heat or other energy input into the process that produces the vapor or drives the evaporating material into the gaseous form. As used in the claims "gas stream" includes: a gas stream of a single gas; a stream of a mixture of gases; a vapor stream; or a gas/vapor stream.

In one application, a light panel system is used to monitor the density gradients (variations) occurring over time in a nonhomogeneous flow stream directed to flow through the sensing plane of a light panel frame. By comparing, analyzing and plotting the values of the signals received from each of the plurality of light panel detectors over a time period, the system constructs an image of the density gradients present in the flow stream ("schlieren imaging").

In another application, a light panel system is used to monitor the flow rate of solid material (e.g. grain, rocks, particles) flowing continuously out of a pipe or chute and through the light panel frame. By monitoring the percentage of total light blocked between emitters and detectors per unit time, the system calculates a proportional flow rate for the material.

As with imaging and inspection applications for discrete objects, light panel systems used to monitor continuous, flowing or web-feed materials are used to transmit signals to operate other devices or to control a process.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A method for monitoring an object passing through a frame space of a light panel, the light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam, across the frame through which and beyond which an object may pass, and at least one light detector on the second side of the frame and associated electronic sensing apparatus connected to the at least one light detector for continuously detecting the fan-shaped light beam from the at least one light emitter, the method comprising continuously detecting with the at least one light detector and associated electronic sensing apparatus interruption by an object of the fan-shaped light beam continuously emitted by the at least one light emitter, and generating with the electronic sensing apparatus a signal signalling the interruption of the fan-shaped beam by the object.

2. The method of claim 1 wherein the at least one light emitter emits a modulated fan-shaped light beam.

3. The method of claim 1 further comprising transmitting with the electronic sensing apparatus the signal to a device thereby activating the device.

4. The method of claim 3 wherein the device is from the group consisting of a computer, an alarm device, a message sender, a signal recording device, a shut-down device, a camera, a machine, a switch, a relay, a controller, a timer, a clock, a display, a light, an instrument, an indicator, a motor, and an image device.

5. The method of claim 1 wherein the light panel is a first light panel, a second light panel is spaced apart a known distance from the first light panel, the second light panel comprising a second frame with a second top, a second bottom spaced apart from the second top, a first lateral side between the second top and the second bottom, and a second lateral side spaced apart from the first lateral side, the second lateral side between the second top and the second bottom, the second frame defining a second frame space between its second top, second bottom, and two lateral sides, at least one second light emitter on the first lateral side, the at least one second light emitter for continuously emitting a second fan-shaped light beam across the second frame through which and beyond which an object may pass, and at least one second light detector on the second lateral side of the second frame and second associated electronic sensing apparatus connected to the at least one second light detector for continuously detecting the second fan-shaped light beam from the at least one second light emitter, each light panel's associated electronic sensing apparatus including a signal generator and a signal transmitter, each associated electronic sensing apparatus connected to a clock, the clock including signal recording apparatus, the method further comprising generating a first signal indicative of passage of the object through the frame space of the first light panel, transmitting the signal to the clock to start the clock to time amount of time for the object to go from the first light panel to the second light panel, generating a second signal indicative of passage of the object through the second frame space of the second light panel, transmitting the second signal to the clock to stop the clock, recording with the clock time elapsed for passage of the object from the first light panel to the second light panel, and calculating velocity of the object based on the time elapsed and the known distance between the light panels.

6. The method of claim 5 wherein the object is a bullet fired from a gun so that the bullet passes through the frame space of both light panels.

7. The method of claim 5 wherein each light emitter emits a modulated fan-shaped light beam.

8. The method of claim 1 wherein the object is a first object and a plurality of objects passes sequentially through the light panel, the light panel and associated electronic sensing apparatus connected to totalling apparatus for receiving a plurality of signals from the associated electronic sensing apparatus, one signal corresponding to each object of the plurality of objects, the method further comprising generating a signal corresponding to a time each object passes through the frame space of the light panel, transmitting each signal to the totalling apparatus, totalling the number of signals received from the associated electronic sensing apparatus with the totalling apparatus and producing an output indicative of the total number of objects passing through the frame space, and totalling an amount of time elapsed for occurrence of the plurality of signals received from the associated electronic sensing apparatus with the totalling apparatus, and calculating with electronic calculating apparatus a numerical rate of passage of objects through the light panel frame space based on the number of objects counted and the time elapsed.

9. The method of claim 8 wherein the totalling apparatus is a computer.

10. The method of claim 1 wherein the at least one light emitter is at least two spaced apart light emitters and the at least one light detector is at least two light detectors with at least one light detector positioned opposite each of the at least two spaced apart light emitters and wherein the light panel is disposed adjacent a menu diagram so that touching a portion of the menu diagram in a specific location with a touch member interrupts a specific part of the fan-shaped light beam, the at least one light detector comprising a plurality of light detectors and associated electronic sensing apparatus so that interruption of the specific part of the fan-shaped light beam is sensed by at least one of the plurality of light detectors and a signal is generated indicating which light detector sensed said interruption thereby indicating the portion of the menu diagram touched by the touch member, the method further comprising, touching a portion of a menu diagram with a touch member, the menu diagram disposed adjacent the light panel so that in touching the portion of the menu diagram the touch member interrupts the fan-shaped light beam and said interruption is sensed by at least one of the light detectors and associated electronic sensing apparatus, generating a touch signal with the associated electronic sensing apparatus indicative of location of the touching and of the portion of the menu diagram touched by the touch member, and transmitting with the associated electronic sensing apparatus the touch signal to a signal receiving other device to activate the signal receiving other device.

11. The method of claim 1 wherein the at least one light emitter is at least two spaced apart light emitters and the at least one light detector is at least two light detectors with at least one light detector positioned opposite each of the at least two spaced apart light emitters and wherein each light detector is connected to associated electronic sensing apparatus for generating a signal upon interruption of a portion of the fan-shaped light beam detected by said each light detector, the method further comprising generating a set of signals from light detectors whose beam portions are interrupted by the object, the set of signals corresponding to an image of the object.

12. The method of claim 11 wherein each light emitter emits a modulated fan-shaped light beam.

13. The method of claim 11 further comprising transmitting the set of images to an image device.

14. The method of claim 11 wherein the image indicates a density pattern of the object.

15. The method of claim 13 wherein the image device is a computer and the method further comprising calculating angles of pitch and yaw for the object.

16. The method of claim 13 wherein the object is a bullet and the image device is a computer, the light panel is a first light panel, a second light panel is spaced apart a known distance from the first light panel, the second light panel comprising a second frame with a second top, a second bottom spaced apart from the second top, a first lateral side between the second top and the second bottom, and a second lateral side spaced apart from the first lateral side, the second lateral side between the second top and the second bottom, the second frame defining a second frame space between its second top, second bottom, and two lateral sides, at least one second light emitter on the first lateral side, the at least one second light emitter for continuously emitting a second fan-shaped light beam across the second frame through which and beyond which an object may pass, and at least one second light detector on the second lateral side of the second frame and second associated electronic sensing apparatus connected to the at least one second light detector for continuously detecting the second fan-shaped light beam from the at least one second light emitter, each light panel's associated electronic sensing apparatus including a signal generator and a signal transmitter, each associated electronic sensing apparatus connected to a computer, the computer including signal recording apparatus, and the method further comprising calculating with the computer an angle of arrival of the bullet on a target adjacent the light panel.

17. The method of claim 1 wherein the object's size is a known size and initial entry into the frame space of the light panel generates a first signal and prior to exiting the frame space the object's passage generates a last signal, the method further comprising transmission of the first and last signals to electronic calculating apparatus and calculating therewith time elapsed between the first and last signals, and based on the known size of the object and time elapsed between the first and last signals, calculating velocity of the object.

18. The method of claim 13 wherein the object is a first object, the first object and a plurality of objects flow through the frame space as a solids stream, and the image is an image of the solids stream, the image device is a computer and the method further comprising calculating with the computer a flow rate of the solids stream.

19. The method of claim 1 wherein the light panel is connected to electronic calculating apparatus associated with the frame for calculating location coordinates of an object passing through the frame space, the associated electronic sensing apparatus connected to the electronic calculating apparatus, the method further comprising calculating location coordinates of the object passing through the frame space.

20. The method of claim 1 wherein the light panel is connected to electronic calculating apparatus associated with the frame for calculating size of an object passing through the frame space, the associated electronic sensing apparatus connected to the electronic calculating apparatus, the method further comprising calculating size of the object passing through the frame space.

21. The method of claim 1 wherein the associated electronic sensing apparatus is connected to electronic calculating apparatus which calculates velocity of an object passing through the light panel frame space, which object has first passed through a second light panel spaced apart from, on a common axis with, and interconnected in electronic communication with the light panel, the method further comprising calculating velocity of the object passing through the light panel frame space.

22. The method of claim 1 wherein the associated electronic sensing apparatus is connected to electronic calculating apparatus that transmits data to another device regarding the object, the method further comprising transmitting the data to the another device.

23. The method of claim 1 wherein the at least one light emitter is a laser and the light panel includes lens means adjacent the laser and the laser provides a laser light beam to the lens means.

24. The method of claim 23 wherein the lens means is a line generating lens emitting a fan-shaped plane of light, the method further comprising generating a fan-shaped plane of light with the lens means.

25. A method for monitoring an object passing through a frame space of a light panel, the light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, and at least one light emitter on the bottom, the light emitters each for continuously emitting a fan-shaped light beam in a plane across the frame through which an object may pass, the light beams crossing each other in the frame space, at least one light detector on the second side of the frame for continuously detecting the fan-shaped light beam from the at least one light emitter on the first side, and at least one light detector on the top of the frame for continuously detecting the fan-shaped light beam from the at least one light emitter on the bottom of the frame, associated electronic sensing apparatus connected to the at least one light detector, the method comprising continuously detecting with the at least one light detector and associated electronic sensing apparatus interruption by an object of the fan-shaped light beams continuously emitted by the at least one light emitter, and generating with the electronic sensing apparatus a signal signalling the interruption of the fan-shaped beams by the object.

26. The method of claim 25 wherein the at least one light emitter on the bottom emits a modulated fan-shaped light beam and the at least one light emitter on the first side emits a modulated fan-shaped light beam.

27. The method of claim 25 wherein the light panel is connected to the associated electronic sensing apparatus associated with the frame for detecting interruption of the light beams by an object passing through the frame space, and to electronic calculating apparatus associated with the frame for calculating size and location coordinates of an object passing through the frame space, and for calculating velocity of an object passing through the light panel frame space and through a frame space of another identical light panel spaced apart therefrom and on a common axis therewith, and for transmitting data regarding the velocity, size, and location coordinates, wherein the at least one light emitter on the first side is a laser with lens means adjacent the laser, the laser for providing a laser light beam to the lens means, and wherein the lens means is a line generating lens emitting a fan-shaped plane of light, wherein the at least one light emitter on the bottom is a laser with lens means adjacent the laser, the laser for providing a laser light beam to the lens means, and wherein the lens means is a line generating lens emitting a fan-shaped plane of light, the method further comprising detecting with the associated electronic sensing apparatuses interruption of the light beams by an object passing through the frame spaces, calculating with the electronic calculating apparatus velocity and size and location coordinates of the object passing through the frame spaces and producing data indicative thereof, and transmitting the data to another device.

28. A method for monitoring an object passing through a frame space of a light panel, the light panel comprising a frame with a top and a bottom spaced apart from the top, the frame defining a frame space between its top and bottom, at least one light emitting fiber optic on the frame with lens means for continuously emitting a fan-shaped light beam across the frame through which an object may pass and having a first end on the frame and a second end spaced apart therefrom, at least one light receiving fiber optic on the frame disposed opposite from the at least one light emitting fiber optic with lens means and having a first end on the frame and a second end spaced apart therefrom, a light emitter adjacent the second end of the at least one light emitting fiber optic for continuously emitting light into the light emitting fiber optic, and a light detector adjacent the second end of the at least one light receiving fiber optic for continuously receiving light therefrom, and associated electronic sensing apparatus connected to the at least one light receiving fiber optic, the method comprising detecting with the at least one light receiving fiber optic and the associated electronic sensing apparatus interruption by an object of the fan-shaped light beam continuously emitted by the at least one light emitter, and generating with the associated electronic sensing apparatus a signal signalling the interruption of the fan-shaped beam by the object.

29. The method of claim 28 wherein the light panel is connected to the associated electronic sensing apparatus associated with the frame for detecting interruption of the light beams by an object passing through the frame space and to electronic calculating apparatus associated with the frame for calculating size and location coordinates of an object passing through the frame space, and for calculating velocity of an object passing through the light panel frame space and through a frame space of another identical light panel spaced apart therefrom and on a common axis therewith, and for transmitting data regarding the velocity, size, and location coordinates, the method further comprising detecting with the associated electronic sensing apparatuses interruption of the light beams by an object passing through the frame space, calculating with the calculating apparatus velocity and size and location coordinates of the object passing through the frame space and producing data indicative thereof, and transmitting the data to another device.

30. The method of claim 28 wherein the object is a bullet fired from a gun.

31. The method of claim 28 wherein the light emitter adjacent the second end of the at least one light emitting fiber optic is a laser.

32. The method of claim 28 wherein the lens means is a line generating lens emitting a fan-shaped plane of light.

33. The method of claim 11 wherein the object is a continuous web passing through the frame space and the method further comprising monitoring the continuous web as it passes through the light panel.

34. A method for monitoring a gas stream passing through a frame space of a light panel, the light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam, across the frame through which and beyond which a gas stream may pass, and at least one light detector on the second side of the frame and associated electronic sensing apparatus connected to the at least one light detector for continuously detecting a portion of the fan-shaped light beam from the at least one light emitter that passes through the gas stream, the method comprising detecting with the at least one light detector and associated electronic sensing apparatus the portion of the fan-shaped light beam that passes through the gas stream, and generating with the electronic sensing apparatus a signal signalling the amount of the fan-shaped beam that passes through the gas stream.

35. The method of claim 1 wherein there is at least one reflector for reflecting the fan-shaped light beam from the at least one light emitter to the at least one light detector, the method further comprising reflecting the fan-shaped light beam from the at least one light emitter to the at least one light detector.

36. The method of claim 35 wherein the at least one reflector is on the light panel.

37. The method of claim 1 wherein the at least one light emitter is at least two spaced apart light emitters and the at least one light detector is at least two light detectors with at least one light detector positioned opposite each of the at least two spaced apart light emitters and wherein the object interrupts a specific part of the fan-shaped light beam, the at least one light detector comprising a plurality of light detectors and associated electronic sensing apparatus so that interruption of the specific part of the fan-shaped light beam is sensed by at least one of the plurality of light detectors and a signal is generated indicating which light detector sensed said interruption thereby indicating a location in the frame space interrupted by the object, the method further comprising, sensing the object's interruption of the fan-shaped light beam with at least one of the light detectors and associated electronic sensing apparatus, and generating a signal with the associated electronic sensing apparatus indicative of location of the interruption by the object.

38. A method for monitoring a liquid stream passing through a frame space of a light panel, the light panel comprising a frame with a top, a bottom spaced apart from the top, a first side between the top and the bottom, and a second side spaced apart from the first side, the second side between the top and the bottom, the frame defining a frame space between its top, bottom, and two sides, at least one light emitter on the first side, the at least one light emitter for continuously emitting a fan-shaped light beam, across the frame through which and beyond which a liquid stream may pass, and at least one light detector on the second side of the frame and associated electronic sensing apparatus connected to the at least one light detector for continuously detecting a portion of the fan-shaped light beam from the at least one light emitter that passes through the liquid stream, the method comprising detecting with the at least one light detector and associated electronic sensing apparatus the portion of the fan-shaped light beam that passes through the liquid stream, and generating with the electronic sensing apparatus a signal signalling the amount of the fan-shaped beam that passes through the liquid stream.

* * * * *